US007473016B2

(12) United States Patent
Flaherty et al.

(10) Patent No.: US 7,473,016 B2
(45) Date of Patent: Jan. 6, 2009

(54) LIGHTED BOLLARD

(75) Inventors: Richard A. Flaherty, Grapeview, WA (US); Matthew A. Gray, Bremerton, WA (US); Michael P. Coffey, Port Orchard, WA (US)

(73) Assignee: Leader Manufacturing, Inc., Port Orchard, WA (US)

( * ) Notice: Subject to any disclaimer, the term of this patent is extended or adjusted under 35 U.S.C. 154(b) by 269 days.

(21) Appl. No.: 11/265,034

(22) Filed: Nov. 2, 2005

(65) Prior Publication Data

US 2006/0109667 A1 May 25, 2006

Related U.S. Application Data

(60) Provisional application No. 60/655,160, filed on Feb. 22, 2005, provisional application No. 60/631,132, filed on Nov. 26, 2004, provisional application No. 60/631,017, filed on Nov. 24, 2004.

(51) Int. Cl.
*F21S 8/00* (2006.01)

(52) U.S. Cl. ..... 362/431; 362/152; 362/351; 362/555

(58) Field of Classification Search ..... 362/431, 362/555, 153.1, 152, 153, 367, 249, 559, 362/560, 576, 551, 410–415, 403, 455, 351, 362/581; 40/546, 547, 579
See application file for complete search history.

(56) References Cited

U.S. PATENT DOCUMENTS

| | | | | | |
|---|---|---|---|---|---|
| 1,034,211 | A | | 7/1912 | De Palma | |
| 1,629,946 | A | * | 5/1927 | Angel | 362/238 |
| 2,355,467 | A | * | 8/1944 | Proulx | 362/225 |
| D158,821 | S | | 5/1950 | Walter | |
| 2,960,361 | A | * | 11/1960 | Boutelle | 292/17 |
| 3,257,496 | A | | 6/1966 | Hamilton | |
| 3,521,047 | A | * | 7/1970 | Smith | 362/222 |
| D235,797 | S | | 7/1975 | Friedburg | |
| 4,064,430 | A | * | 12/1977 | Owens | 362/231 |
| 4,096,555 | A | * | 6/1978 | Lasker | 362/302 |
| 4,438,484 | A | * | 3/1984 | Winden | 362/267 |
| D318,136 | S | | 7/1991 | Kira | |

(Continued)

OTHER PUBLICATIONS

All bollard designs by sitespecifier on webpage titled: "Bollards". Found onlien at sitespecifier.com on May 18, 2007.

(Continued)

*Primary Examiner*—Sandra L. O'Shea
*Assistant Examiner*—Gunyoung T. Lee
(74) *Attorney, Agent, or Firm*—Van Dyke, Gardner, Linn & Burkhart, LLP

(57) ABSTRACT

A lighted post includes a stanchion and a light assembly. The light assembly includes a body, with a light emitting surface, and a light source that is coupled to the body. The light assembly is adapted for coupling to a power source for powering the light source. When powered light from the light source is directed into the body and is directed from the body through the light emitting surface. The light assembly is mounted to the stanchion, with the body being located in a light transmitting opening provided in the stanchion, such that the light emitting surface faces outwardly from the stanchion to thereby direct light outwardly from the stanchion.

19 Claims, 59 Drawing Sheets

U.S. PATENT DOCUMENTS

| | | | | | |
|---|---|---|---|---|---|
| 5,134,550 | A | * | 7/1992 | Young | 362/560 |
| 5,151,679 | A | * | 9/1992 | Dimmick | 340/326 |
| 5,161,874 | A | * | 11/1992 | Benes | 362/552 |
| 5,388,357 | A | * | 2/1995 | Malita | 40/570 |
| D372,320 | S | | 7/1996 | Brady | |
| D373,000 | S | | 8/1996 | Brady | |
| 5,829,913 | A | * | 11/1998 | Puckett | 404/6 |
| D425,646 | S | | 5/2000 | Giese et al. | |
| D426,013 | S | | 5/2000 | Landefled | |
| D435,130 | S | | 12/2000 | Landefeld | |
| D435,309 | S | | 12/2000 | Landefeld | |
| D439,000 | S | | 3/2001 | Landefeld | |
| D440,339 | S | | 4/2001 | Landefeld | |
| D442,312 | S | | 5/2001 | Metchear, III | |
| D453,583 | S | | 2/2002 | Shimada | |
| 6,457,847 | B1 | * | 10/2002 | LeVasseur | 362/351 |
| 6,530,675 | B1 | * | 3/2003 | Van Etten | 362/267 |
| D479,355 | S | | 9/2003 | Dalton et al. | |
| 6,705,751 | B1 | * | 3/2004 | Liu | 362/431 |
| 6,971,781 | B2 | * | 12/2005 | Guy | 362/576 |
| 7,083,315 | B2 | * | 8/2006 | Hansler et al. | 362/559 |
| 7,086,769 | B1 | * | 8/2006 | Thompson et al. | 362/559 |
| 7,150,117 | B2 | | 12/2006 | Venegas, Jr. | |
| 7,175,326 | B2 | * | 2/2007 | Bossomo | 362/554 |
| 2002/0114170 | A1 | | 8/2002 | Chen et al. | |
| 2006/0109667 | A1 | | 5/2006 | Flaherty et al. | |
| 2007/0008717 | A1 | | 1/2007 | Flaherty | |

OTHER PUBLICATIONS

All "Lighted Bollard Styles" by King Luminaire at kingluminaire.com. © 2007.

All "Unlit Bollard Styles" by King Luminaire at kingluminaire.com. © 2007.

* cited by examiner 1110
1120
1114

1110
1120
1121c
1122
LXXX
LXXX 1110
1114
1142
1110
1140
1140
1140
1121d
1144
1121a
1121b
1144a
1144a
1114
1144

1110
1120
1121
1121b
1121d
1121a
1114
1121c
1122

1720
1710
1734
1714
1712

1720
1712
1710
1734
1714
1712
X
X

1712

BOTTOM 1710
1714
1712
1720

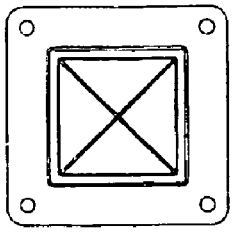
FIG. 122
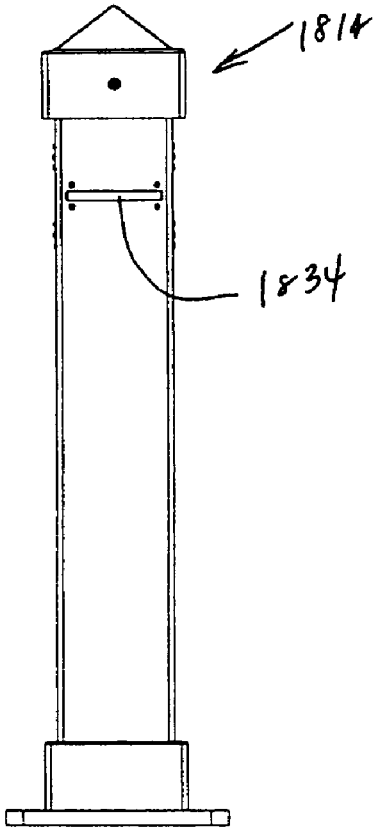
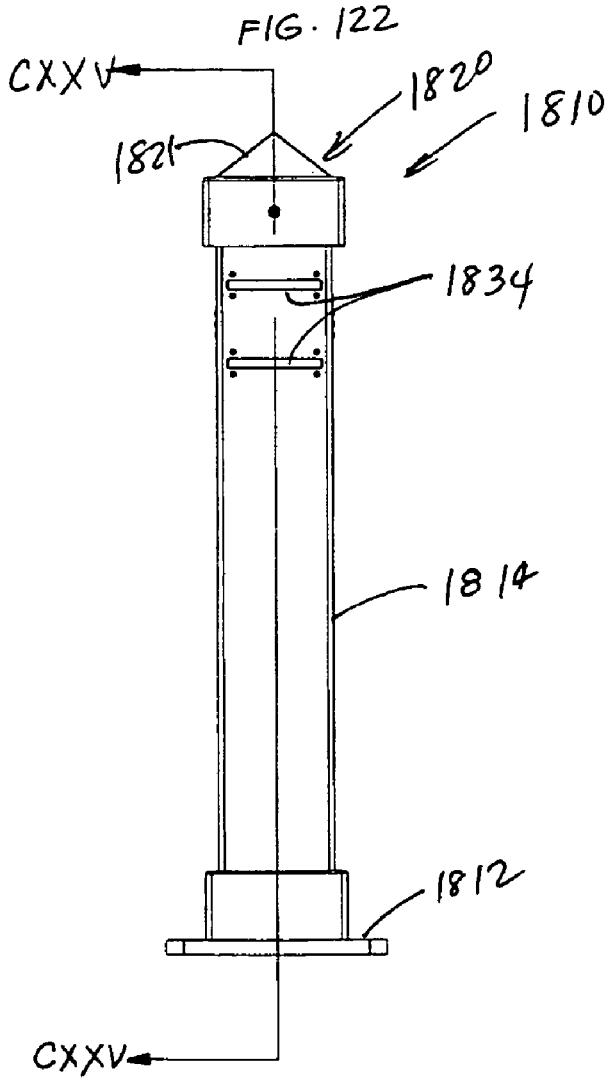
FIG. 121
FIG. 120
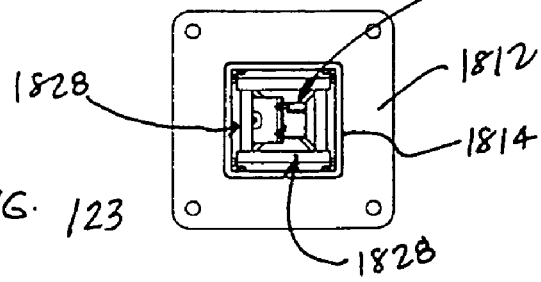
FIG. 123

LIGHTED BOLLARD

CROSS REFERENCES TO RELATED APPLICATIONS

This application is related to and claims the benefit of provisional applications entitled LIGHTED POST ASSEMBLY, Ser. Nos. 60/631,017; 60/631,132; 60/655,160, filed Nov. 24, 2004; Nov. 26, 2004; and Feb. 22, 2005, respectively, which are herein incorporated by reference in their entireties.

TECHNICAL FIELD AND BACKGROUND OF THE INVENTION

The present invention generally relates to lighted posts and, more particularly, to lighted posts that may be used as bollards or pathway lights.

Lighted posts have been used for years to light the entrance way of a building or a residence or to light an area, such as a walkway or deck, including a pool deck. Most residential lights are formed from a support post and a housing that is mounted to the post. The housing typically houses one or more lights, such as halogen lights or the like, and incorporates light transmitting openings through which the light passes to illuminate the ground or the light post itself. Some light transmitting openings have covers or lenses to diffuse or direct the light. Other openings are left uncovered. A lighted post may also be formed from a tubular member that provides a support, as well as a housing for the light. These lighted posts tend to be used in commercial applications.

However, the light sources used in conventional lighted posts produce a significant amount of heat and, further, consume a considerable amount of energy. If the light sources are energized for a significant length of time the housing may become quite hot. Consequently, the housings typically incorporate louvers to allow air flow through the housing to cool the air in the housing and, hence, cool the housing. These louvers or openings, however, tend to detract from the appearance of the housing. In addition, the light is generated by discrete light sources that results overlapping puddles of light, which produce a non-uniform light intensity.

Consequently, there is a need for a lighted post that can be assembled in a manner to eliminate the need for louvers and further to reduce its power consumption.

SUMMARY OF THE INVENTION

Accordingly, the present invention provides a lighted post that can be assembled in a manner to reduce or minimize the bug and dirt intrusion into the post and, further, configured in a manner to reduce its power consumption.

In one form of the invention, a lighted post includes a stanchion, a light assembly, and a light transmitting opening provided at the wall of the stanchion. The light assembly includes a light source and a body with a light emitting surface. The light assembly is adapted for coupling to a power source for powering the light source so that when powered, light from the light source is directed into the body and is directed from the body through the light emitting surface. The light assembly is mounted so that the body is located in the light transmitting opening wherein the light emitting surface, which faces outwardly from the stanchion, directs light outwardly from the stanchion.

In one aspect, the stanchion comprises a tubular member.

According to another form of the invention, a lighted post includes a tubular member, a cover, and a light assembly. The tubular member has an upper open end, which is closed by the cover, a lower open end, which is adapted to mount to a fixed surface, a wall, and a chamber defined by the wall. The light assembly has a light source and a body with a light emitting surface and is adapted for coupling to a power source for powering the light source. When powered, light from the light source is directed into the body and is directed from the body through the light emitting surface. A light transmitting opening is provided at the wall of the tubular member, with the light assembly mounted so that the body of the light assembly is located in the opening and so that the light emitting surface, which faces outwardly from the tubular member, directs light outwardly from the tubular member.

In one aspect, the tubular member comprises a metal tubular member, such as tubesteel. For example, the tubular member may comprise a rectangular tubular member, such as a square tubular member, or a round tubular member.

In yet another form of the invention, a lighted post includes a base, a tubular member, which is mounted to the base, a cover that is mounted to the upper open end of the tubular member and closes the upper open end, and a light assembly. The light assembly includes a light emitting diode and a body with a light emitting surface. The light assembly is adapted for coupling to a power source for powering the light emitting diode so when powered, light from the light emitting diode is directed into the body and is directed from the body through the light emitting surface. In addition, a light transmitting opening is provided at the tubular wall of the tubular member, with the body located at the light transmitting opening so that the light emitting surface faces outwardly from the tubular member through the light transmitting opening to thereby direct light outwardly from the tubular member. Further, the light transmitting opening is substantially closed and the tubular member is substantially free of any unclosed openings wherein the chamber remains substantially free from intrusion from bugs.

In yet another form of the invention, a lighted post includes a base, a tubular member, and a light assembly. The light assembly includes a light emitting diode and a body with a light emitting surface and is adapted for coupling to a power source for powering the light emitting diode. When powered, light from the light emitting diode is directed into the body and directed from the body through the light emitting surface. The tubular member includes an access opening that is covered by a panel, which includes a light transmitting opening. The light assembly is mounted so that its body is located at the light transmitting opening to thereby direct light outwardly from the tubular member through the light transmitting opening.

In another form, a lighted post includes a support, a light assembly, and a cover that is mounted to the support and that forms a cover for the light assembly. The light assembly includes a light source and a body with a light emitting surface. The light assembly is adapted for coupling to a power source for powering the light source so that when powered, light from the light source, which is directed into the body, is directed from the body through the light emitting surface. The body is configured to diffuse the light in a manner so that when light is emitted by the light emitting surface it has a substantially uniform light intensity pattern. The light assembly is mounted in the cover at the support, with the light emitted from the light assembly's light emitting surface directed downwardly toward the surface on or in which the lighted post is mounted. Further, the cover is adapted to substantially seal the light assembly in the cover.

In one aspect, the support comprises a tubular member, including a square tubular member or a round tubular member, with an open upper end. The cover is mounted over the open upper end and closes and substantially seals the open upper end of the support.

In another aspect, the body of the light assembly comprises an elongated body, such as a waveguide, which extends around at least a portion of the perimeter of the support post to provide a substantially uniform pattern of light around at least a portion of the lighted post. In preferred form, the light assembly includes at least two bodies and at least two light sources, with the two bodies configured to substantially extend around the full perimeter of the support to thereby form a substantially uniform pattern of light around the lighted post.

According to another form of the invention, a lighted post includes a support, a cover, and at least one light assembly. The support is adapted to mount on or in a ground surface or a base and comprises a tubular member with an upper open end, which is closed by the cover, and a lower open end. The light assembly has a light source and a body with a light emitting surface and is adapted for coupling to a power source for powering the light source. When powered, light from the light emitting surface is directed downwardly to illuminate at least the ground surface or base with a substantially uniform pattern of light.

In one aspect, the tubular member comprises a plastic tubular member, such as reinforced plastic. The tubular member may comprise a rectangular tubular member, such as a square tubular member, or a round tubular member. In a further aspect, the cover comprises a plastic cover.

In yet a further aspect, the lighted post includes a bracket which mounts the cover to the tubular member. The light assembly may be positioned between the cover and the bracket, for example.

According to yet a further aspect, the light assembly is mounted to the bracket with its light emitting surface facing downwardly toward the ground surface.

According to yet another form of the invention, a lighted post includes a tubular support, a light assembly, and a cover that is mounted to the upper end of the support. The tubular body or the cover includes at least one transverse opening that extends through the wall of the support or the cover to form a light transmitting opening. The light assembly includes a light source and a body with a light emitting surface, which is positioned in the light transmitting opening. The light assembly is adapted for coupling to a power source for powering the light source so that when powered, light from the light source, which is directed into the body, is directed from the body through the light emitting surface and directed outwardly from the lighted post through the light transmitting opening.

For example, the light transmitting opening may comprise an elongate opening oriented such that its longitudinal extent is aligned with the vertical axis of the tubular support.

In one aspect, the tubular support includes an open upper end. The cover is mounted over the open upper end and closes and substantially seals the open upper end of the support. In a further aspect, the cover includes a downwardly depending cylindrical wall that is mounted to the tubular support. For example, the light transmitting opening may be provided in the cylindrical wall of the cover. Optionally, the cylindrical wall may include a plurality of light transmitting openings, with each opening associated with a light assembly.

In a further aspect, the cover is adapted to substantially seal the light assembly in the support.

In any of the above forms of the invention, the light source may comprise a plurality of light emitting diodes, such as a plurality of high intensity light emitting diodes. The body of the light assembly may comprise an elongated body, and, further, may act as a waveguide. In preferred form, the waveguide has a curved outer surface, which forms the light emitting surface for fanning the light from the light emitting diodes outwardly. According to yet another aspect, the lighted posts further may include a bracket, with the body of the light assembly including a groove and with the bracket extending into the groove for mounting the light assembly. In yet another aspect, the body of the light assembly substantially fills the opening wherein the post is substantially free of unclosed openings. The light emitting surface may be recessed in the opening or may project outwardly from the opening, or may be flush with the exterior.

In addition, in any of the above forms of the invention, the lighted post may include a plurality of light assemblies and a corresponding plurality of light transmitting openings. Each of the light assemblies has a light source and a body, which may act as a wave guide. Further, the body or bodies are preferably positioned at a respective light transmitting opening so that each of the light emitting surfaces faces outwardly from the post at the respective light transmitting opening. In a further aspect, the light assemblies may be mounted using a single bracket. In addition, each of the bodies may have a groove to provide an engagement surface for mounting the light assembly. For example, in one aspect, the bracket extends into the respective grooves of the bodies of the light assemblies to thereby mount the light assemblies to the post. For example, the bracket may comprise a plate with a plurality of slots extending into the plate from an edge of the plate. The slots form a plurality of spaced lateral edges, with the bodies of the light assemblies received in the slots and engaged by the lateral edges. In yet another aspect, the lighted post may include a side panel, with the side panel having the light transmitting opening.

Accordingly, the lighted post of the present invention is particularly suitable for use as a pathway light or bollard. The lighted post consumes less energy and produces less heat than conventional pathway lights and, further, significantly reduces, if not eliminates, bug or dirt intrusion into the post. These and other objects, advantages, purposes, and features of the invention will become more apparent from the study of the following description taken in conjunction with the drawings.

DETAILED DESCRIPTION OF THE DRAWINGS

Figure 81:
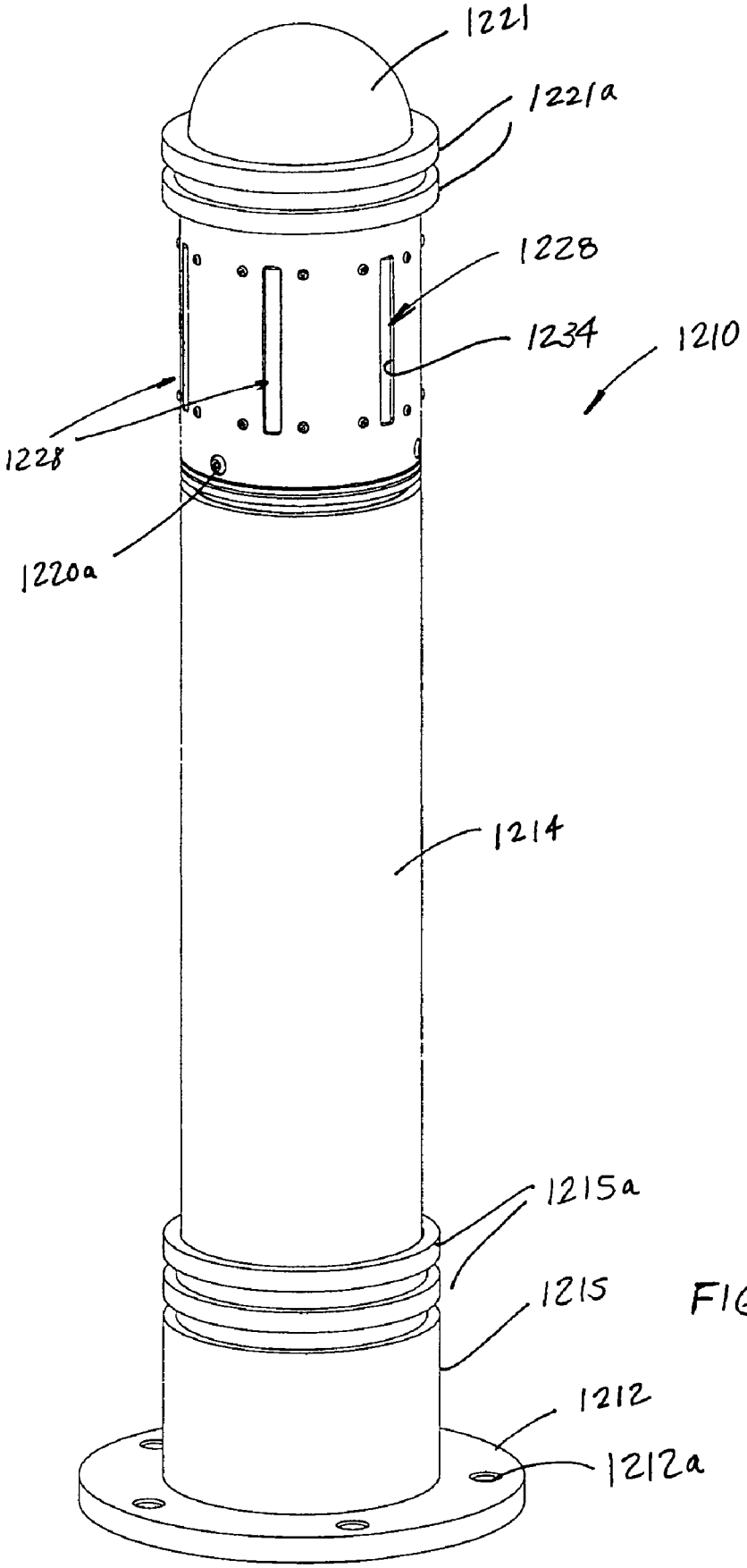
FIG. 81 is a perspective view of another embodiment of the lighted post of the present invention.
Figure 84:
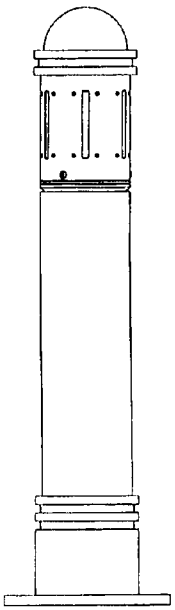
FIG. 84 is a right side elevation view of the lighted post of FIG. 82.
Figure 85:
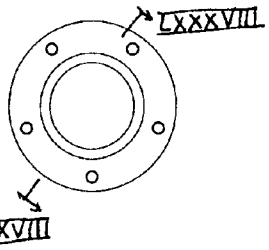
FIG. 85 is a top plan view of the lighted post of FIG. 82.
Figure 82:
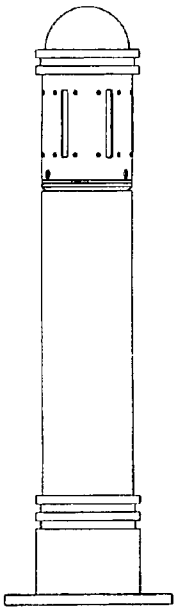
FIG. 82 is a front elevation view of the lighted post of FIG. 81.
Figure 86:
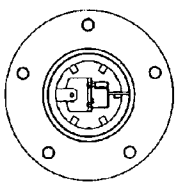
FIG. 86 is a bottom plan view of the lighted post of FIG. 82.
Figure 83:
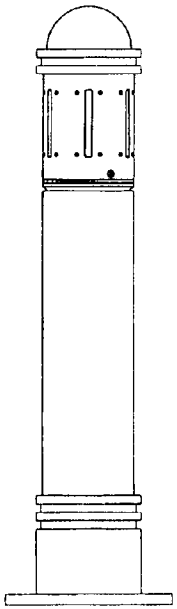
FIG. 83 is a left side elevation view of the lighted post of FIG. 82.
Figure 89:
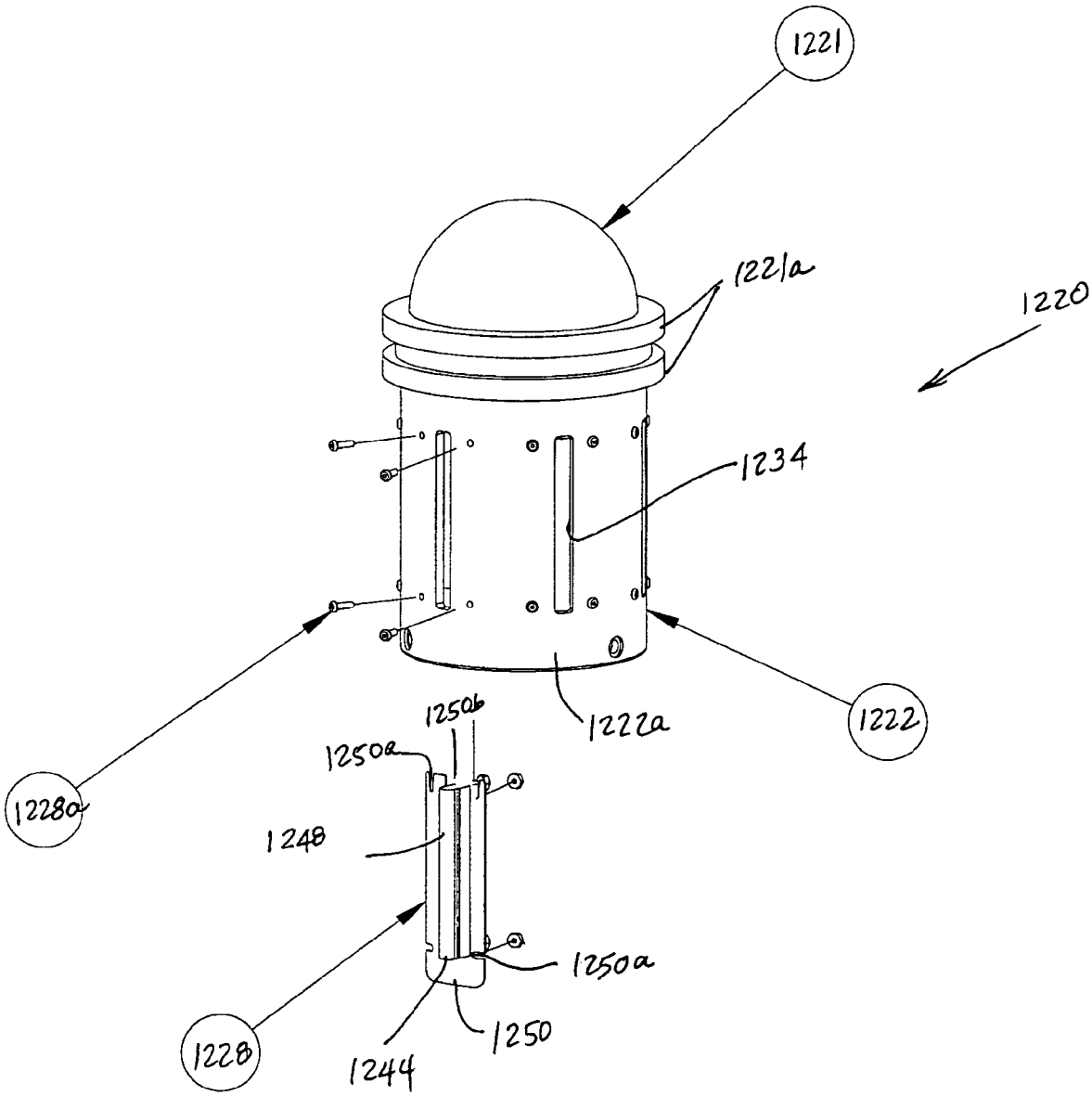
Figure 93:
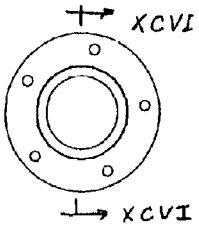
Figure 90:
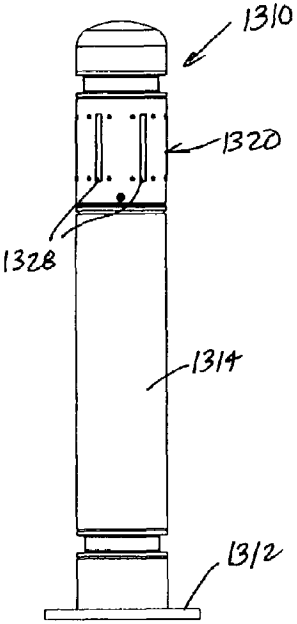
Figure 92:
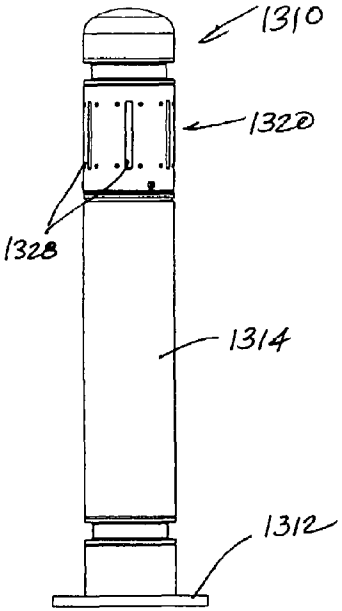
Figure 91:
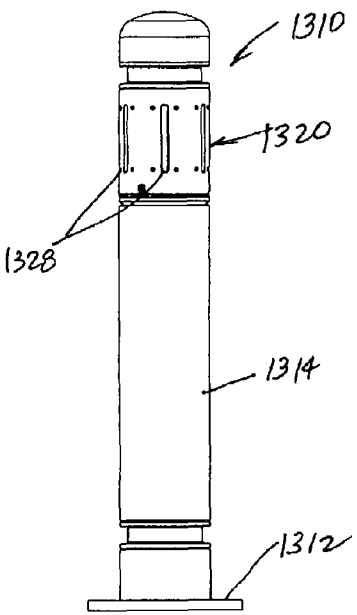
Figure 94:
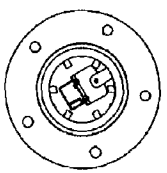
Figure 95:
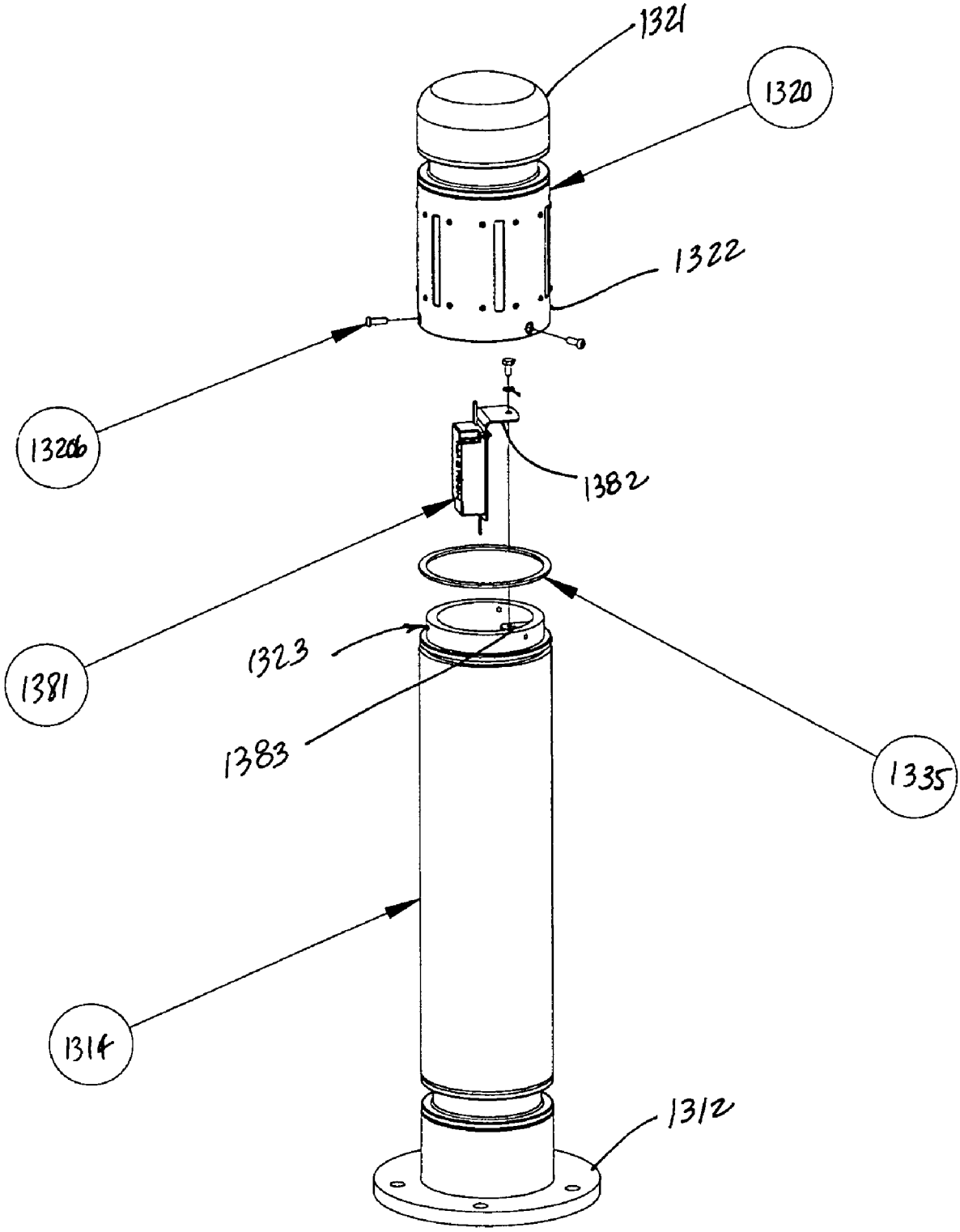
Figure 96:
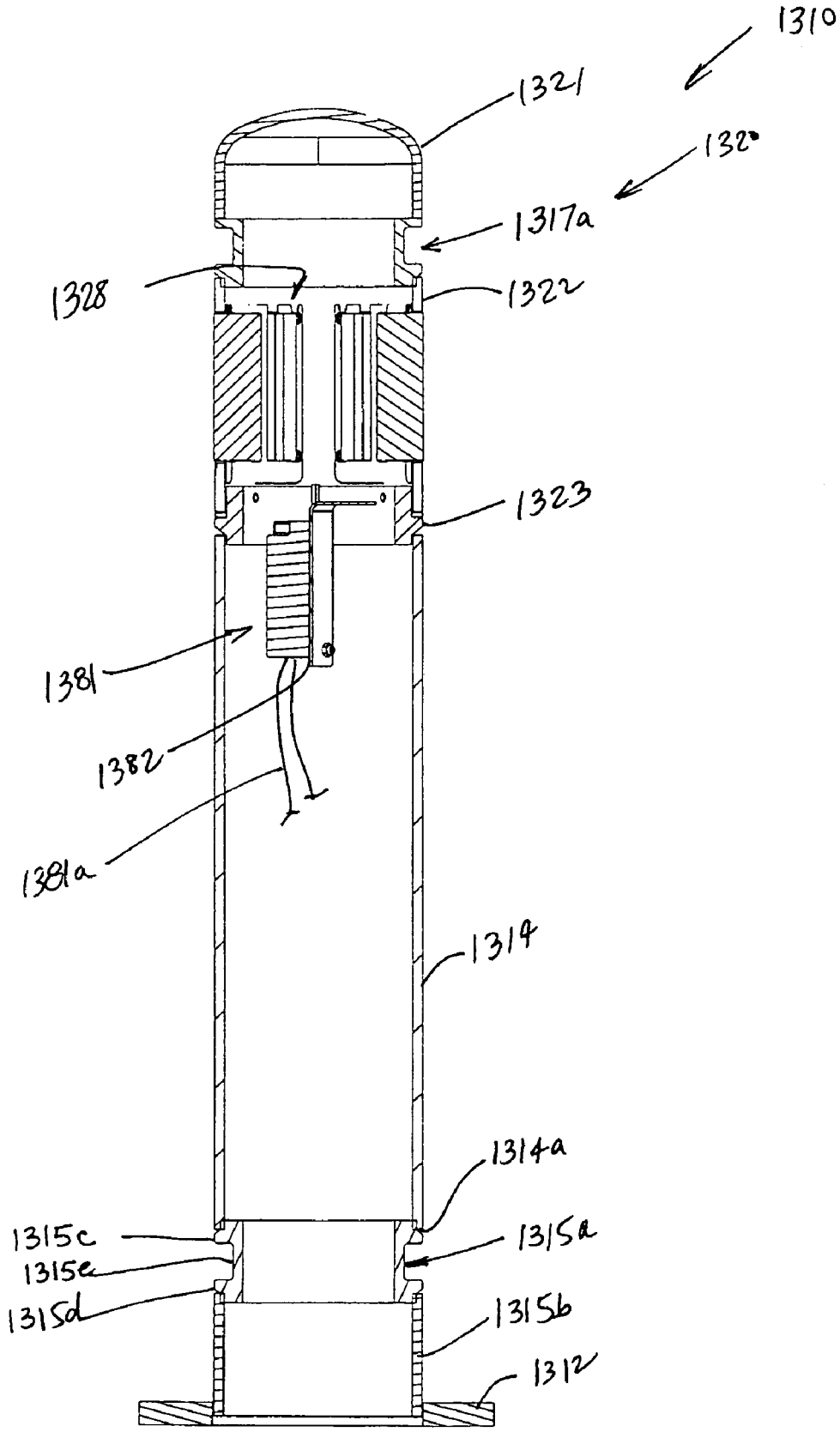
Figure 97:
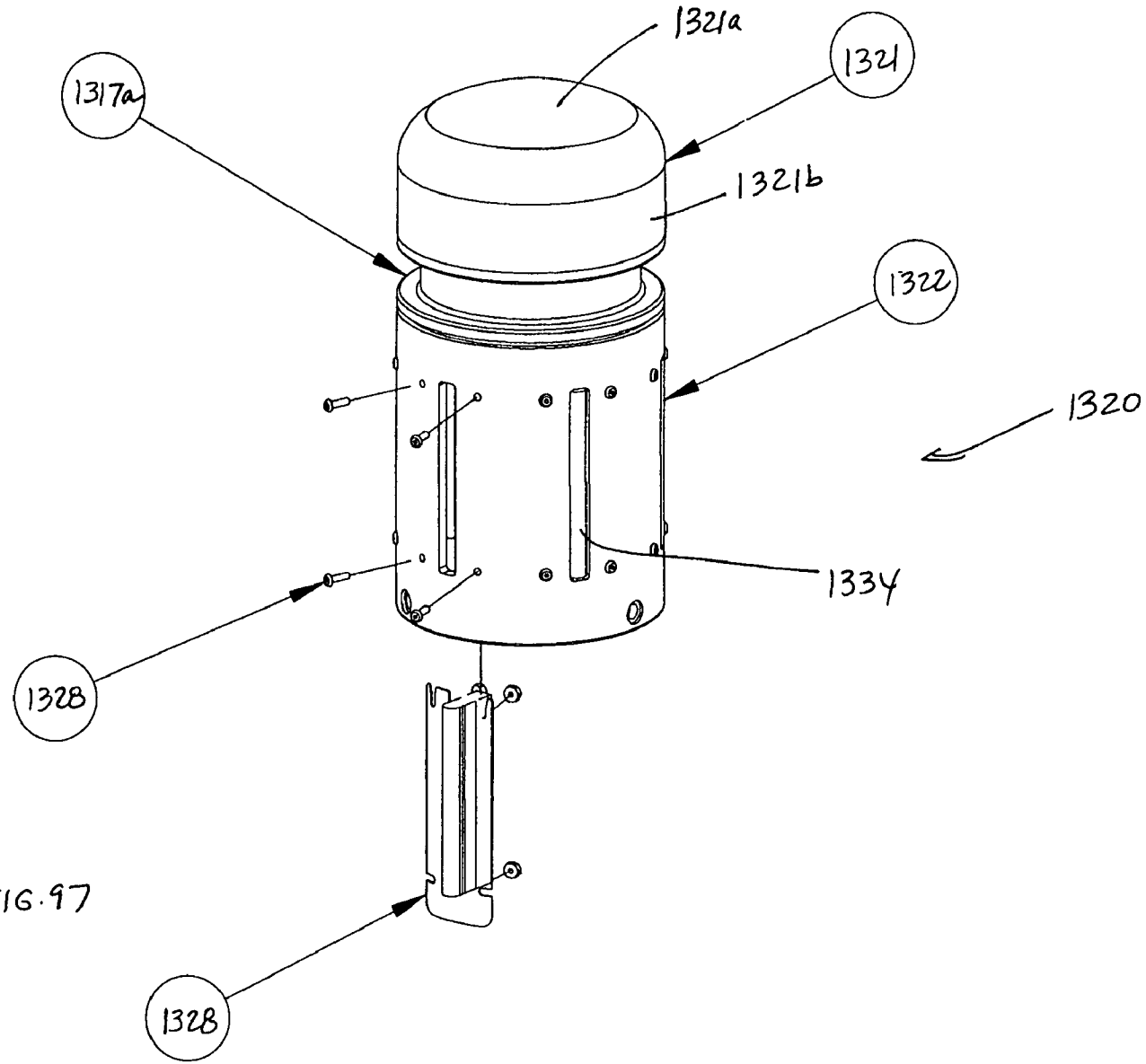
Figure 101:
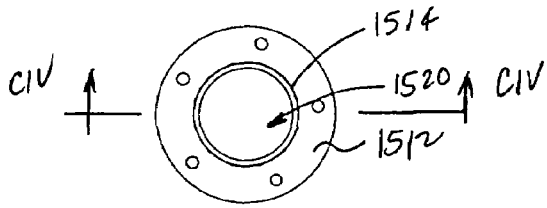
Figure 99:
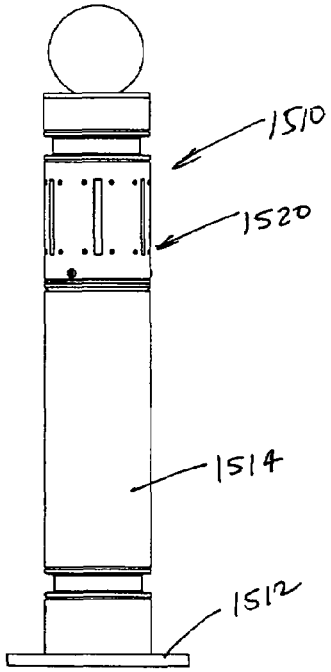
Figure 98:
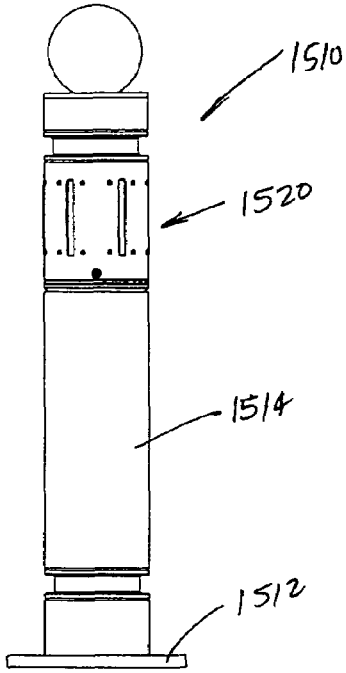
Figure 100:
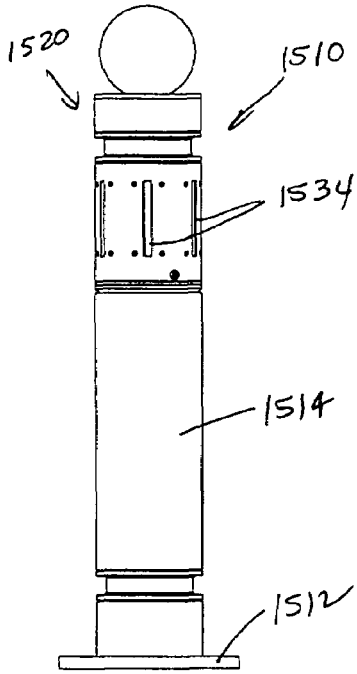
Figure 102:
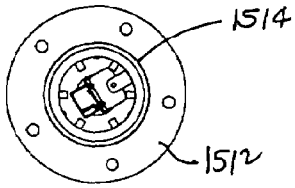
Figure 103:
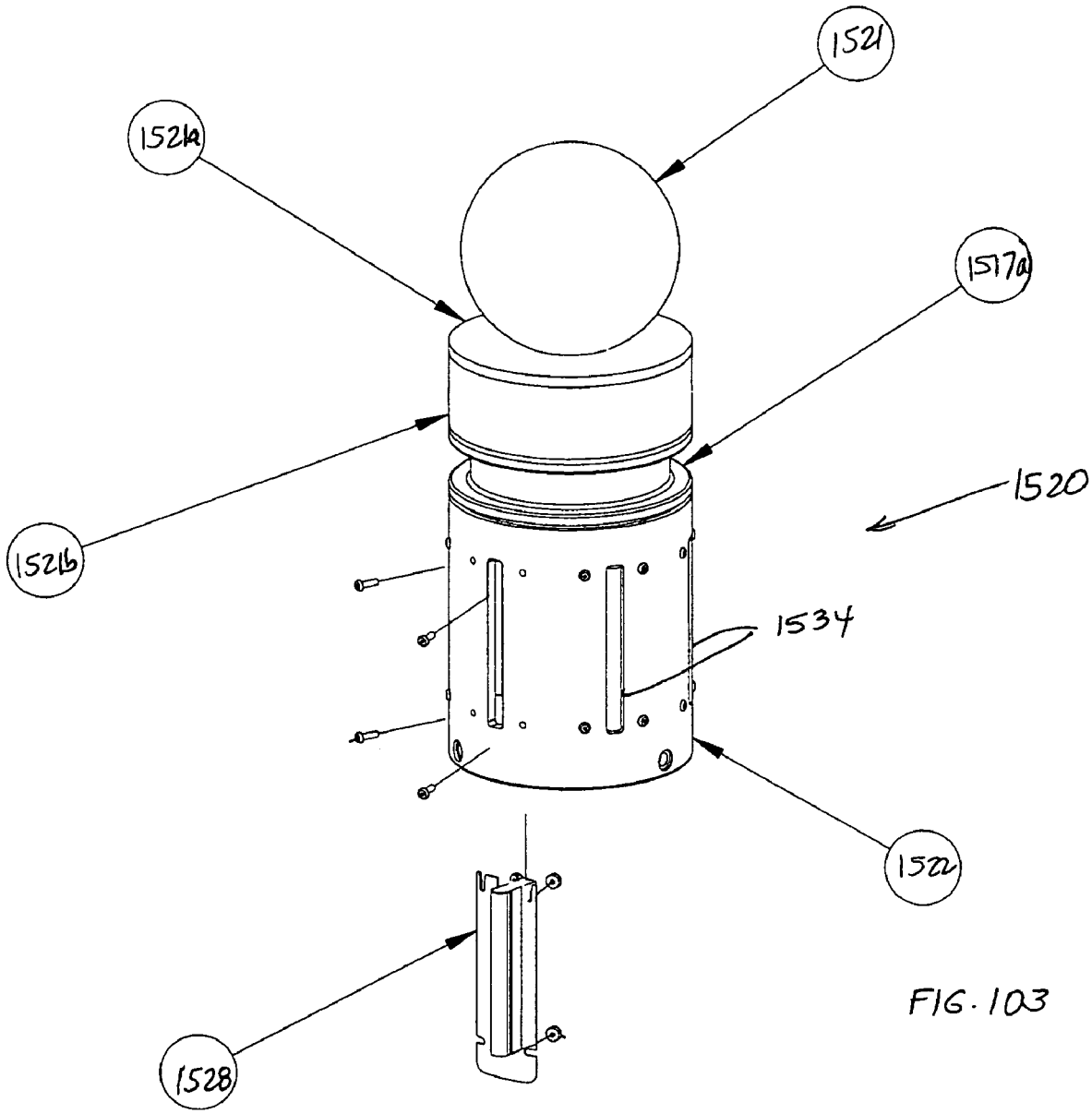
Figure 104:
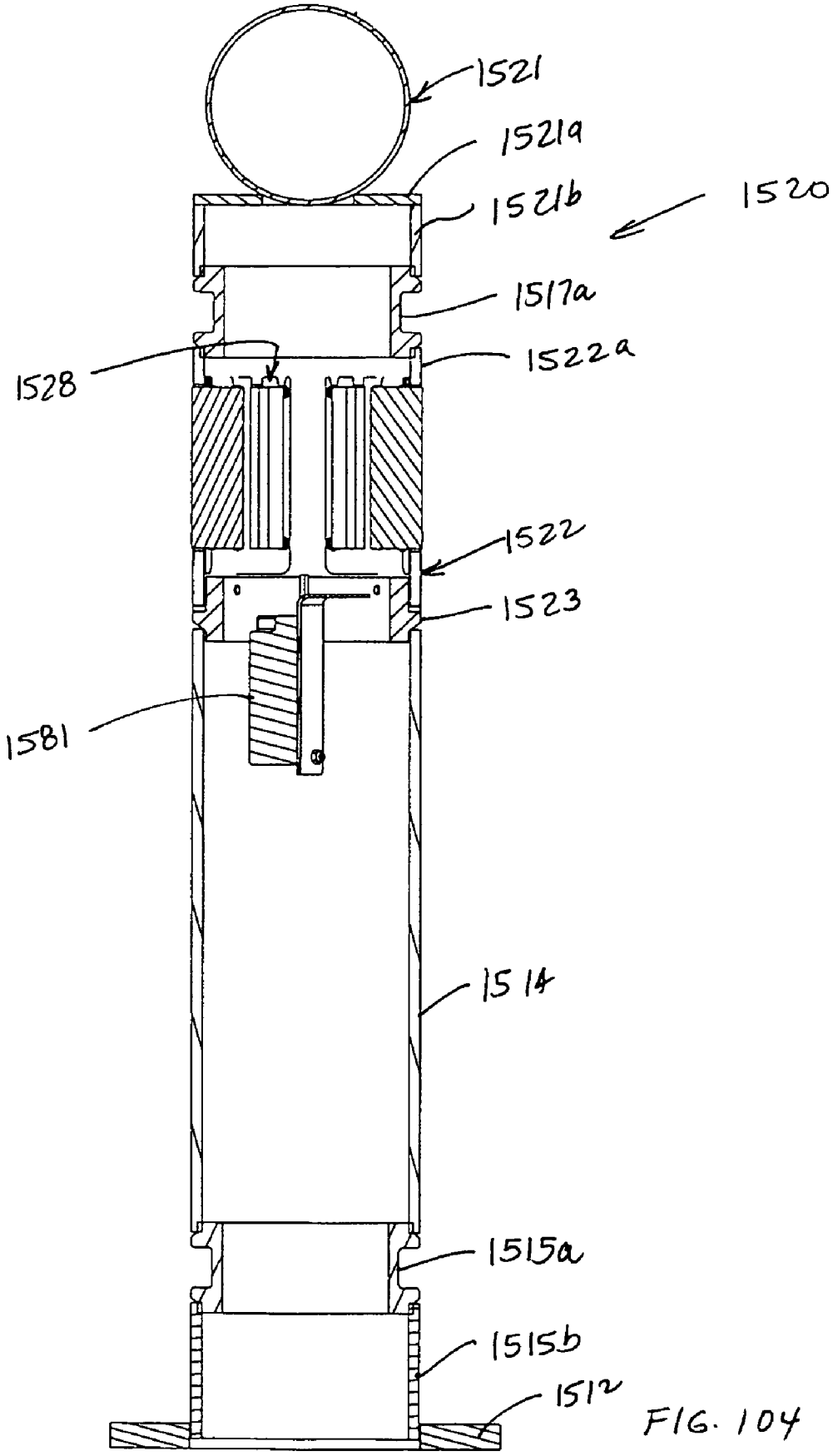
Figures 105, 106, 107, 108, 109:
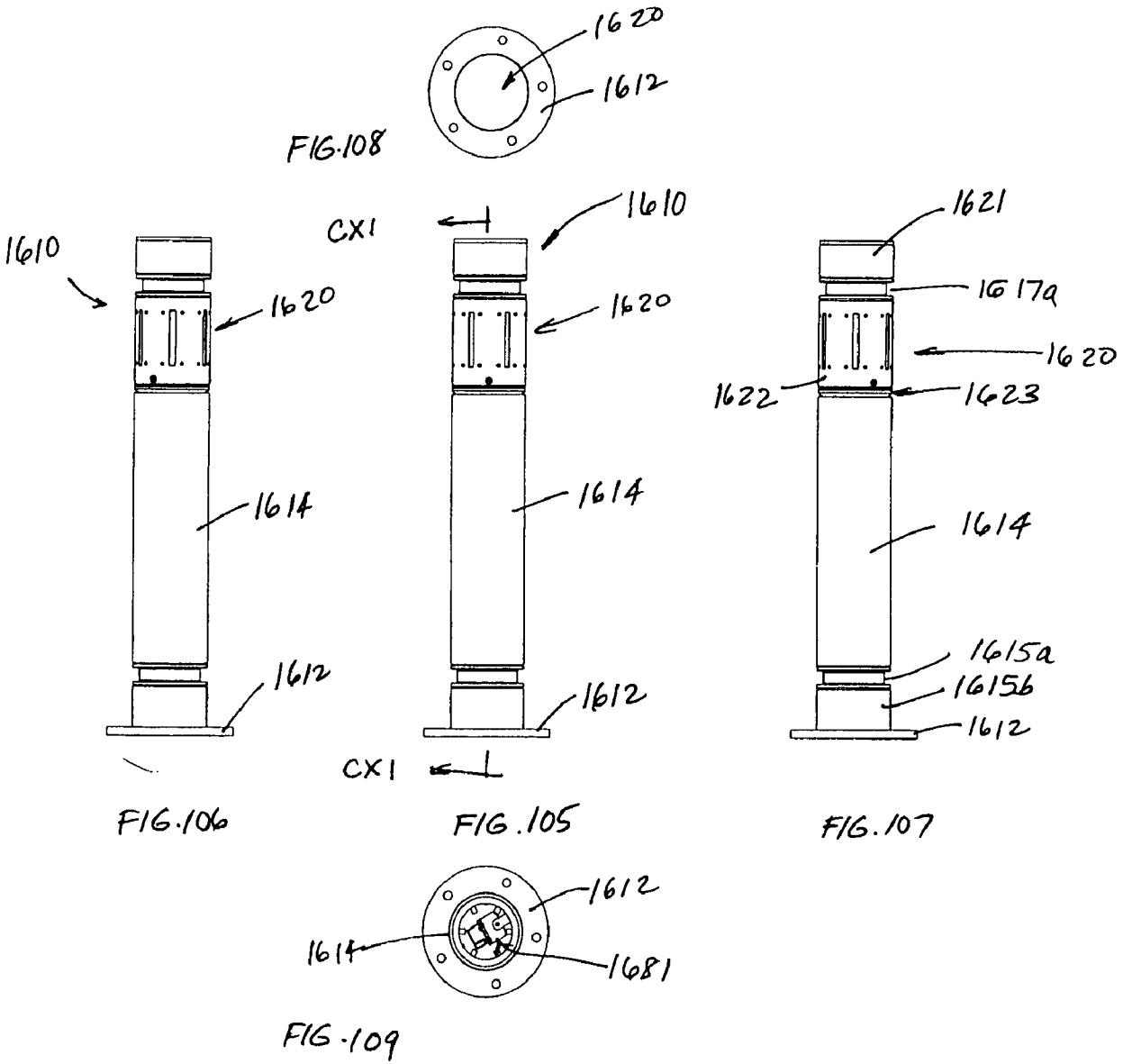
Figure 110:
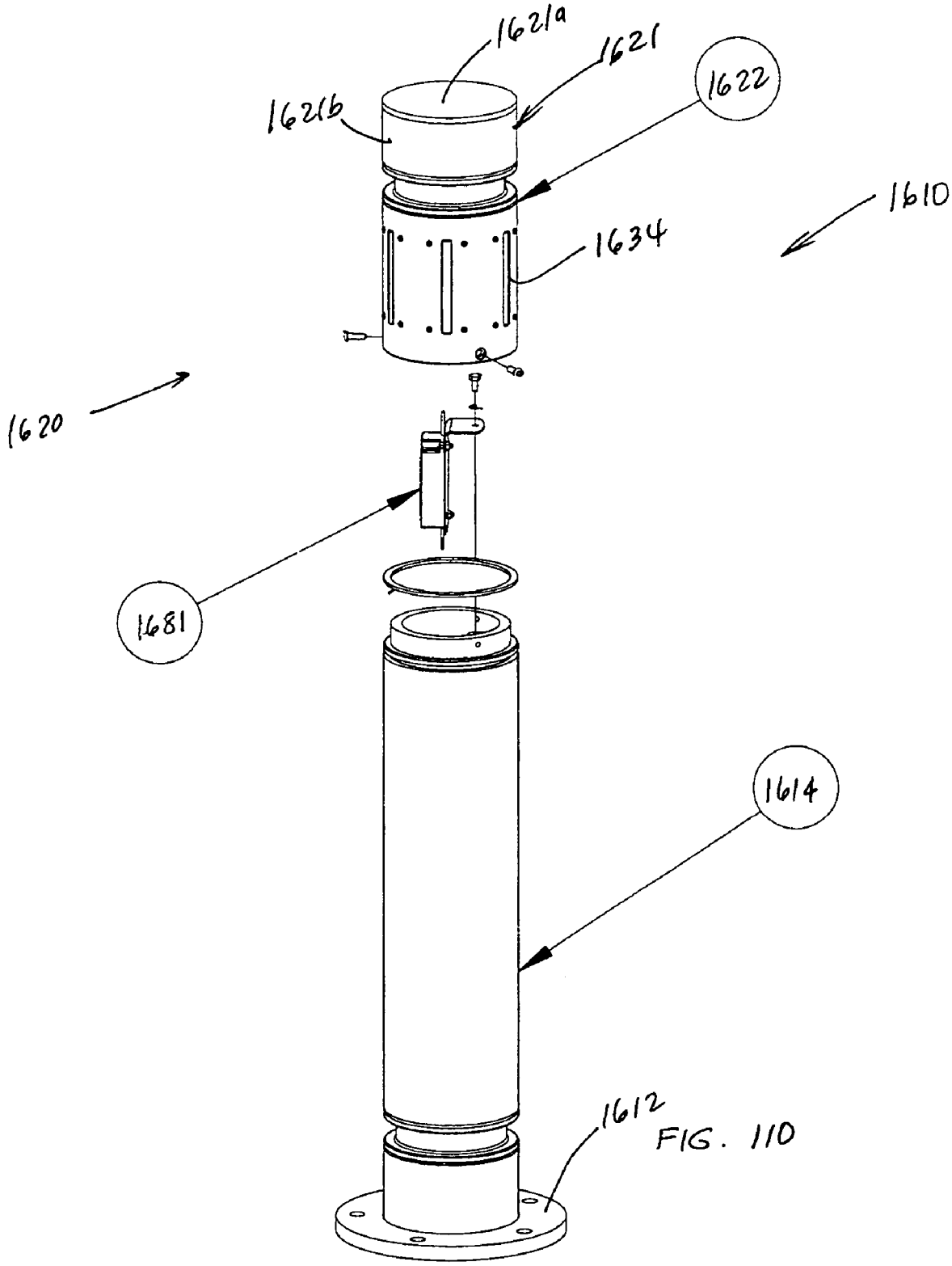
Figure 111:
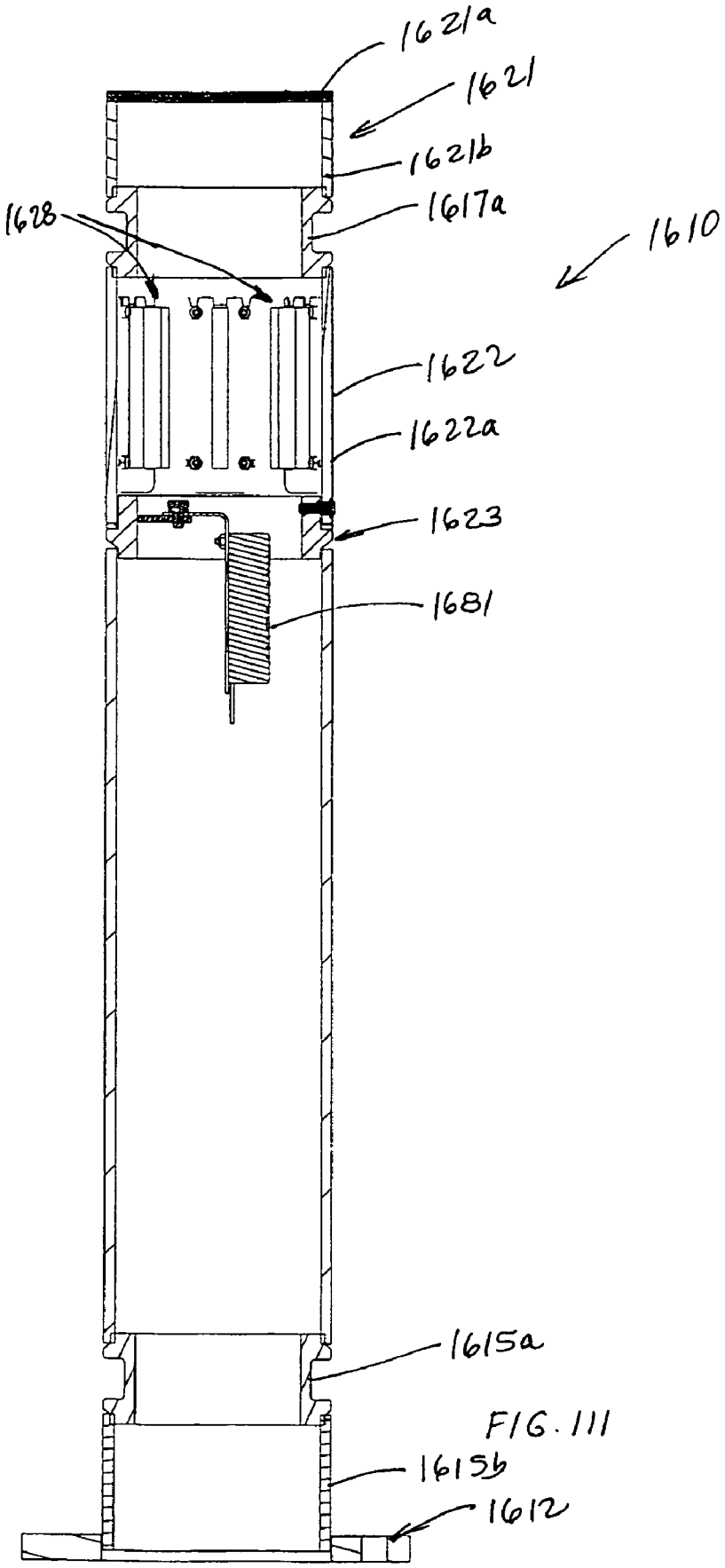
Figure 112:
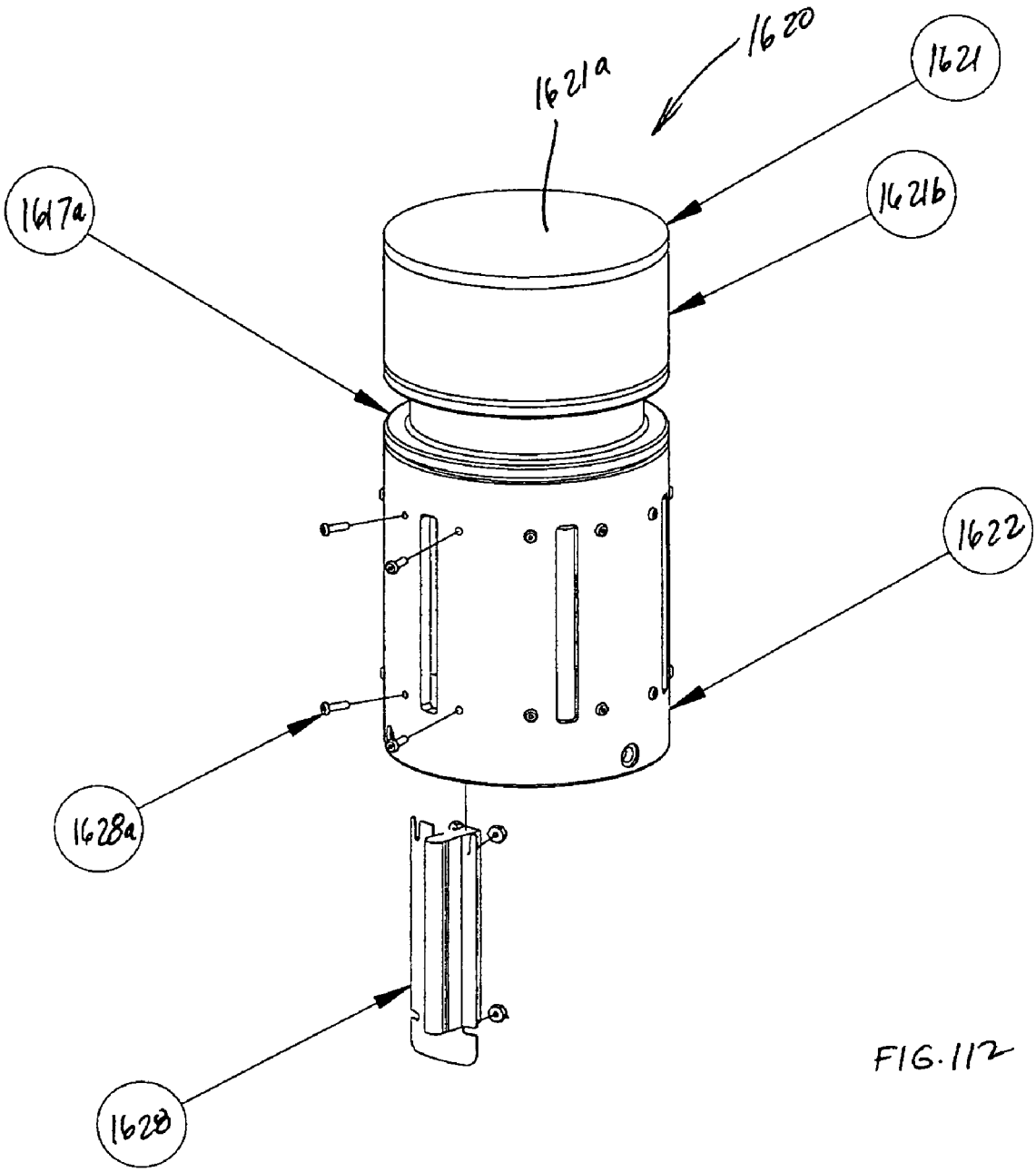
Figures 113, 114, 115, 116, 117:
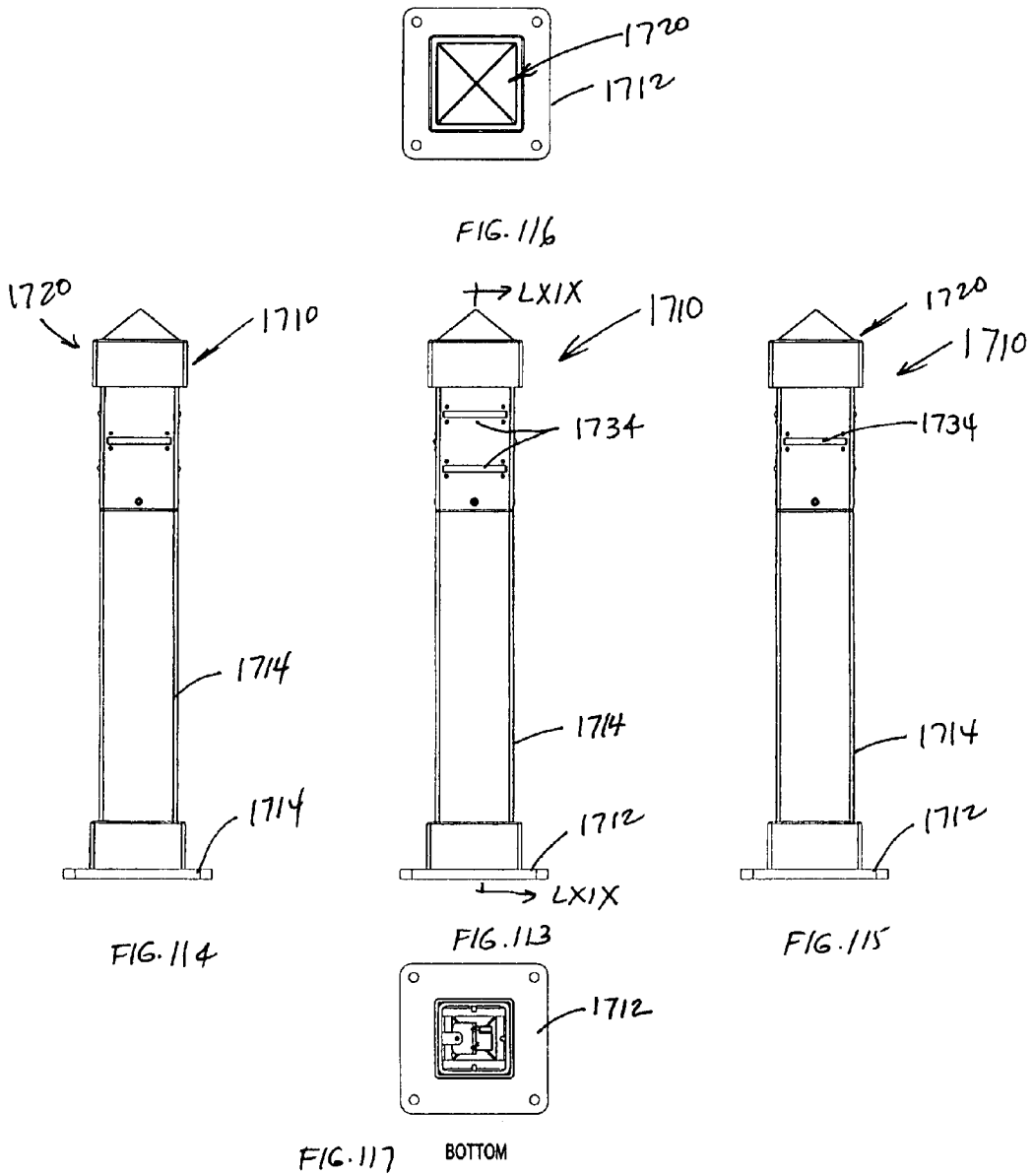
Figure 118:
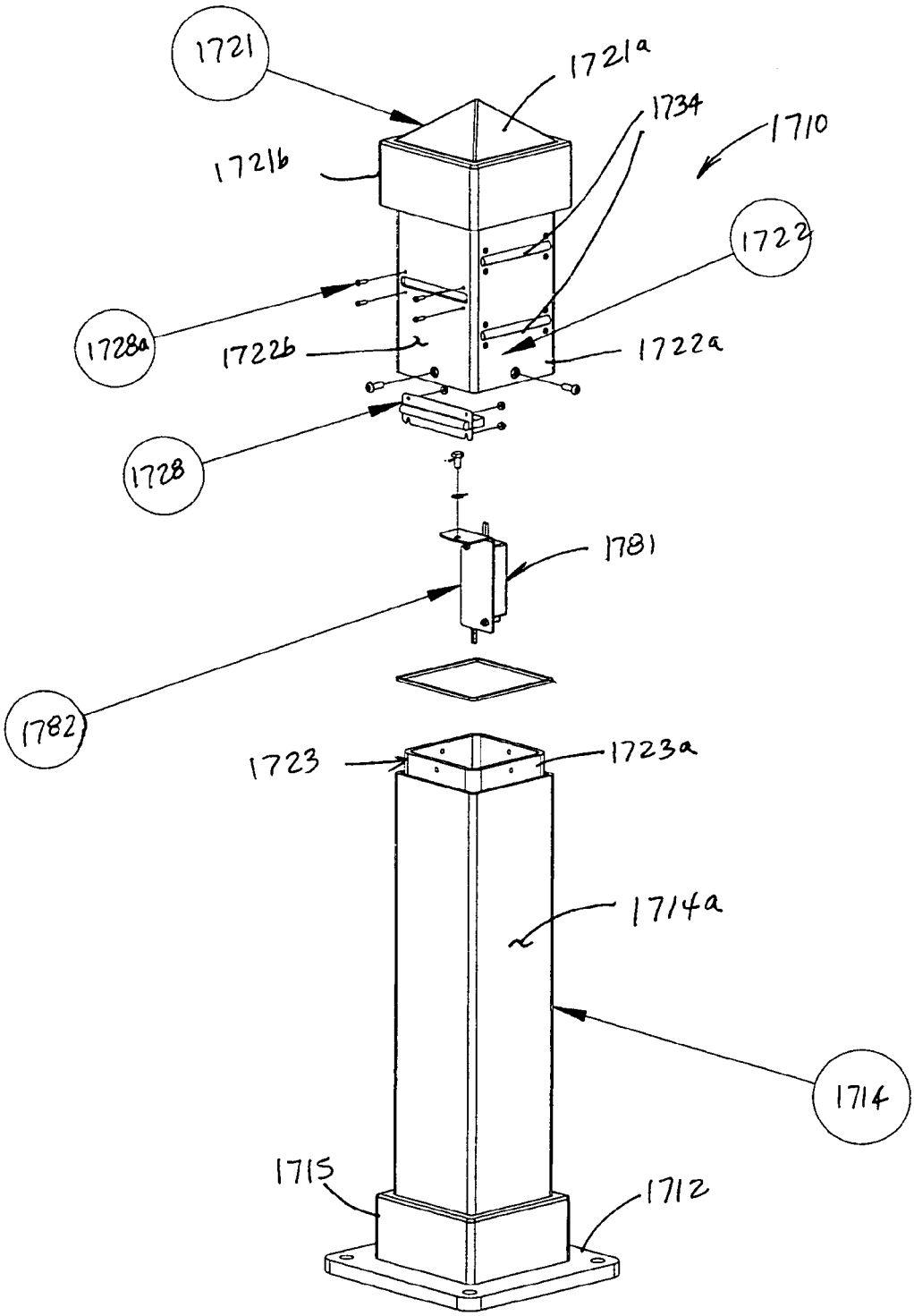
Figure 119:
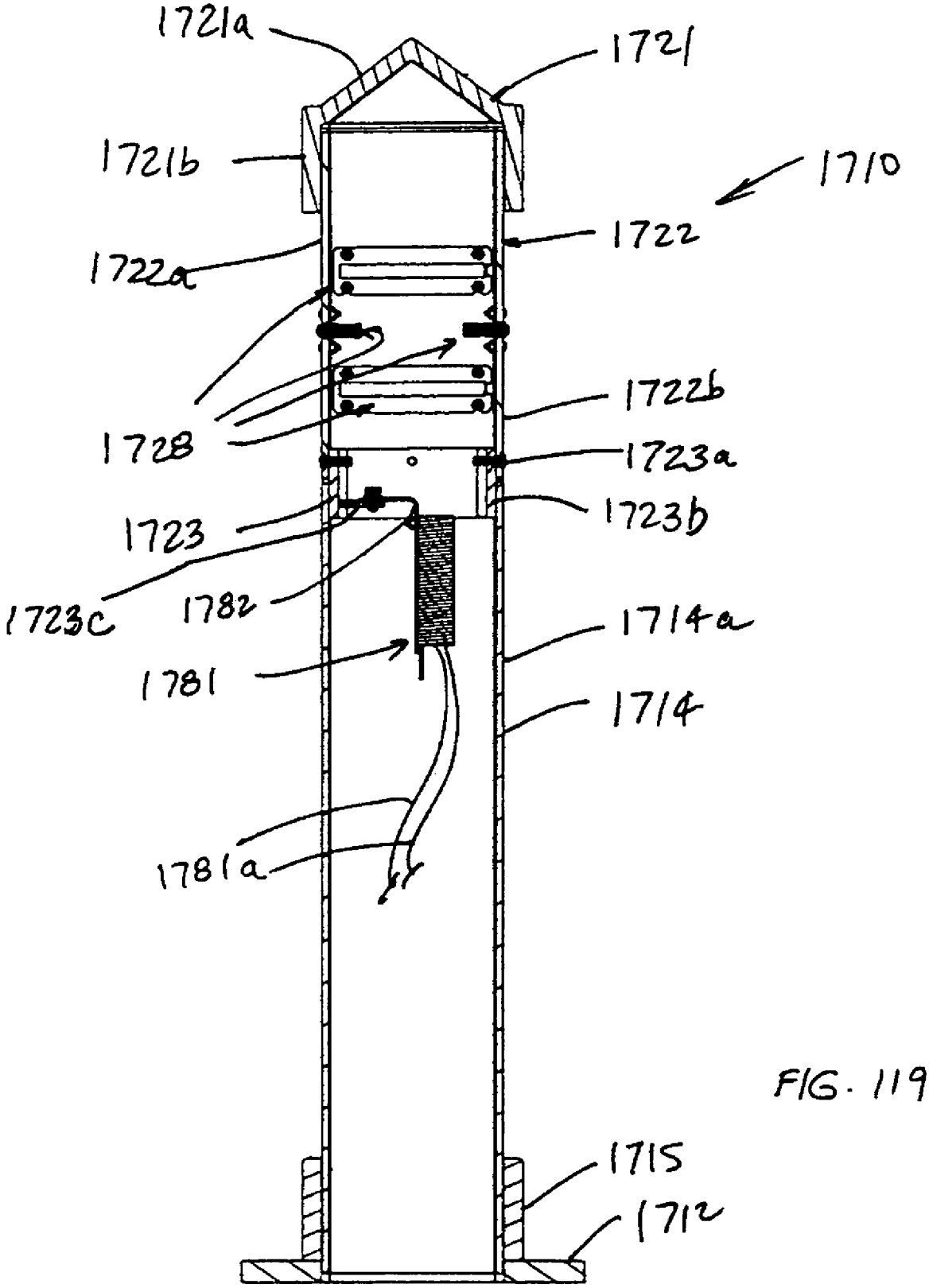
Figure 124:
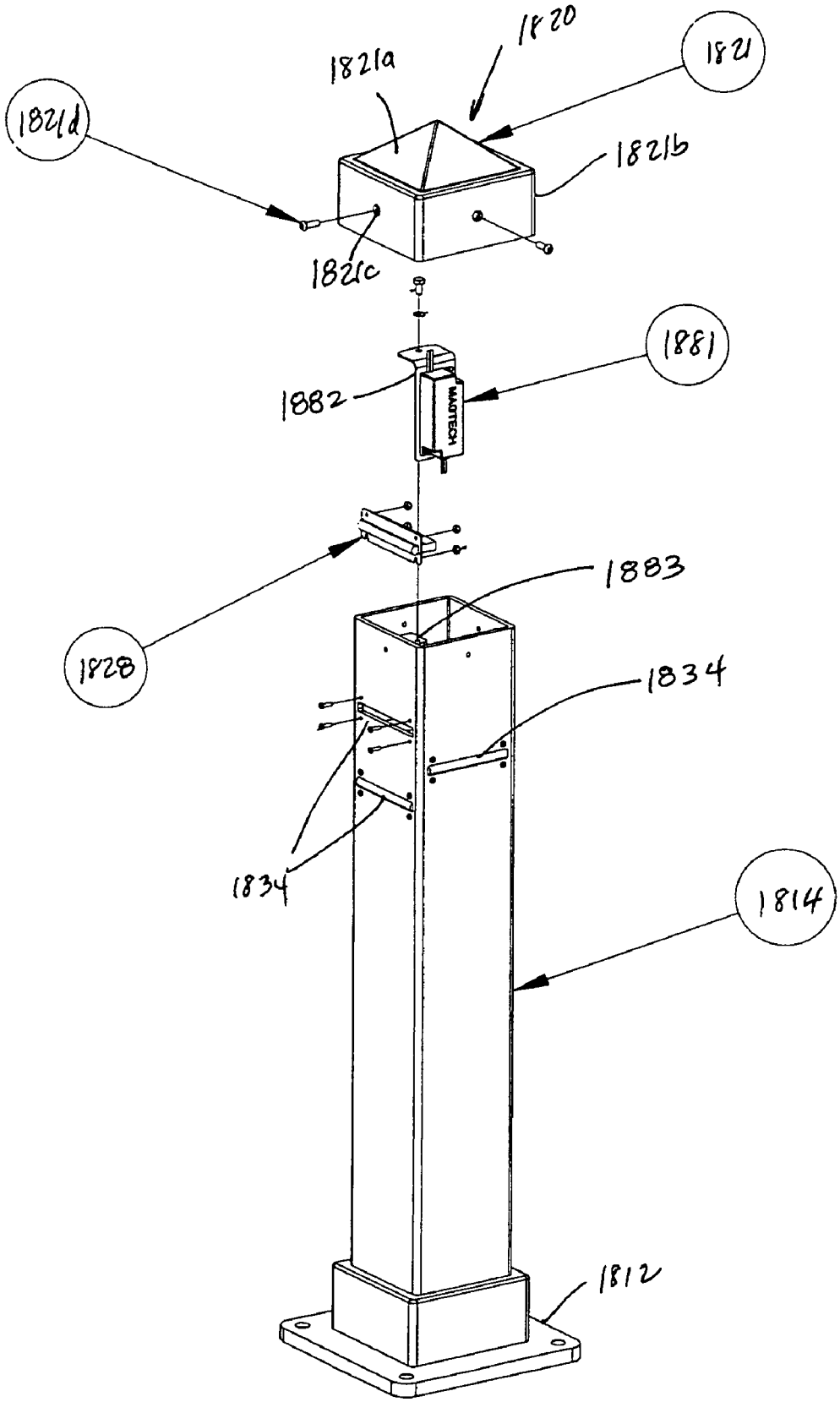
Figure 125:
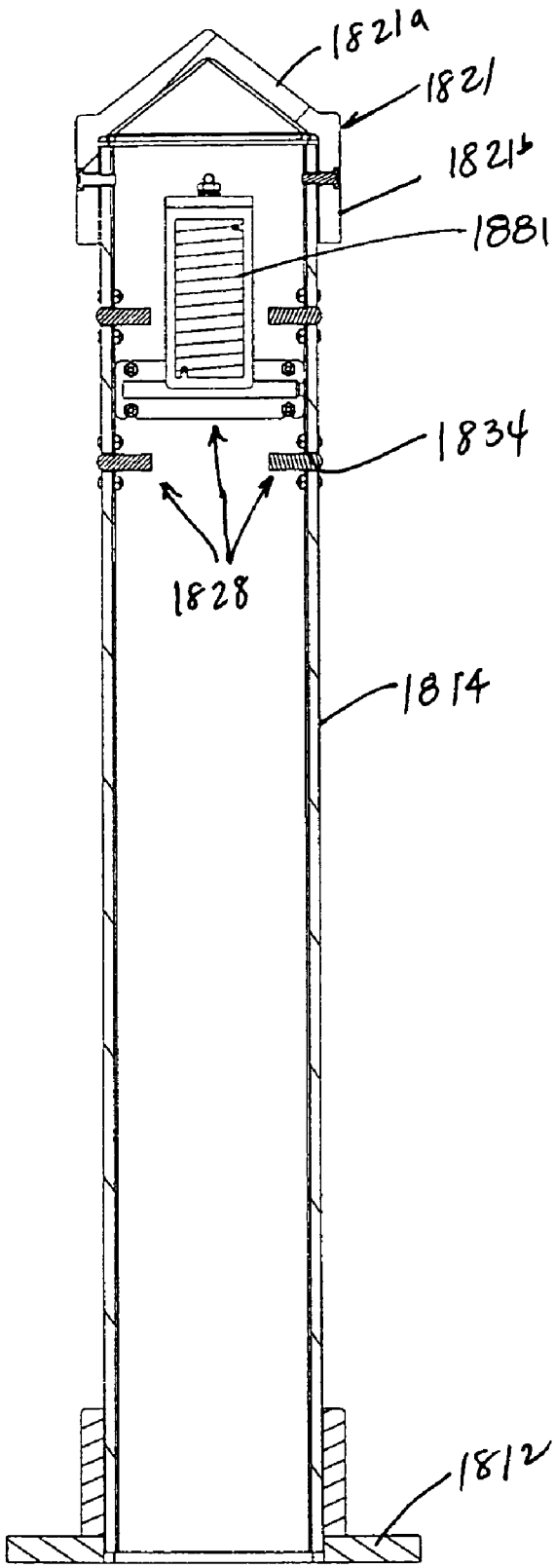

FIG. 89 an enlarged exploded perspective view of the cover of the lighted post of FIG. 81;

FIG. 90 is a front elevation view of another embodiment of the lighted post of the present invention;

FIG. 91 is a left side elevation view of the post of FIG. 90;

FIG. 92 is a right side elevation view of the post of FIG. 90;

FIG. 93 is a top plan view of the lighted post of FIG. 90;

FIG. 94 is a bottom plan view of the lighted post of FIG. 90;

FIG. 95 is an exploded perspective view of the lighted post of FIG. 90;

FIG. 96 is a cross-section taken along line XCVI-XCVI of FIG. 93;

FIG. 97 is an enlarged exploded perspective view of the cover of the lighted post of FIG. 90;

FIG. 98 is front elevation view of another embodiment of the lighted post of the present invention;

FIG. 99 is a left side elevation view of the lighted post of FIG. 98;

FIG. 100 is a right side elevation view of the lighted post of FIG. 98;

FIG. 101 is a top plan view of the lighted post of FIG. 98;

FIG. 102 is a bottom plan view of the lighted post of FIG. 98;

FIG. 103 is an exploded perspective view of the cover of the lighted post of FIG. 98;

FIG. 104 is a cross-section taken along line CIV-CIV of FIG. 101;

FIG. 105 is a front elevation view of another embodiment of the lighted post of the present invention;

FIG. 106 is a left side elevation view of the lighted post of FIG. 105;

FIG. 107 is a right side elevation view of the lighted post of FIG. 105;

FIG. 108 is a top plan view of the lighted post of FIG. 105;

FIG. 109 is a bottom plan view of the lighted post of FIG. 105;

FIG. 110 is an exploded perspective view of the lighted post of FIG. 105;

FIG. 111 is a cross-section taken along line CXI-CXI of FIG. 105;

FIG. 112 an enlarged exploded perspective view of the cover of the lighted post of FIG. 105;

FIG. 113 is a front elevation view of another embodiment of the lighted post of the present invention;

FIG. 114 is a left side elevation view of the lighted post of FIG. 113;

FIG. 115 is a right side elevation view of the lighted post of FIG. 113;

FIG. 116 is a top plan view of the lighted post of FIG. 113;

FIG. 117 is a bottom plan view of the lighted post of FIG. 113;

FIG. 118 is an exploded perspective view of the lighted post of FIG. 113;

FIG. 119 is a cross-section taken along line LXIX-LXIX of FIG. 113;

FIG. 120 is a front elevation view of another embodiment of the lighted post of the present invention;

FIG. 121 is a left side elevation view of the lighted post of FIG. 120;

FIG. 122 is a top plan view of the lighted post of FIG. 120;

FIG. 123 is a bottom plan view of the lighted post of FIG. 120;

FIG. 124 is an exploded perspective view of the lighted post of FIG. 120; and FIG. 125 is a cross-section taken along line CXXV-CXXV of FIG. 120.

DETAILED DESCRIPTION OF THE PREFERRED EMBODIMENTS

Figure 1:
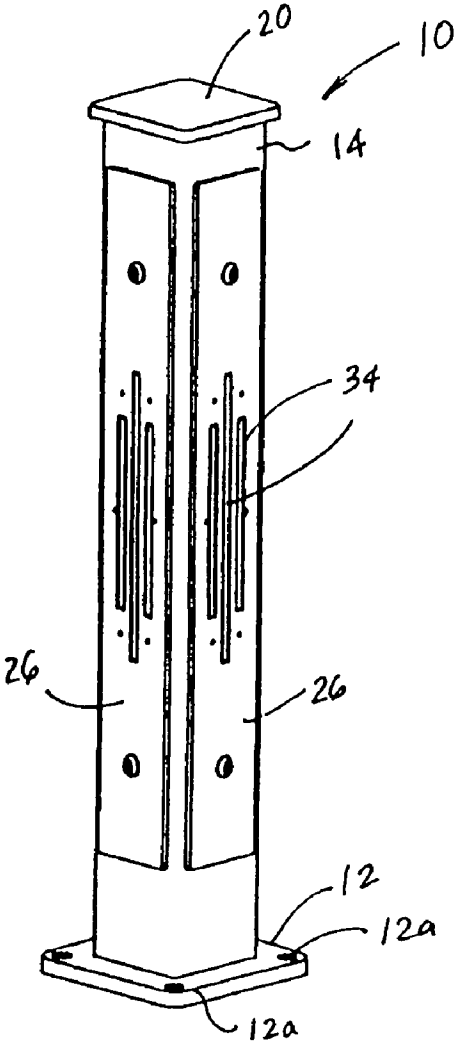
FIG. 1 is a perspective view of a lighted post of the present invention.
Figure 6:
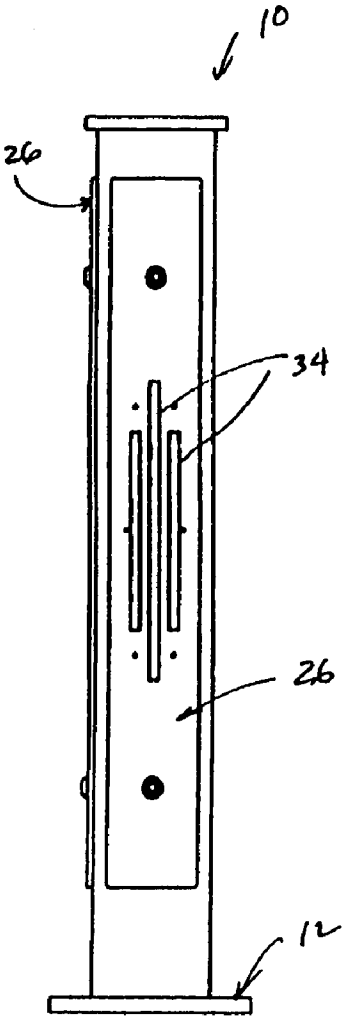
FIG. 6 is a right side elevation view of the lighted post of FIG. 2.
Figure 2:
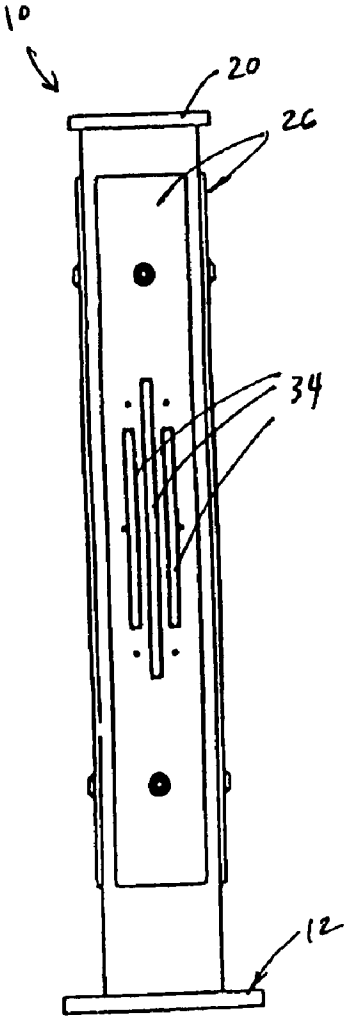
FIG. 2 is a front elevation view of a lighted post of FIG. 1.
Figure 3:
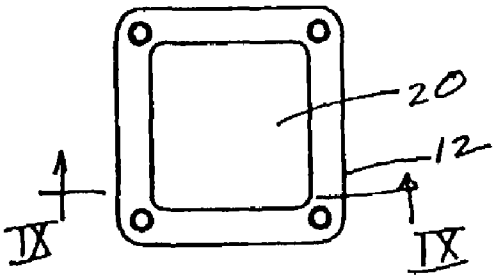
FIG. 3 is a top plan view of the lighted post of FIG. 2.
Figure 4:
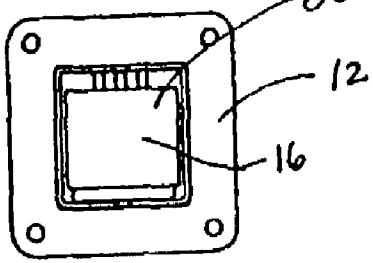
FIG. 4 is a bottom plan view of the lighted post of FIG. 2.

Referring to FIG. 1, the numeral 10 generally designates a lighted post of the present invention. As will be more fully described below, lighted post 10 is particularly useful as a lighted bollard and incorporates the use of light assemblies that use less energy and produce less heat than the lights used in conventional bollards and, further, in a manner to limit the intrusion of bugs and dirt into the post to maintain the aesthetic appearance of the lighted post.

In the illustrated embodiment, lighted post 10 includes a base 12 and a tubular member 14 that is mounted to base 12 to form a stanchion. It should be understood that the stanchion may be assembled from a variety of other components and further may not require a base. Base 12 is adapted to anchor tubular member 14, for example, to a rigid support surface, such as the ground or to a mat, such as a concrete or asphalt pad or a deck. As best seen in FIG. 1, base 12 includes a plurality of mounting openings 12*a* for receiving anchor bolts or the like to secure base 12 and, hence, tubular member 14 to the rigid support surface, such as noted above, to form a "bolt down" post. However, it should be understood that tubular member 14 may be mounted using other methods. For example, tubular member 14 may be "cast in place". This may be achieved by mounting an inner tubular member in tubular member 14, which is extended below tubular member 14. The inner tubular member is then inserted into a hole formed in the ground and cast in the hole, for example, by concrete to in effect form a piling for the post. Alternately, a separate tubular member may be cast in the ground to form a sleeve into which tubular member 14 or an inner tubular member is inserted to form a removable post. Tubular member 14 or its inner tubular member may or may not be locked to the sleeve.

Base 12 and tubular member 14 are both preferably formed from a strong, rigid material, such as metal, so that lighted post 10 may be used as a bollard. However, it should be understood the base and tubular member may be formed from plastic, such as a reinforced plastic, wood, or a composite material. In addition, in the illustrated embodiment, tubular member 14 comprises a square tubular member; however, as will be described below, the shape of the tubular member, and also of the base, may be varied.

Figure 9:
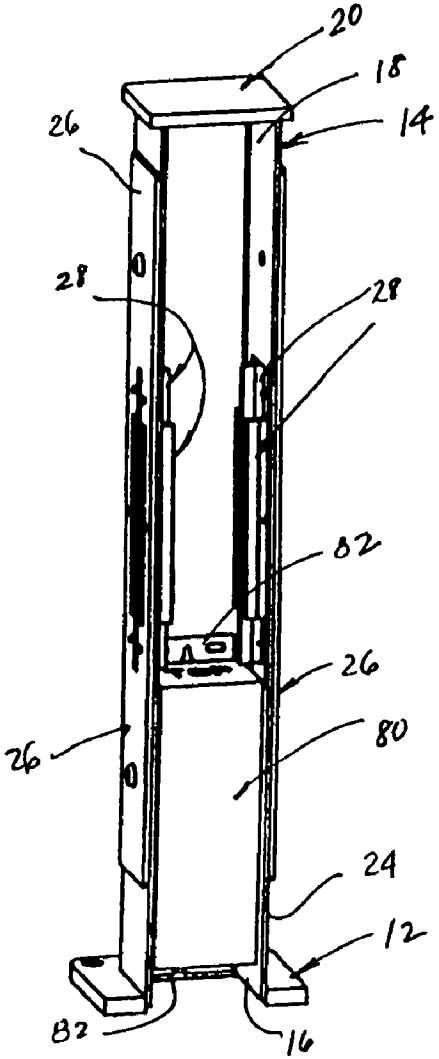
FIG. 9 is a cross-section view taken along line IX-IX of FIG. 2.
Figure 10:
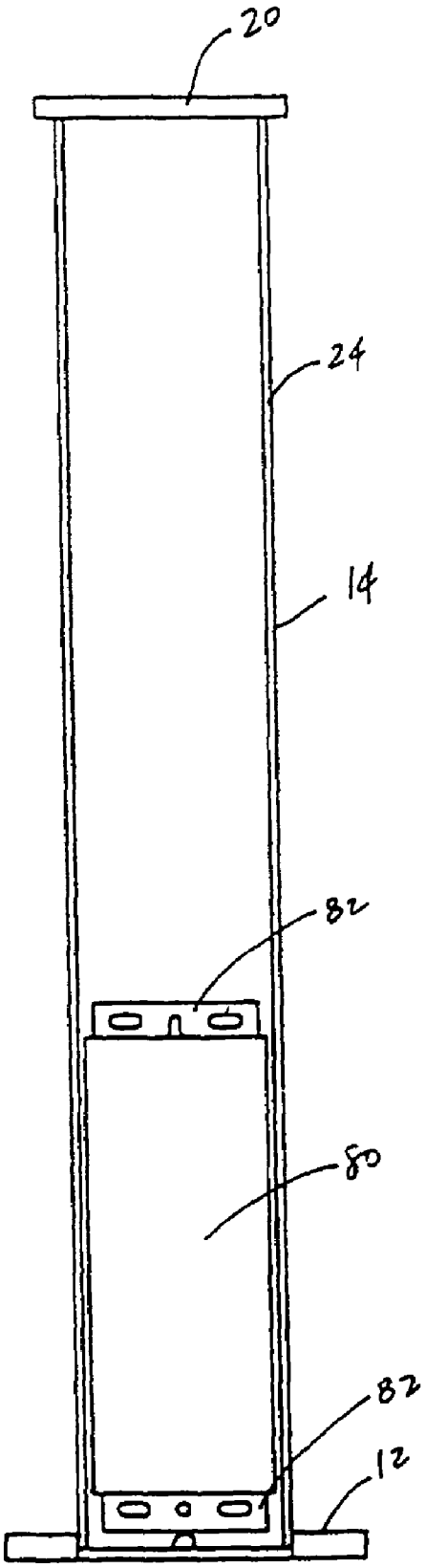
FIG. 10 is an enlarged elevation view of the cross-section of FIG. 9 with the side panels and lighting assemblies removed for clarity.
Figure 11:
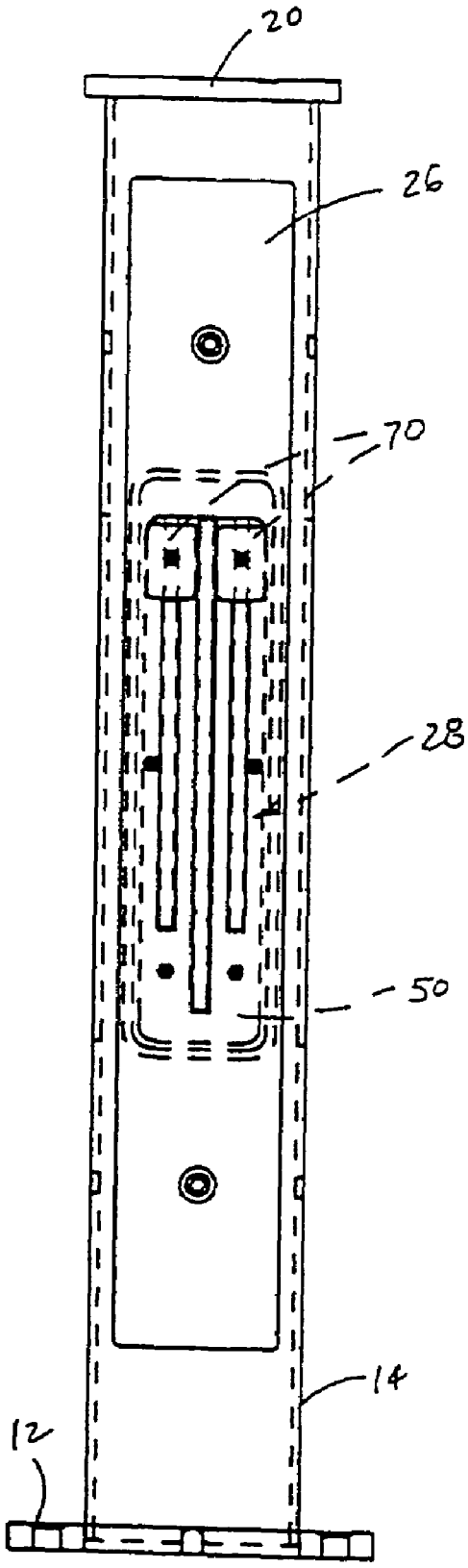
FIG. 11 is a similar view to FIG. 2 with the side panels removed and the light assembly shown in phantom.

As best seen in FIG. 9, tubular member 14 includes a lower open end 16 and an upper open end 18, which is closed and substantially sealed by a cover plate 20 to form a housing for one or more light assemblies described below. Cover plate 20 is secured to tubular member 14, for example by fasteners, so that cover 20 may be removed or may be fixedly secured to tubular member 14, for example by welding. In the illustrated embodiment, cover plate 20 comprises a flat square plate. It should be understood that the shape and size of the cover may be varied.

Figure 8:
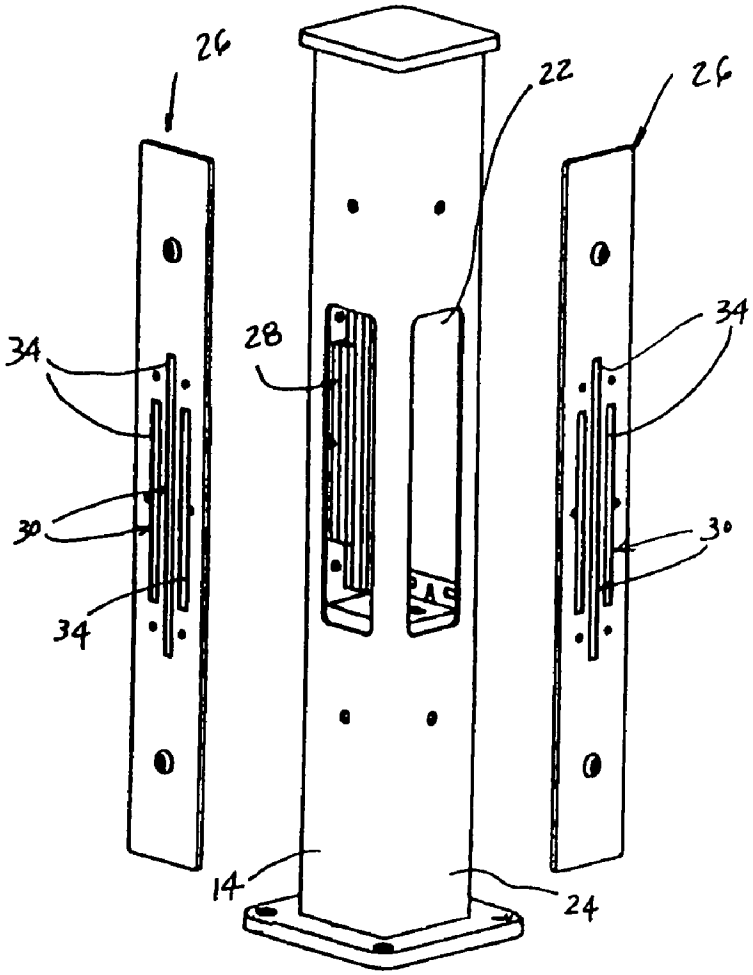
FIG. 8 is an exploded perspective view of the lighted post of FIG. 1.

Referring to FIG. 8, tubular member 14 includes one or more access openings 22, which are provided in its tubular wall 24. In the illustrated embodiment, tubular member 14 comprises a square tubular member with four sides, with three of the sides including an access opening. However, it should be understood that tubular member 14 may include one, two, or four sides with access openings. Furthermore, as will be described in reference to the later embodiments, tubular member 14 may comprise a circular tubular member with radially spaced access openings. Openings 22 may be centrally located on the respective sides of the tubular member and may be arranged so that they are horizontally aligned. Alternately, openings may be arranged at different heights along tubular member 14, which may facilitate the arrangement of the light assemblies and their respective wires in tubular member 14.

As best seen in FIG. 8, each access opening 22 is covered by a side panel 26, which supports one or more light assemblies 28 and, further, incorporates one or more light transmitting openings 30 through which the light from the respective light assemblies is transmitted for illuminating tubular member and/or the ground or area surrounding the tubular member for security or decorative purposes. Each panel 26 is optionally releasably mounted to the tubular member, for example, by removable fasteners so that the respective panels are removable. For example, each panel 26 may be secured to the tubular member by a pair of threaded fasteners 32.

In the illustrated embodiment, each side panel 26 includes a plurality of elongate openings 34 that are arranged in a generally parallel relationship and are aligned generally parallel to the central vertical access of post 10, which form light transmitting openings 30. Outer openings 34*a* and 34*c* have shorter vertical dimensions than central opening 34*b*, though it should be understood that the number size and shape of the openings may be varied.

Figure 12:
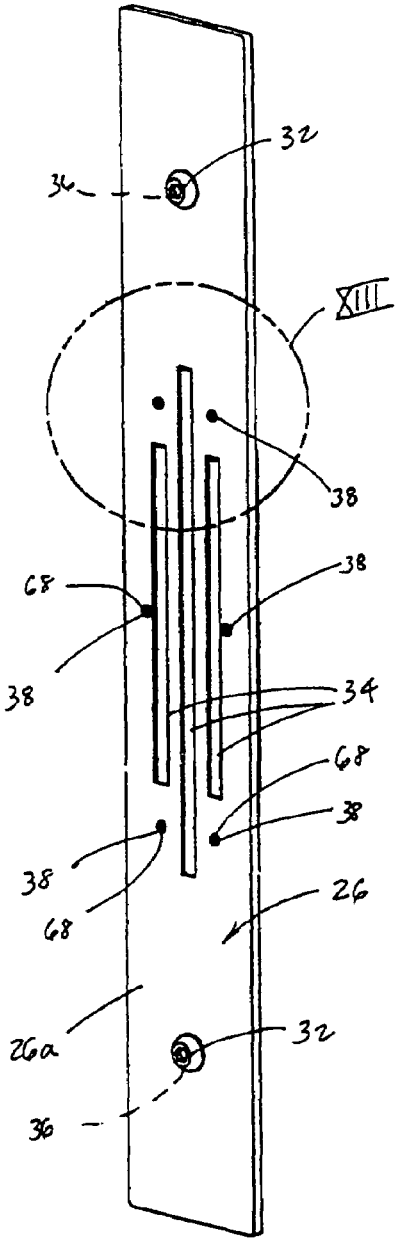
FIG. 12 is an enlarged perspective view of the side panel.

Referring to FIG. 12, each side panel 26 is formed from a generally rectangular plate 26*a* with the elongate openings noted above and also a first plurality of mounting openings 36 for receiving fasteners 32 and for securing each panel 26 to tubular member 14. Each panel 26 also includes a second plurality of openings 38 for securing the light assemblies to the panel, described in further detail below.

Figure 15:
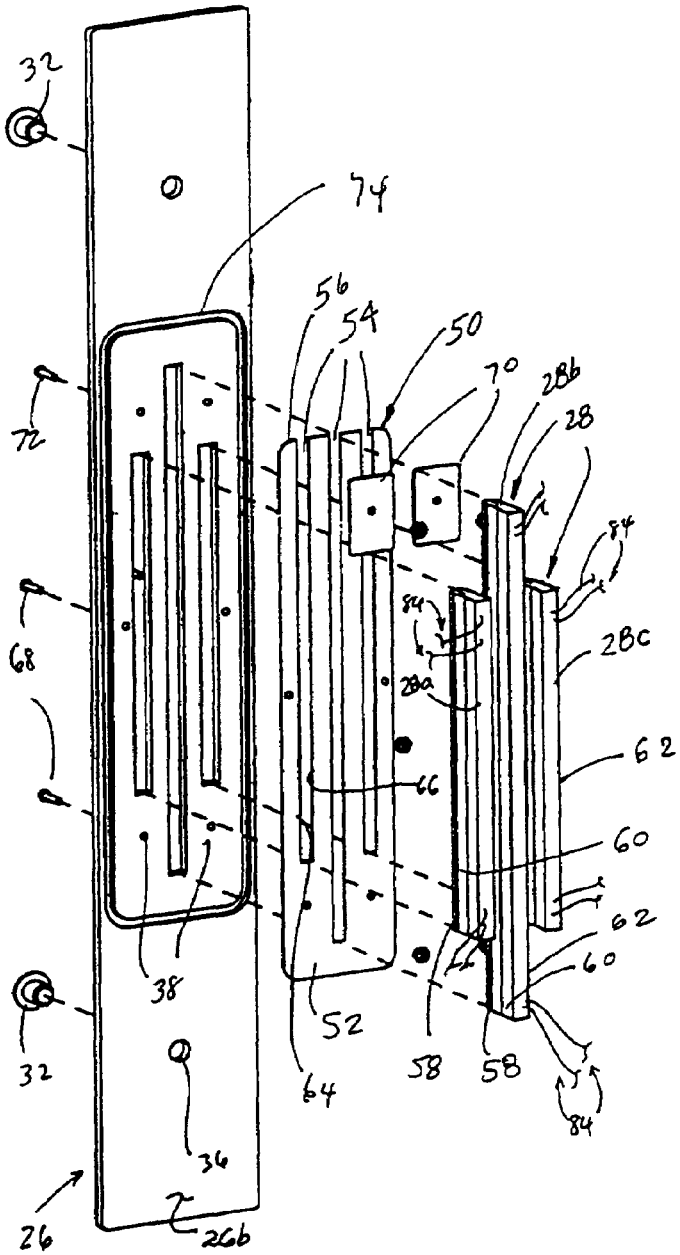
FIG. 15 is an exploded rear perspective view of the side panel of FIG. 12.

As best seen in FIG. 15, light assemblies 28 are mounted to a respective panel at the inwardly facing side of the panel. In the illustrated embodiment, each panel 26 includes three light assemblies 28 that are mounted to panel 26 at its inner facing side 26b so that they align with elongate openings 34 so that light emitted by the light assemblies extends outwardly from the tubular member through elongated openings 34. However, as will be more fully described below, each opening 22 is closed by a light assembly to eliminate bug and dirt intrusion into the tubular member.

Each light assembly 28 is formed from a plurality of light sources 40 (FIG. 14), and preferably a string of light sources that are contiguously mounted, for example, to circuit board 40a, such as a string of light emitting diodes and, more preferably, a string of high intensity light emitting diodes. The LEDS may produce a white light or may produce colored light, such as blue, yellow, or provide different levels of white light. In addition, each light assembly 28 includes a body that is configured to act as a wave guide 42 (FIG. 14), which scatters the light emitted by the light sources along its length but allows the light to exit through its lateral surface. The light sources (40) are enclosed in a housing 44 (FIG. 14) that is positioned adjacent the wave guide and directs the light into the wave guide. Housing 44 also houses the electrical wiring and circuit board for the LEDs. Suitable light assemblies are available under the trade name PLEXINEON from Light Technologies, Inc. of Ill. For further details of suitable light assemblies, reference is made herein to U.S. Pat. No. 6,592,238, which is incorporated by reference herein in its entirety.

Figure 14:
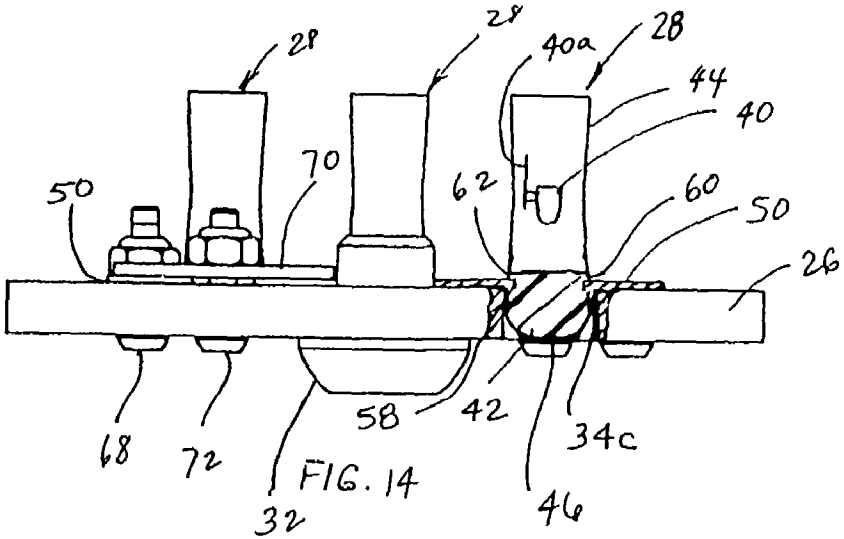
FIG. 14 is a top plan view of the side panel of FIG. 12.
Figure 13:
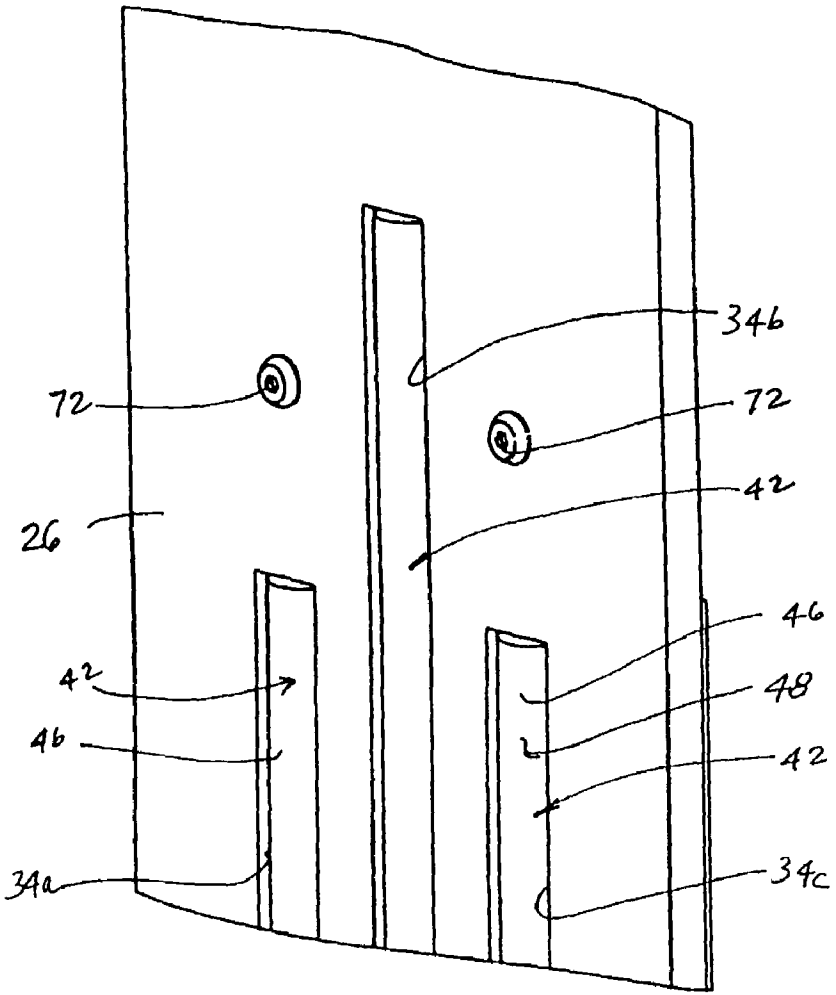
FIG. 13 is an enlarged detail identified by the numeral XIII-XIII of FIG. 12.

Referring to FIGS. 13 and 14, wave guide 42 includes a curved outer surface 46 that forms a light emitting surface 48. As best seen in FIG. 13, when light assemblies 28 are mounted at panel 26, wave guides 42 are positioned in or adjacent openings 34 so that their respective light emitting surfaces 48 are positioned in openings 34 to direct light outwardly from tubular member 14 when the panels (26) are mounted to the tubular member. In the illustrated embodiment, light emitting surfaces 48 are slightly recessed within openings 34; however, it will be appreciated that light emitting surfaces 48 may be flush or project from the openings.

Figure 7:
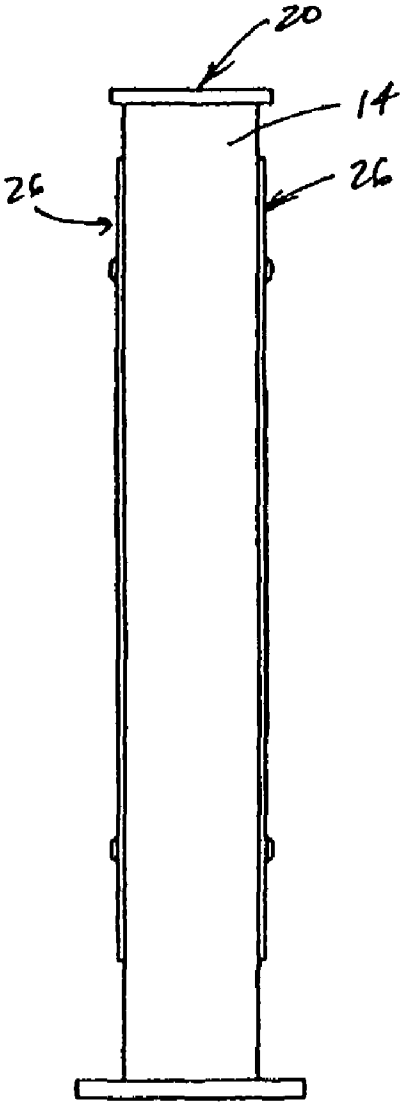
FIG. 7 is a back elevation view of the lighted post of FIG. 2.
Figure 5:
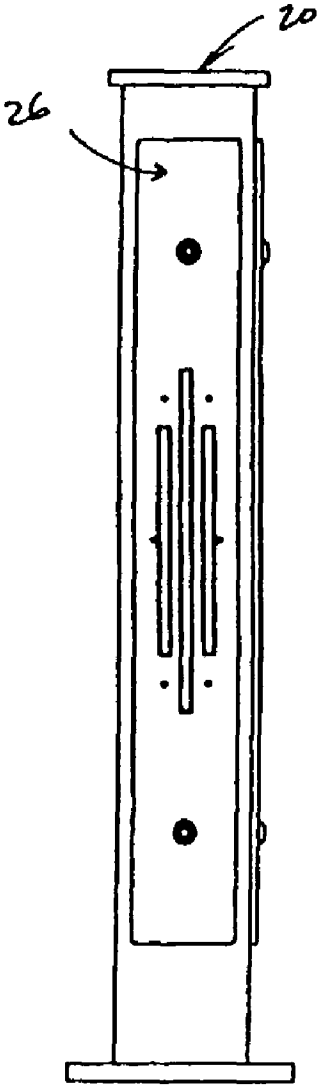
FIG. 5 is a left side elevation view of the lighted post of FIG. 2.

Because the outer surfaces (46) of the wave guides (42) are curved, the light emitted from the respective light assembly is fanned outwardly, such as illustrated in FIG. 7 of U.S. Pat. No. 6,592,238, referenced above. Though the LEDs tend to produce directional light, the wave guide will distribute the light from the LEDs in a manner to simulate a neon light. However, the light assemblies of the present invention produce much less heat than a neon light or other conventional lights, which as will be more fully described below, allows the light assemblies to be positioned such that their light emitting surfaces may be at or adjacent (or project from) an exterior surface of the light post without the risk of injury to a passerby. Further, as will be more fully described below, the post may be closed and essentially sealed to eliminate bug or dirt intrusion in the tubular member, which will allow the post to remain clean and maintain its aesthetic appearance.

Referring again to FIG. 15, light assemblies 28 are mounted to the inwardly facing side 26*b* of panel 26 by a bracket 50. Bracket 50 is formed from a plate 52 with a plurality of elongate slots extending into plate from its upper edge 56. Slots 54 are sized to receive the respective light assemblies in the bracket 50 and, further, so that the spaced lateral edges of the plate engage the light assemblies. Each light assembly 28 includes an elongate groove 58 along its lateral sides 60 and 62. Slots 54 correspond to the length of the respective light assemblies so that bracket 50 may be mounted in the grooves 58 of the respective light assemblies with the light assemblies 28 positioned in the respective slots 54 and engaged by the opposed lateral edges 64 and 66 of the fingers formed by slots 54. Bracket 50 is then secured to the inwardly facing side of panel 26 by a plurality of fasteners 68, which extend through mounting openings 38 and secure bracket 50 to panel 26. In addition, the upper ends of the fingers formed by slots 54 are secured to panel 26 by rectangular washers 70, which are positioned on either side of the central light assembly (28*b*) and above the outer light assemblies (28*a*, 28*c*) and secure the upper end of bracket 50 to panel 26 by fasteners 72.

Optionally, the inwardly facing side of panel 26 includes a groove 74 for receiving a seal or gasket, which encircles the respective access opening 22 when panel 26 is secured to tubular member 14 by fasteners 32 to thereby close and substantially seal the interface between panel 26 and tubular member 14 around opening 22. In this manner, light assemblies 28 are mounted in access opening 22 of tubular member 14, with the light emitting surfaces supported such that they are located in openings 34 of panel 26.

Referring to FIG. 9, tubular member 14 includes an optional housing 80 for housing, for example a transformer for reducing a supply voltage to a drive voltage that is suitable for driving the LEDs in light assemblies 28. Housing 80 comprises a generally boxed-shaped housing with mounting tabs 82 for securing housing 80 to member 14. Accordingly, the various wiring 84 (FIG. 15) from the light assemblies 28 are extended into housing 80 for coupling to the transformer, which in turn, includes wiring for connecting to a power supply, which is external to tubular member 14. Optionally, the transformer may also be mounted externally of tubular member 14.

Accordingly, when assembled, lighted post 10 provides a substantially sealed bollard that is suitable for use as a security bollard or simply as a decorative bollard or for pathway, directional, or signal lighting. Furthermore, the voltage requirements to power the light assemblies within the bollard are relatively low and, therefore, consume less power than conventional lighted bollards. In addition, by incorporating LED light sources into the light assemblies, the heat produced by the light assemblies are significantly reduced over neon, halogen, metal halide, high pressure sodium, fluorescent, and incandescent lights or the like and, further, provide an extended life. For example, high intensity LED's may have a life expectancy on the order of 180,000 hours. Consequently, the light assemblies may be left on for extended periods of time. In addition, given the expected life expectancy of the light assemblies, the bollard may be assembled in a manner so that the light assemblies are permanently mounted or embedded in the tubular member.

As best understood from FIG. 9, base 12 includes a central opening in which tubular member 14 is extended and secured, which allows the cable or wiring from the transformer positioned in housing 80 to extend from post 10 for coupling to the external power supply.

Optionally, lighted post 10 may incorporate a sensor that detects, for example, motion or light, for example, a low light condition, which triggers actuation of the light assemblies. For example, housing 80 may house a circuit and/or electronics that are coupled to the sensor and responds to the sensor detecting motion or a low light condition by powering the light assemblies.

Another feature that may be added includes a light shield. For example, a light shield may be mounted to tubular member 14 at of adjacent the upper ends of openings 34 to limit, if not eliminate, "uplighting". For example, the shield may comprise metal curved shield that is mounted using fasteners 72.

Though illustrated with three panels 26, it should be understood that the tubular member may incorporate one, two, or four panels. In addition, each panel may have a similar configuration to the other panel. Alternately, the tubular member may be provided with different panels and/or light transmitting openings with different configurations. For example, the posts may incorporate light transmitting openings, either in the wall of the tubular member or in the panels, which form signals. For example, the light assemblies and/or light transmitting openings may be configured to form word signals, such as "stop" or "slow" or "caution" or the like, or may be configured to form symbols, such as universal signals.

Figure 18:
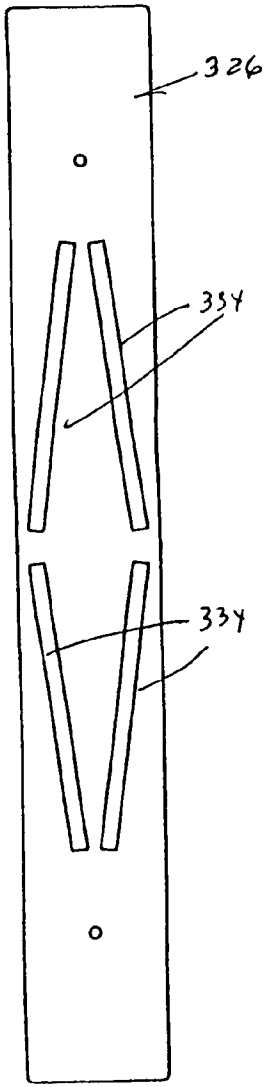
FIG. 18 is a fourth embodiment of a side panel of the lighted post of the present invention.
Figure 17:
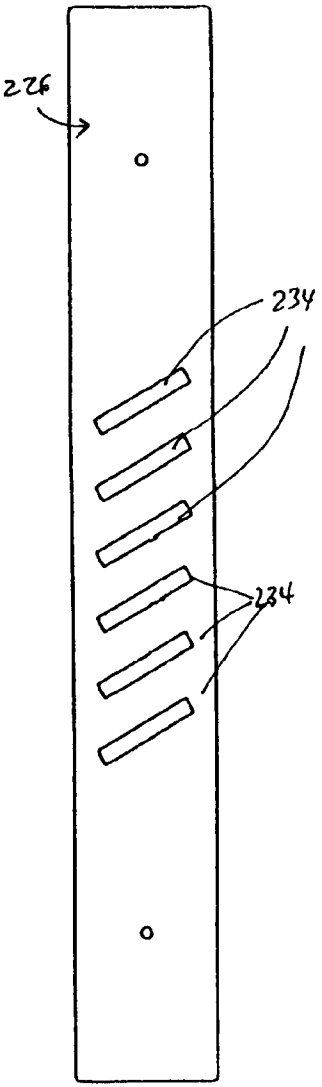
FIG. 17 is a third embodiment of the side panel of the lighted post of the present invention.
Figure 16:
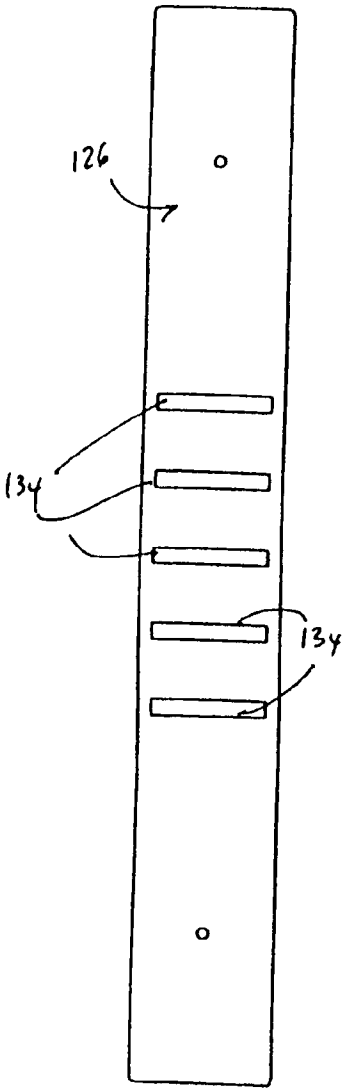
FIG. 16 is a front elevation view of another embodiment of the side panel of the present invention.

For example, referring to FIGS. 16-18, panels 126, 226, and 326 each incorporate a different pattern of light transmitting openings. With reference to FIG. 16, panel 126 includes a plurality of vertically spaced elongate openings 134, which have approximately the same length and width. Though illustrated with five transmitting openings, the number of light transmitting openings and be increased or decreased as desired.

With reference to FIG. 17, panel 226 similarly includes a plurality of spaced elongate openings 234, which are angled with respect to the horizontal plane. In this embodiment, panel 226 includes six light transmitting openings, which are generally equal in length and width.

As best seen in FIG. 18, panel 326 includes four light transmitting openings with two of the light transmitting openings arranged in a V-shaped configuration and the other two arranged in an inverted V-shaped configuration. Again, in this illustrated embodiment, the length and width of each of the openings are substantially equal.

It should be understood that the number of openings and size and shape of any of the openings may be varied. Furthermore, each panel may include a combination of different shapes and different size openings.

As noted previously, the shape of the tubular member may be varied. For example, referring to FIGS. 19 and 23-26, lighted post 410 includes a round tubular member 414 that is mounted to a round base 412. In addition, cover 420 comprises a semispherical cover and, further, includes a pair of annular rings 421, which match a pair of annular ribs or rings 423 located adjacent base 412. Tubular member 414 also includes a collar 415 positioned between annular ribs 423 and base 412.

Figure 26:
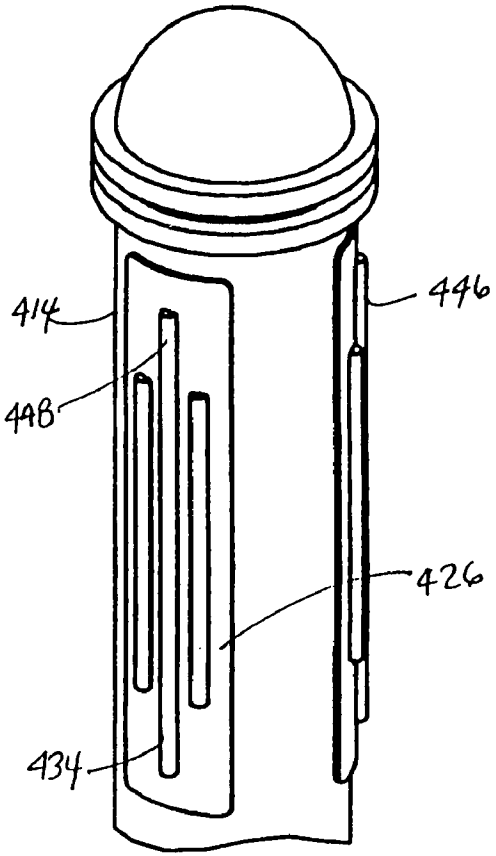
FIG. 26 is an enlarged perspective view of the detail identified by the numeral XXVI-XXVI of FIG. 19.
Figure 21:
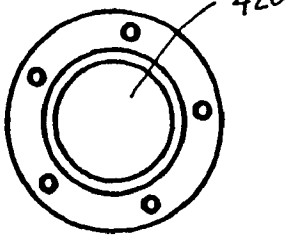
FIG. 21 is a top plan view of the lighted post of FIG. 20.
Figure 22:
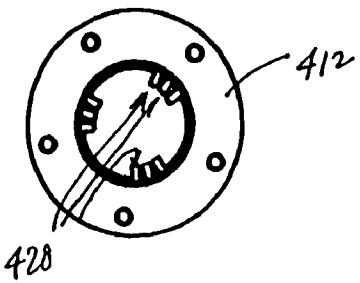
FIG. 22 is a bottom plan view of the lighted post of FIG. 20.
Figure 19:
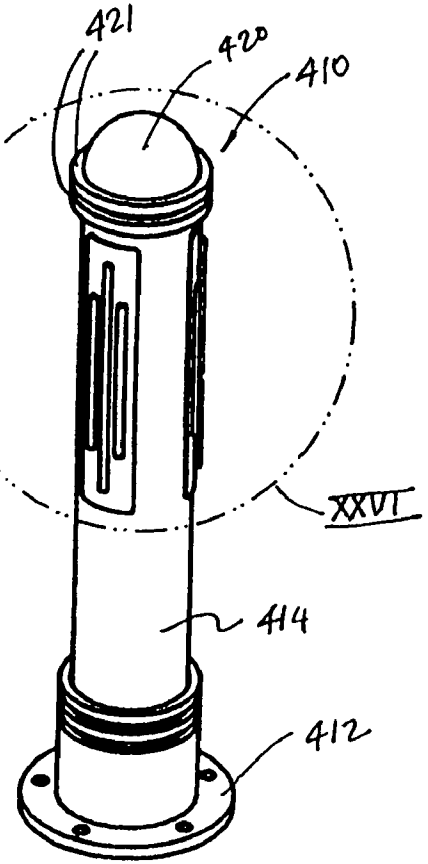
FIG. 19 is a perspective view of a second embodiment of the lighted post of the present invention.
Figure 24:
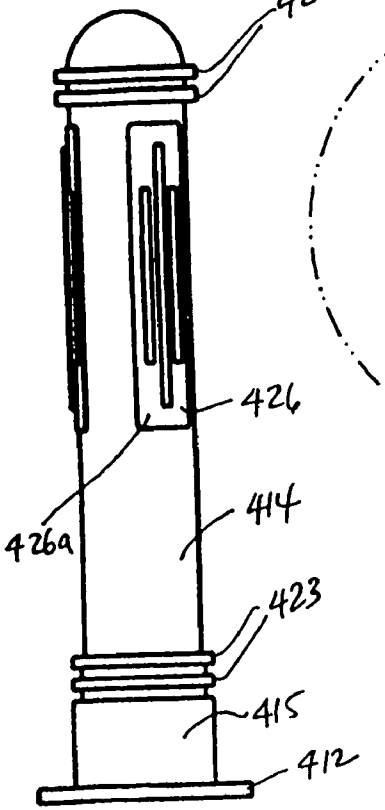
FIG. 24 is a right side elevation view of the lighted post of FIG. 20.
Figure 25:
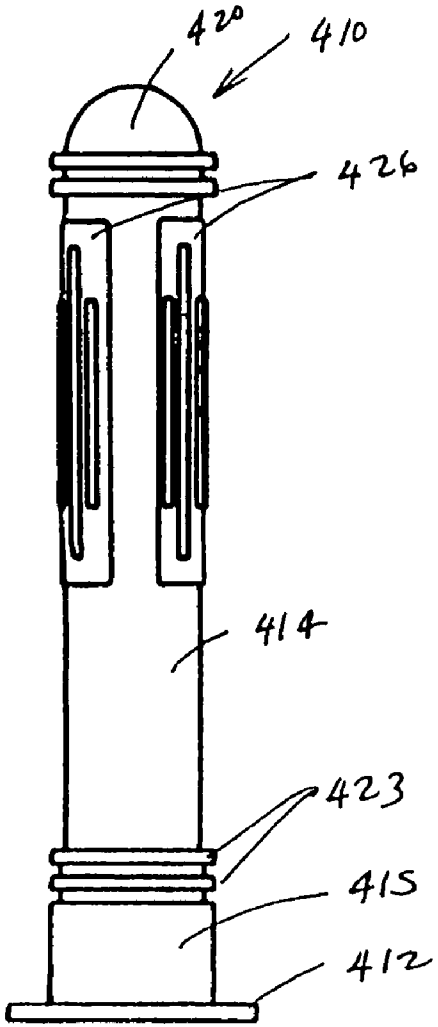
FIG. 25 is a rear elevation view of the lighted post of FIG. 20.
Figure 20:
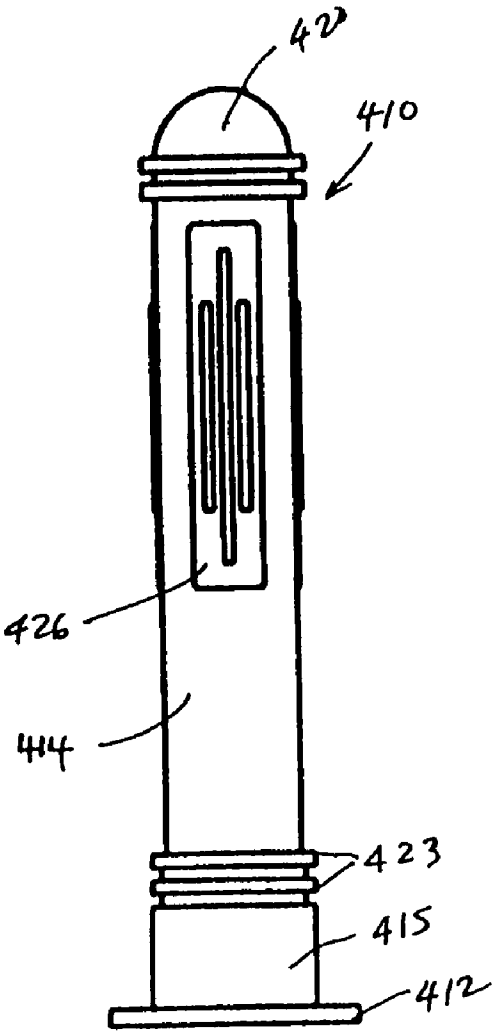
FIG. 20 is a front elevation view of the side post of FIG. 19.
Figure 23:
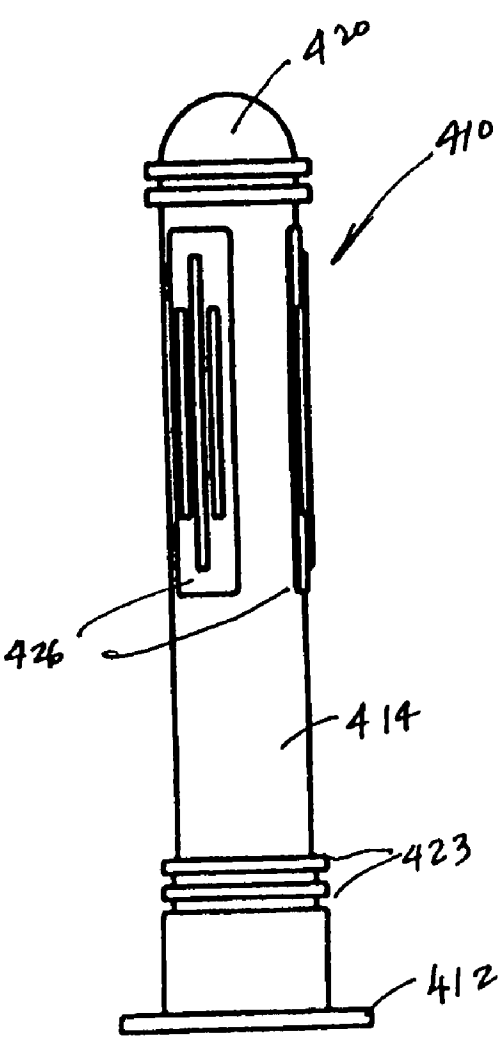
FIG. 23 is a left side elevation view of the lighted post of FIG. 20.
Figure 34:
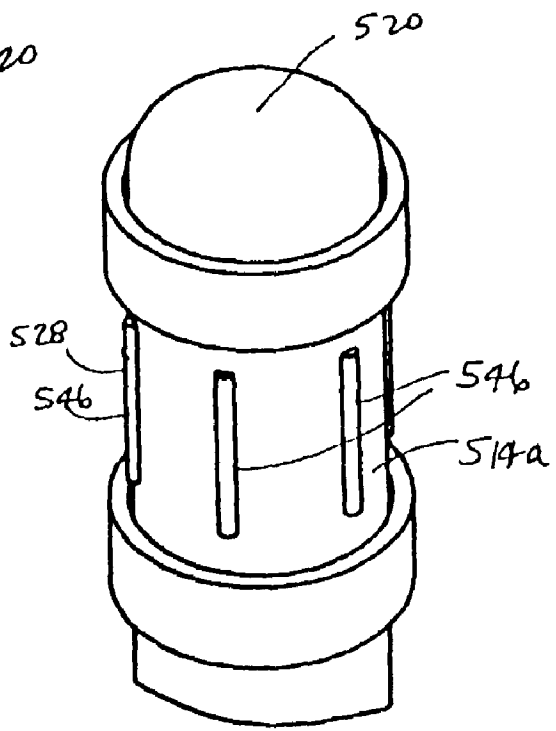
FIG. 34 is an enlarged view identified by the numeral XXXIV-XXXIV of FIG. 27.
Figure 29:
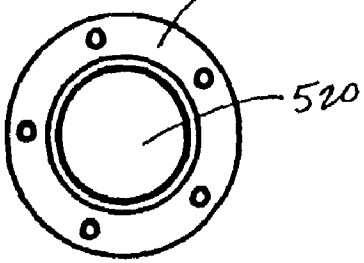
FIG. 29 is a top plan view of the lighted post of FIG. 28.
Figure 30:
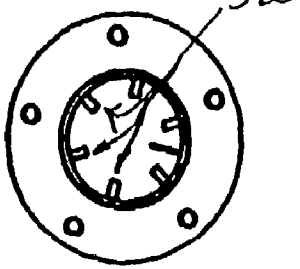
FIG. 30 is a bottom plan view of the lighted post of FIG. 28.
Figure 27:
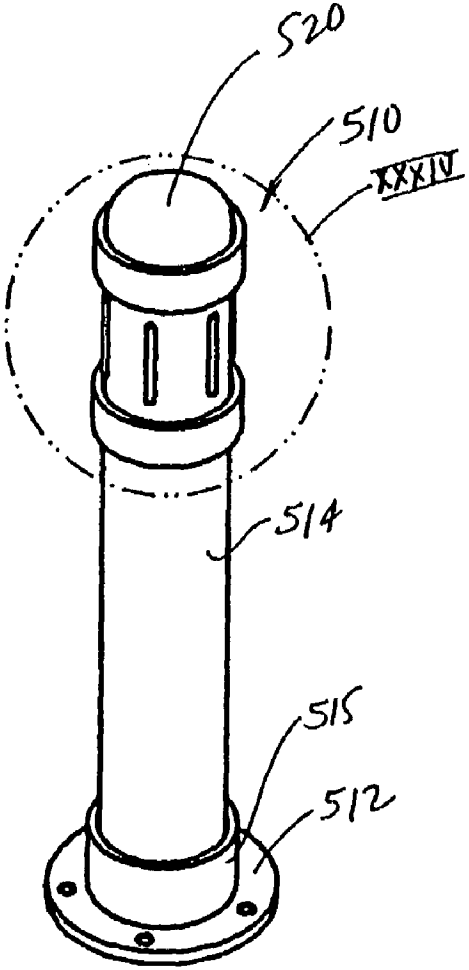
FIG. 27 is a perspective view of a third embodiment of the lighted post of the present invention.
Figure 28:
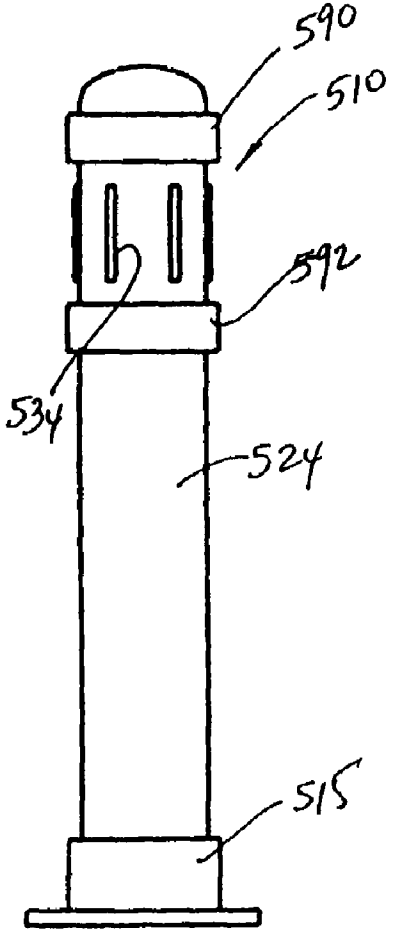
FIG. 28 is a front elevation view of the lighted post of FIG. 27.
Figure 31:
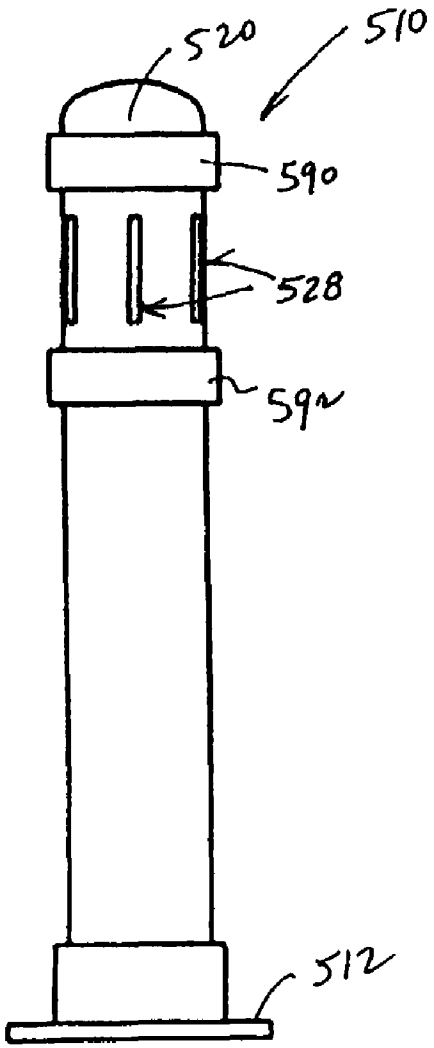
FIG. 31 is a left side elevation view of the lighted post of FIG. 28.
Figure 33:
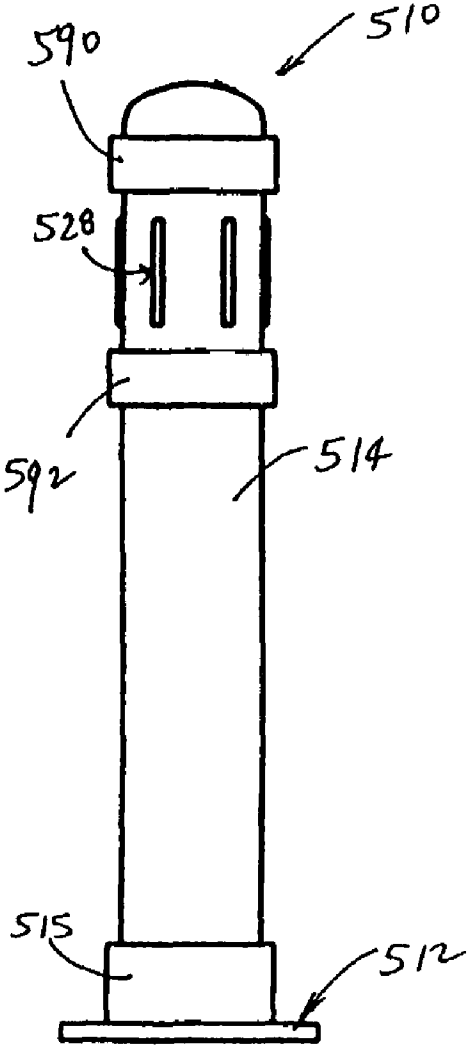
FIG. 33 is a rear elevation view of the lighted post in FIG. 28.
Figure 32:
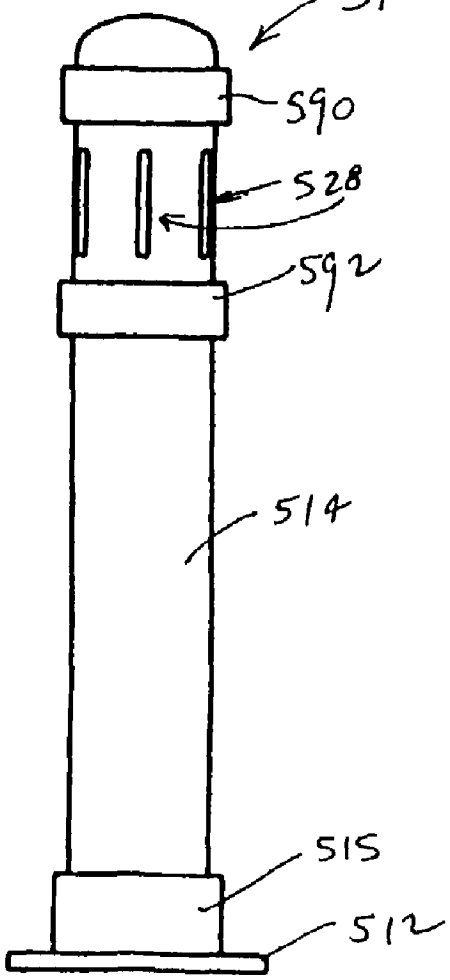
FIG. 32 is a right side elevation view of the lighted post of FIG. 28.

In the illustrated embodiment, side panels 426 are formed from curved plate members **426*a*, which are formed to match the curvature of tubular member 414. Referring to FIG. 22 light assemblies 428 are arranged in a radial arrangement so that their light emitting surfaces 448 are aligned with the respective openings 434 of side panels 426. In addition, the curved outer surfaces 446 of each light assembly 428 projects outwardly from the respective side panels 426, as best seen in FIG. 26**.

Light assemblies 428, which are of similar construction to light assemblies 28, produce less heat than conventional neon lights or similar lights and, therefore, when operated even for a long duration, do not generate a significant amount of heat. Therefore, contact with the light assemblies 428 will not pose any significant risk of injury to a passerby or the like. For further details for light assemblies 428 and the mounting of light assemblies 428, reference is made to the first embodiment. However, it should be understood that the shape of the mounting bracket is preferably adjusted fit the contour of the inner surface of the tubular member 414. Further, separate mounting brackets may be used for each light assembly.

Referring to FIGS. 27-34, the numeral 510 designates yet another embodiment of the lighted post of the present invention. Lighted post 510 is of similar construction to lighted post 410 and includes a circular tubular member 514 mounted to a circular base 512, with a lower collar 515 mounted to tubular member 514 adjacent base 512. In the illustrated embodiment, light assemblies 528 are mounted in a plurality of vertical light transmitting openings 534 formed in tubular wall 524 of tubular member 514, which are horizontally and, optionally, uniformly spaced around tubular member 514. Light assemblies 528 are of similar construction to light assemblies 28; therefore, for further details for light assemblies 528 and the mounting of light assemblies 528, reference is made to the previous embodiments. Optionally, the curved outer surface 546 of each light assembly projects outwardly from the outer surface **514*a* of tubular member 514** to increase the fanning effect of the light emitted by the respective light assemblies.

Similar to the previous embodiment, the upper end of tubular member 514 is closed by a rounded cover 520. In addition, mounted above and below light assemblies 528 are a pair of upper collars 590 and 592, which are vertically and evenly spaced on either side of the respective light assemblies. Upper collar 592 is provided at the juncture between cover 520 and tubular steel 514 to hide the seam between the cover and the tubular member.

Referring to FIGS. 35-42, the numeral 610 generally designates yet another embodiment of the lighted post of the present invention. Lighted post 610 is of similar construction to lighted post 510 and includes a round tubular member 614 and a round base 612, with the upper open end of tubular member 614 enclosed by a rounded cover 620. In the illustrated embodiment, the seam 621 between cover 620 and tubular member 614 is exposed, unlike the previous embodiment.

Similar to lighted post 410, lighted post 610 includes a plurality of side panels 626, which are formed by curved plates, which are secured to the outer surface of tubular member 614 and, which include a plurality of elongate openings 634 to form light transmitting openings to allow light from light assemblies 628 to be transmitted from tubular member 614. In the illustrated embodiment, lighted post 610 includes four side panel members; however, it can be appreciated that the number of side panels may be increased or decreased as desired. Light assemblies 628 are of similar construction to light assemblies 28; therefore, for further details for light assemblies 628 and the mounting of light assemblies 628, reference is made to the previous embodiments.

Figures 35, 37, 38, 42:
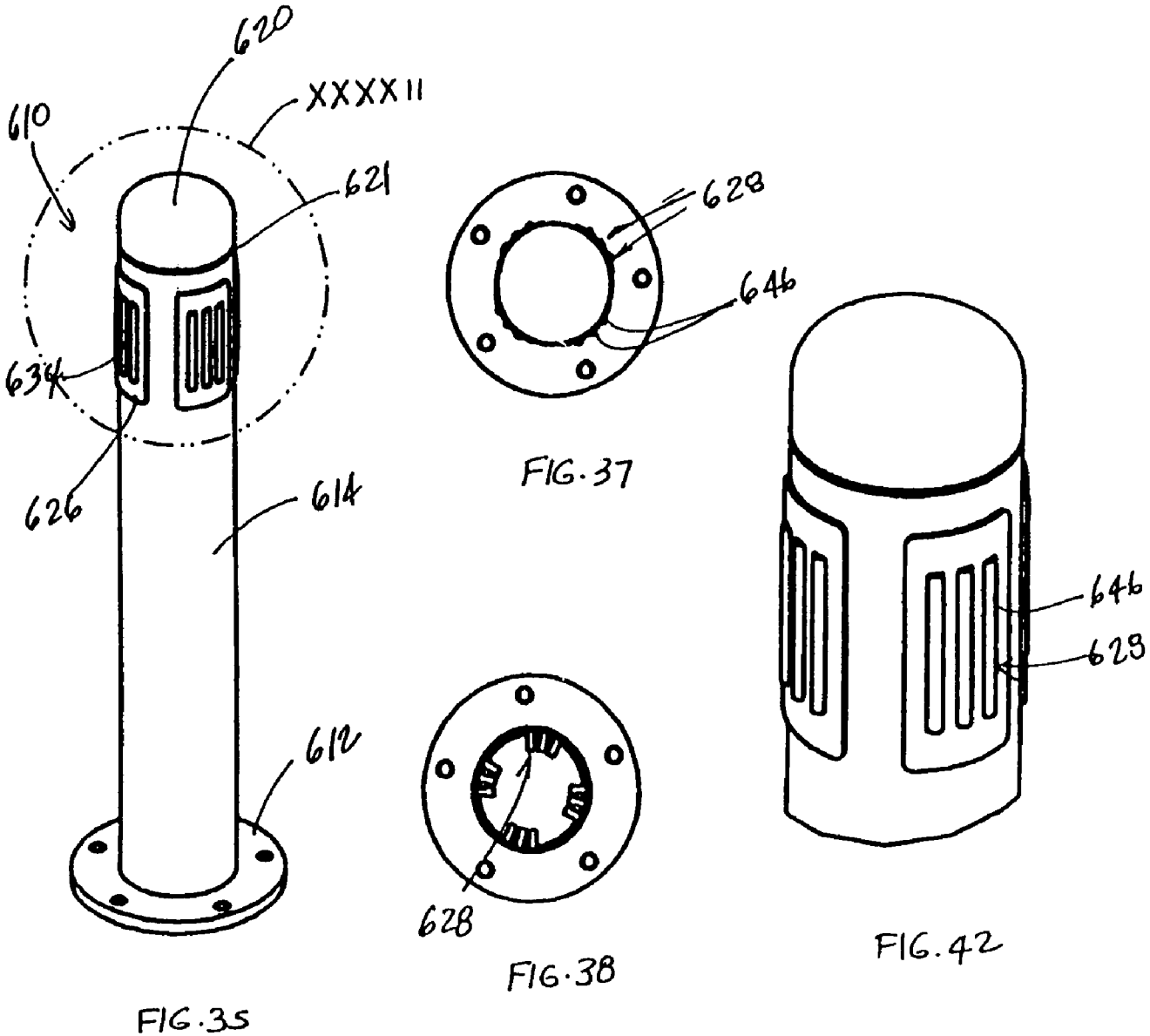
FIG. 35 is a perspective view of a fourth embodiment of the lighted post of the present invention.
FIG. 37 is a top plan view of the lighted post of FIG. 36.
FIG. 38 is a bottom plan view of the lighted post of FIG. 36.
FIG. 42 is an enlarged detail identified by the numeral XXXXII-XXXXII of FIG. 35.
Figure 36:
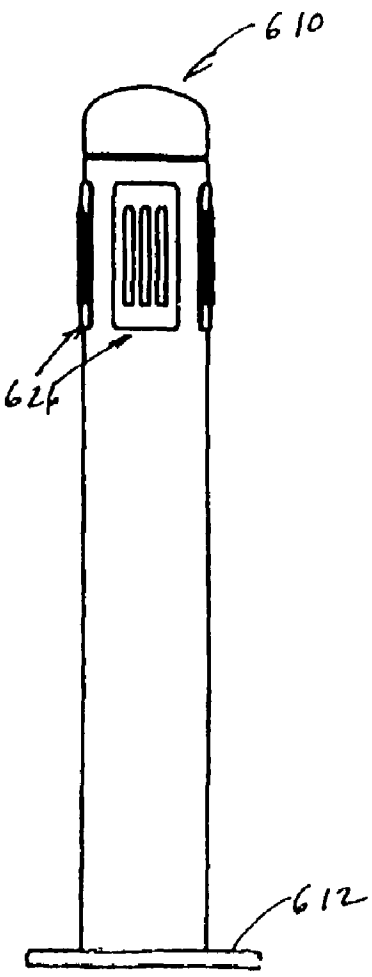
FIG. 36 is a front elevation view of the lighted post of FIG. 35.
Figure 41:
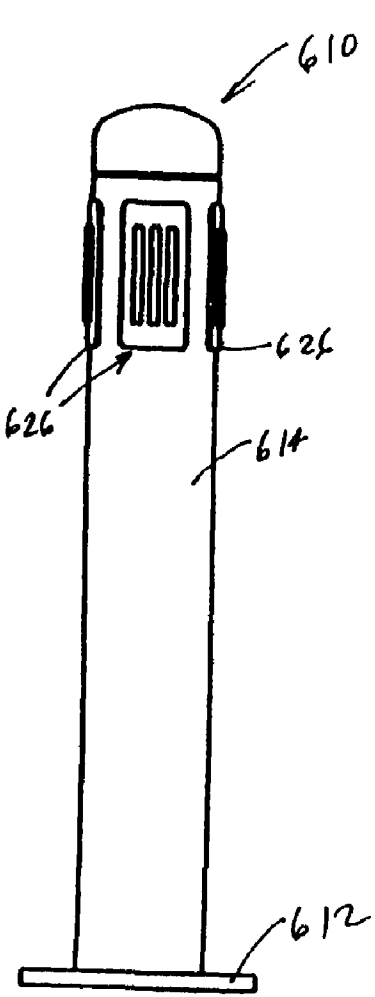
FIG. 41 is a rear elevation view of the lighted post of FIG. 36.
Figure 40:
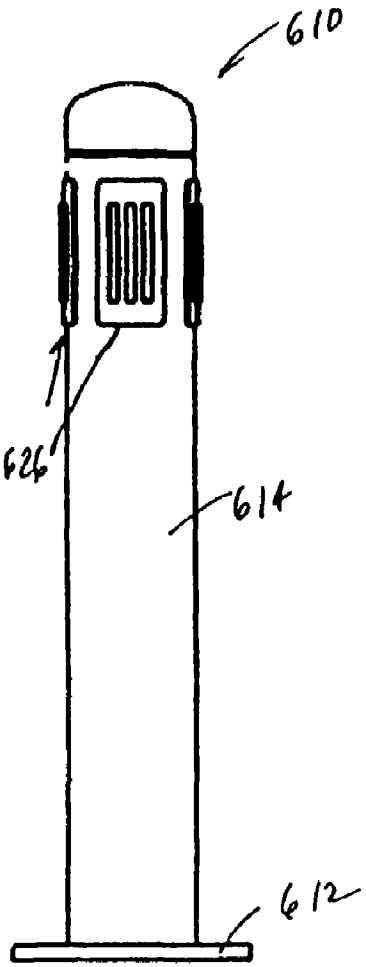
FIG. 40 is a right side elevation view of the lighted post of FIG. 36.
Figure 39:
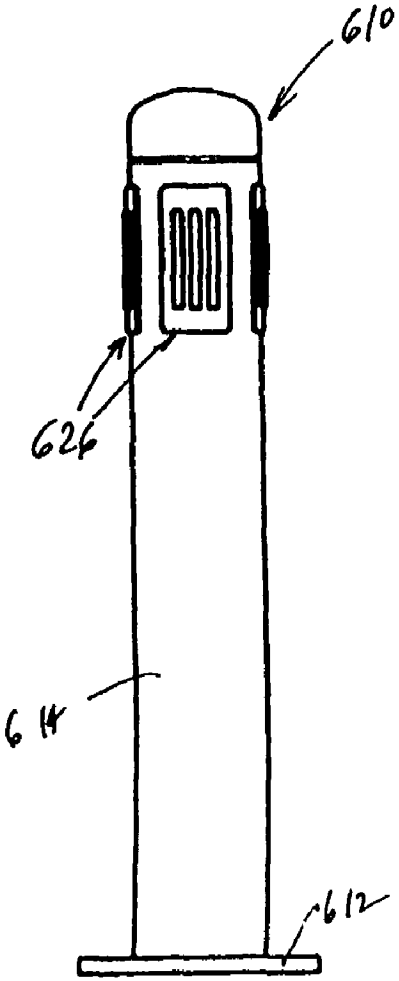
FIG. 39 is a left side elevation view of the lighted post of FIG. 36.
Figure 50:
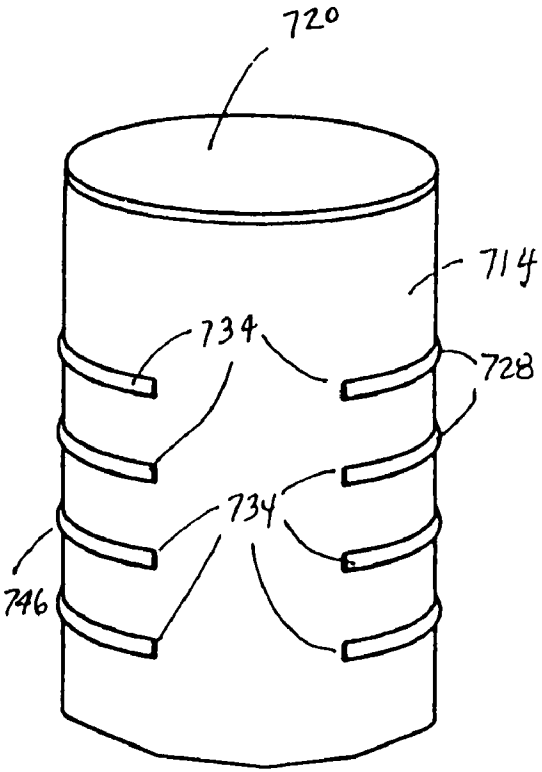
FIG. 50 is an enlarged detail view of the lighted post identified by the numeral L-L of FIG. 43.
Figure 43:
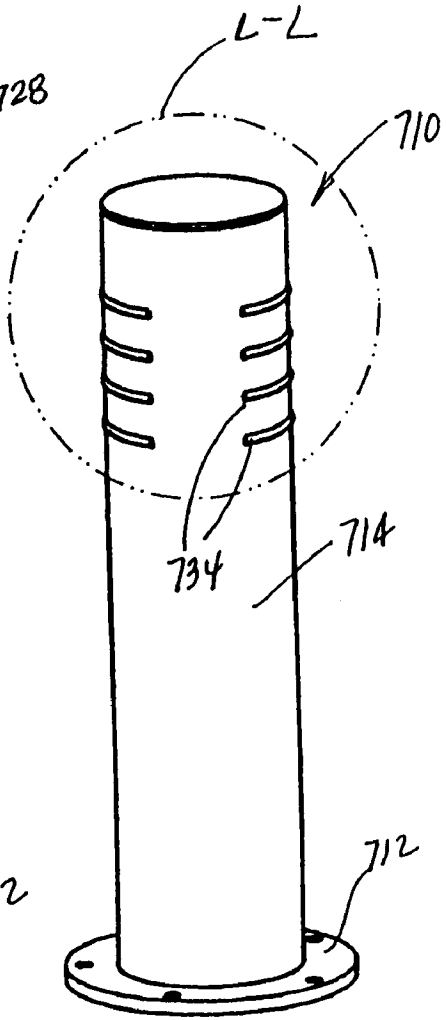
FIG. 43 is a perspective view of a fifth embodiment of the lighted post of the present invention.
Figure 44:
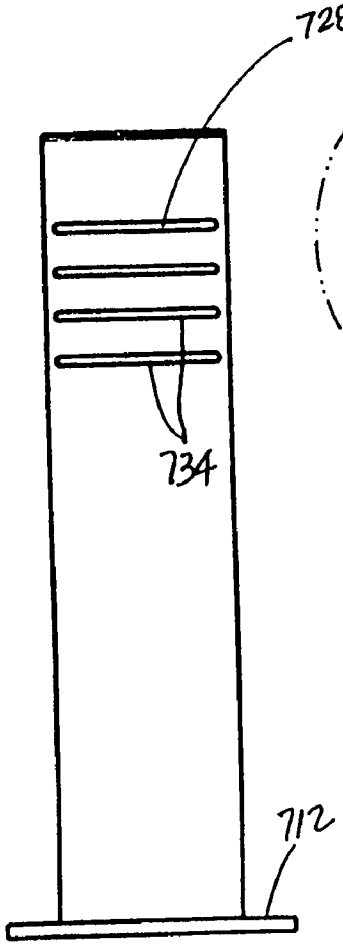
FIG. 44 is a front elevation view of the lighted post of FIG. 43.
Figure 45:
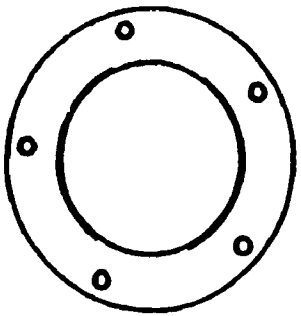
FIG. 45 is a top pan view of the lighted post of FIG. 44.

As best understood from FIG. 42, the curved outer surface 646 of each light assembly 628 is projected through the respective elongate openings 634 to further enhance the fanning of the light from their respective wave guides.

Referring to FIGS. 43-50, the numeral 710 generally designates another embodiment of the lighted post of the present invention. Similar to lighted post 510, lighted post 710 includes a tubular member 714 mounted to a round base 712, with a plurality of elongate openings 734 formed in the wall of the tubular member. Openings 734 are arranged in a vertically spaced arrangement so that openings 734 follow the contour of tubular member 714, Further, each of the elongate openings 734 have a similar size, length, and width; however, it can be appreciated that the like the other light transmitting openings, the number, size and length of the elongate openings 734 may be varied.

The upper open end of tubular member 714 is similarly closed and preferably sealed by a cover 720, which in the illustrated embodiment comprises a flat circular plate, which has an outer diameter generally commensurate in size with the outer diameter of tubular member 714.

Figure 46:
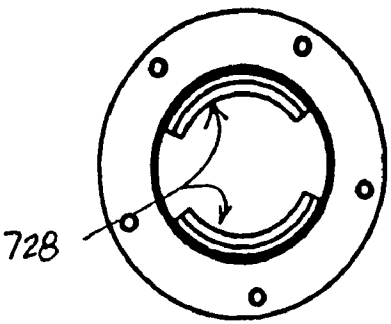
FIG. 46 is a bottom plan view of the lighted post of FIG. 44.
Figure 48:
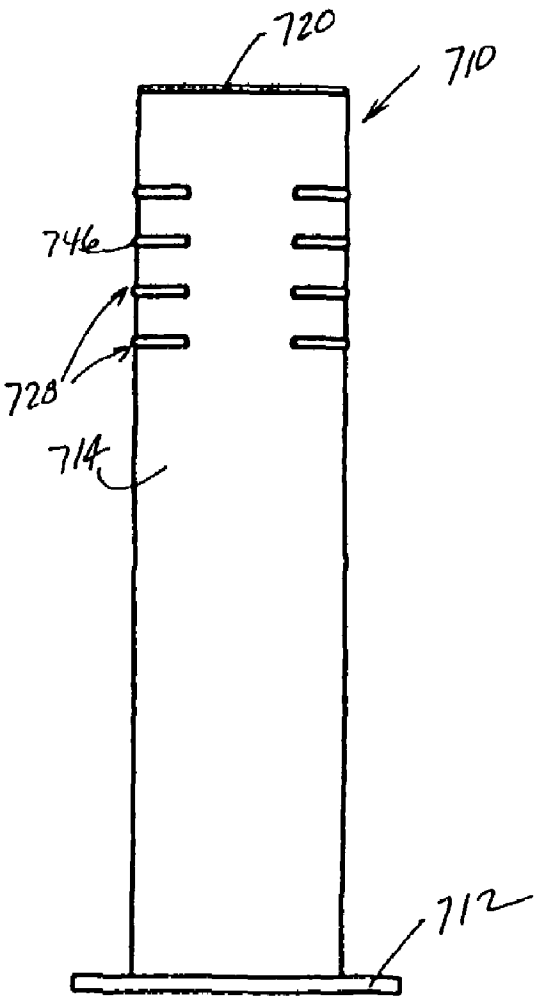
FIG. 48 is a right side elevation view of the lighted post of FIG. 44.
Figure 49:
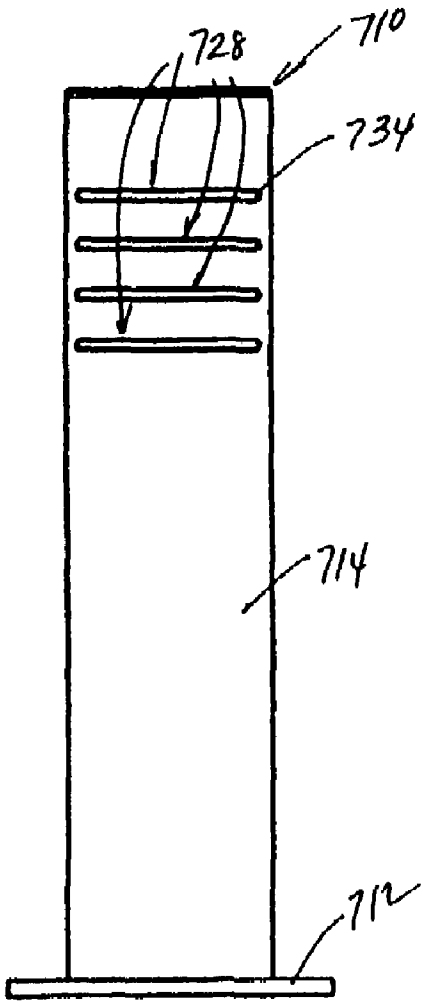
FIG. 49 is a rear elevation view of the lighted post of FIG. 44.
Figure 47:
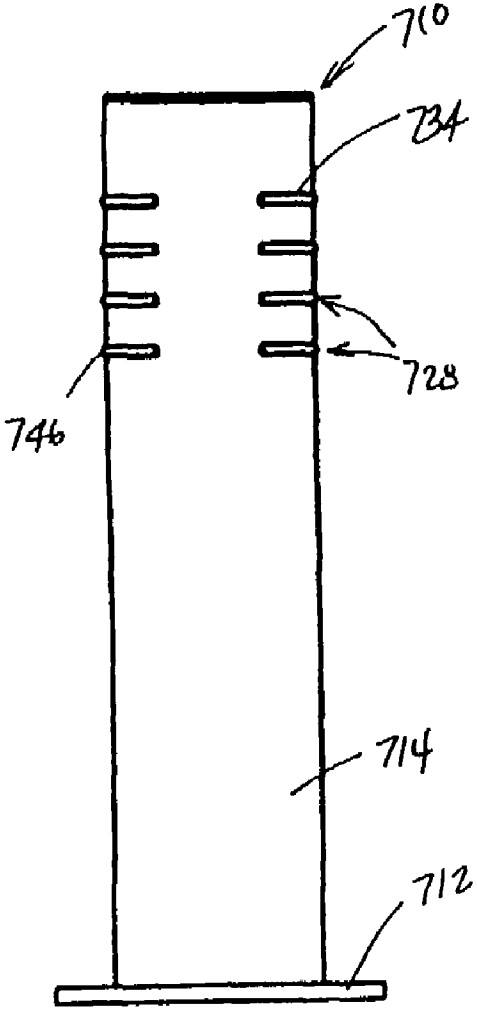
FIG. 47 is a left side elevation view of the lighted post of FIG. 44.
Figure 51:
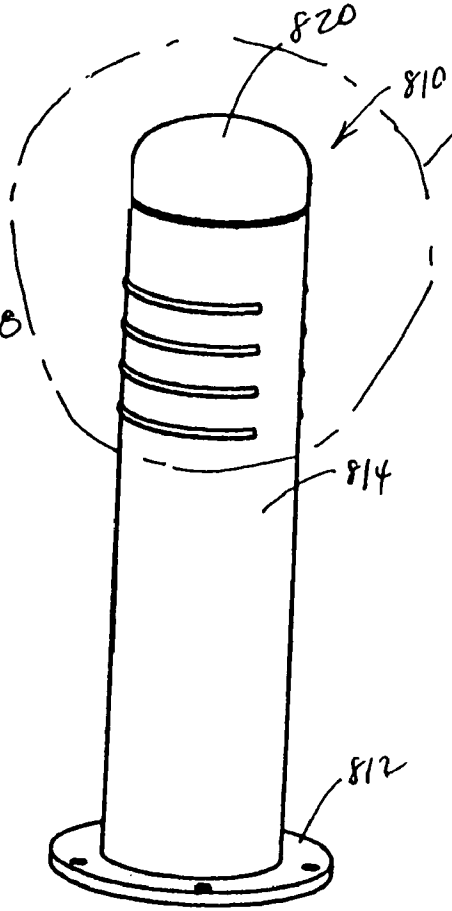
FIG. 51 is a perspective view of a sixth embodiment of the lighted post of the present invention.
Figure 55:
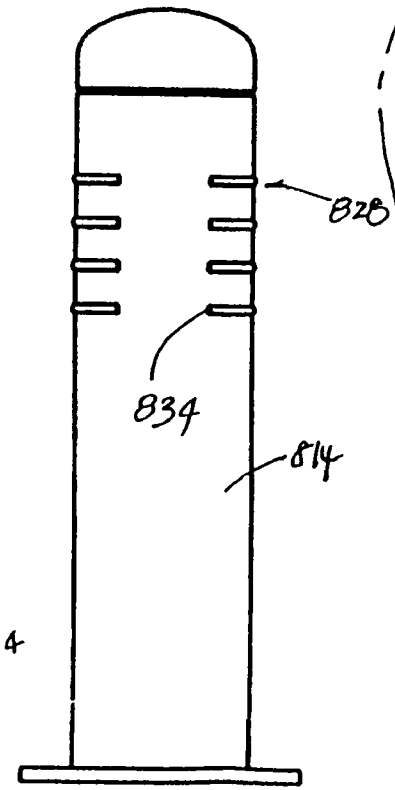
FIG. 55 is a left-hand side elevation view of the lighted post of FIG. 52.
Figure 53:
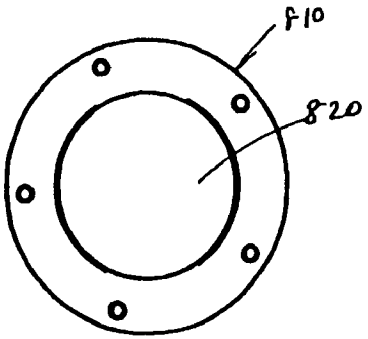
FIG. 53 is a top plan view of the lighted post of FIG. 52.
Figure 54:
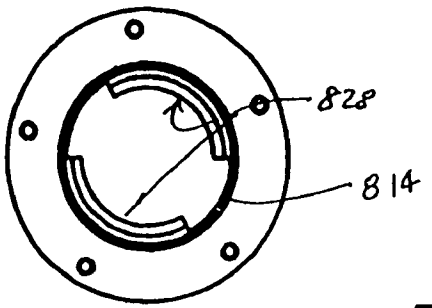
FIG. 54 is a bottom plan view of the lighted post of FIG. 52.
Figure 57:
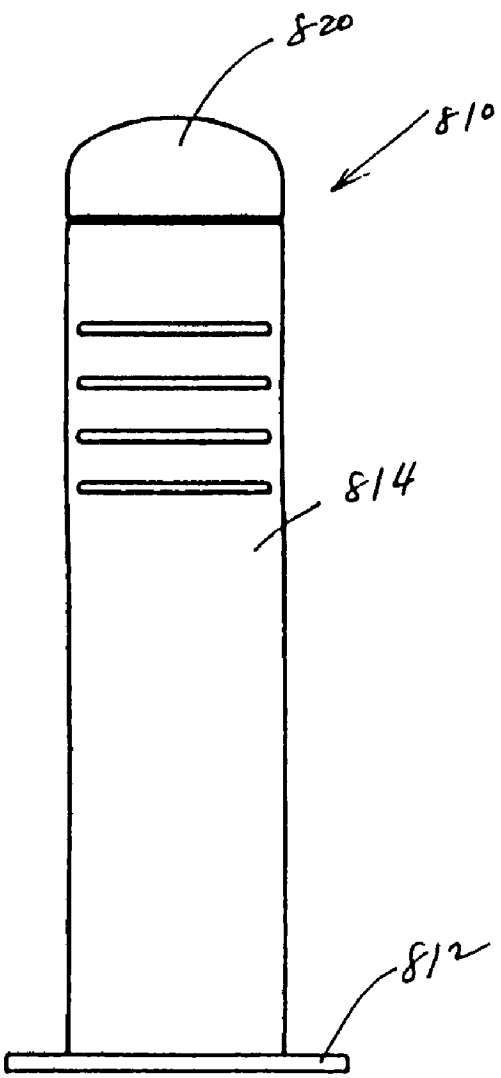
FIG. 57 is a rear elevation view of the lighted post of FIG. 52.
Figure 52:
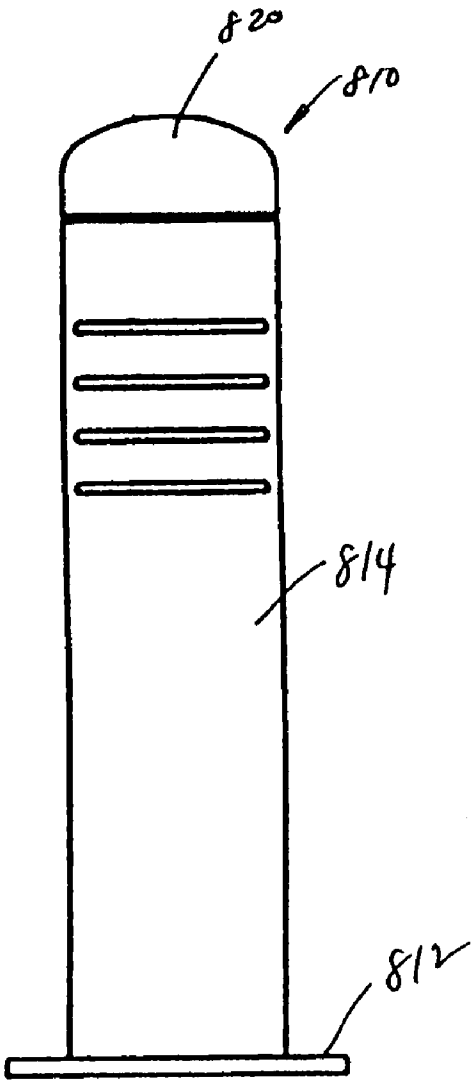
FIG. 52 is a front elevation view of the lighted post of FIG. 51.
Figure 56:
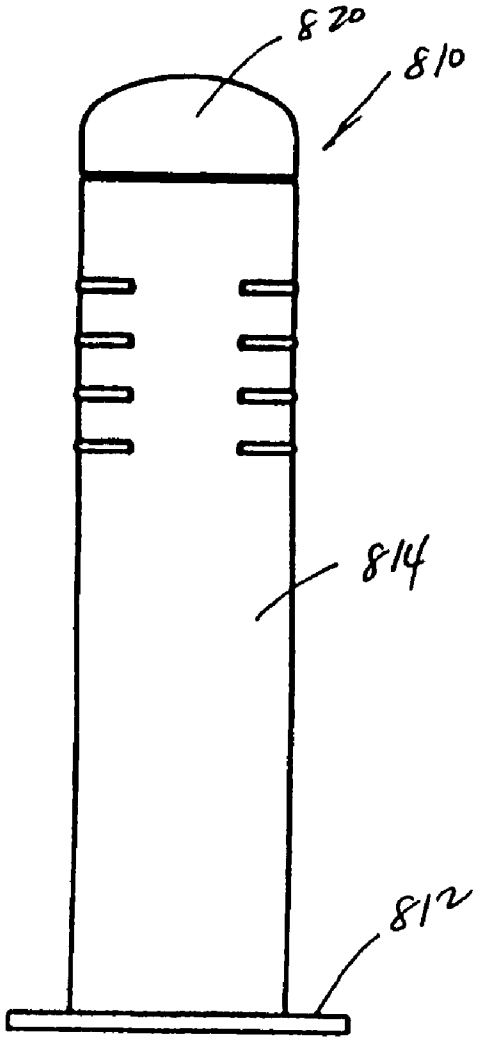
FIG. 56 is a right-hand side elevation view of the lighted post of FIG. 52.

Referring to FIG. 46, light assemblies 728, which are of similar construction to light assemblies 28, are configured so that their wave guides are bent, such as by "hard bending", into an arcuate shape to thereby at least generally follow the inner curvature and, further, the outer curvature of tubular member 714. In this manner the outer curved surface of each wave guides is bent about an arc of the tubular member. For further details for light assemblies 728 and the mounting of light assemblies 728, reference is made to the previous embodiments.

In the illustrated embodiment, the curved outer surfaces 746 of the respective light assemblies project outwardly from the opening 734. It should be understood, however, that curved outer surfaces 746 may be positioned within the respective openings so that the outer surface is at most flush or sub-flush with the outer surface 746 of tubular member 714.

Referring to FIGS. 51-58, the numeral 810 generally designates yet another embodiment of the lighted post of the present invention. Lighted post 810 is of similar construction to lighted post 710 and includes a tubular member 814, a round base 812, and a plurality of light assemblies 828 that are aligned with light transmitting openings 834 formed in the wall of tubular member 814. Cover 820 is similar to rounded cover 620 of lighted post 610. For further details of light assemblies 828 reference is made to the previous embodiment.

Referring to FIGS. 58A-58D, the numerals 810A, 810B, 810C, and 810D designate various embodiments of the lighted post of the present invention. Lighted post 810A is of similar construction to lighted post 10 described in provisional application Ser. No. 60/631,132, which is incorporated herein by reference in its entirety, and includes a tubular member 814A mounted to a base 812A. In the illustrated embodiment, panel 826A includes a plurality of light transmitting openings 834A formed in panel 826A, which are configured and arranged to form letters. In the illustrated embodiment, openings 834A are formed and configured to spell "SLOW". The light assemblies 828A, which are positioned in the respective openings, are of similar construction to light assemblies 28 referenced and described in the provisional application Ser. No. 60/631,132; therefore, for further details of light assemblies 828A and the mounting of light assemblies 828A within tubular member 814A, reference is made to the referenced provisional application.

Figure 58:
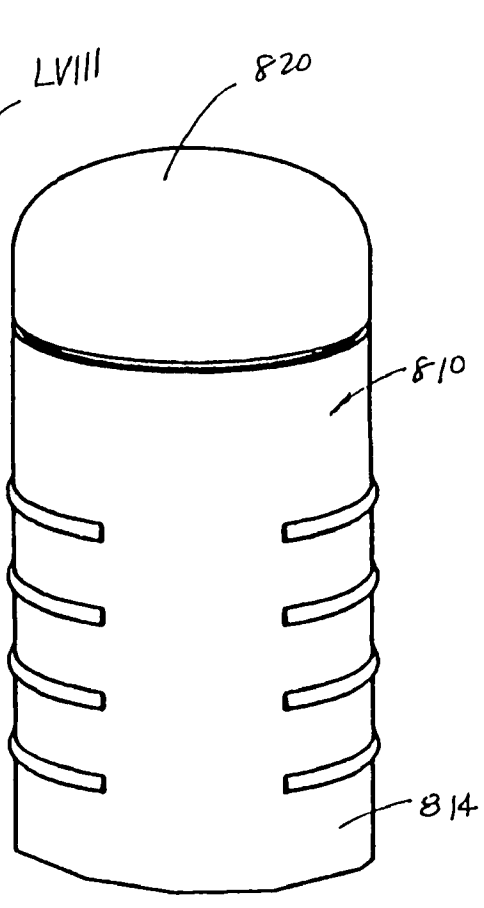
FIG. 58 is an enlarged detail identified by the numeral LVIII-LVIII of FIG. 51.
Figure 58D:
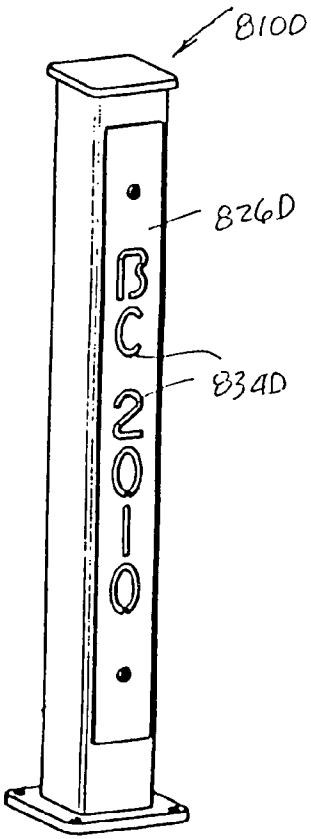
FIG. 58D is a perspective view of another embodiment of the lighted post of the present invention.
Figure 58C:
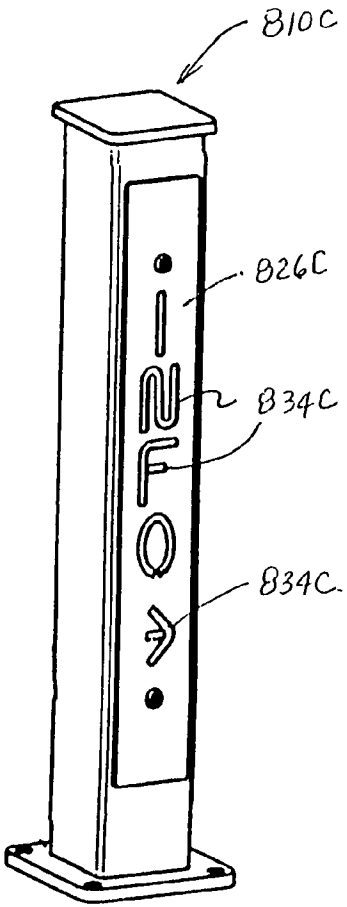
FIG. 58C is a perspective view of another embodiment of the lighted post of the present invention.
Figure 58B:
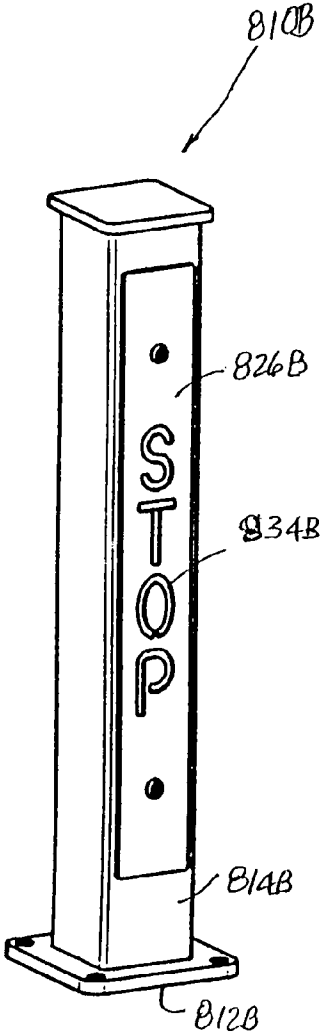
FIG. 58B is a perspective view of another embodiment of the lighted post of the present invention.
Figure 58A:
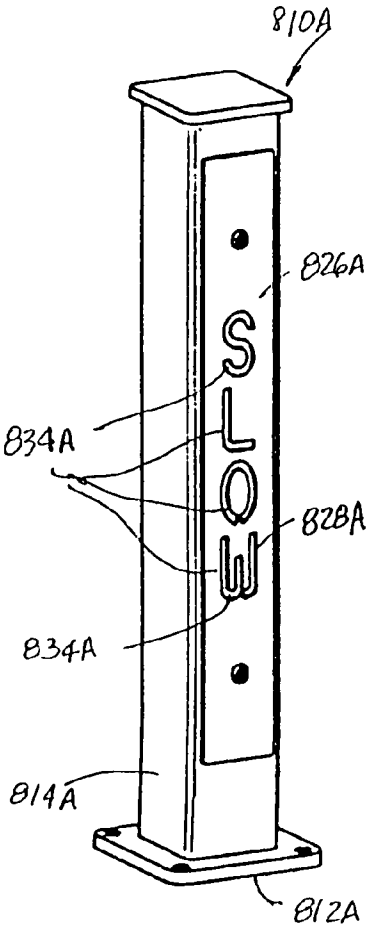
FIG. 58A is a perspective view of another embodiment of the lighted post of the present invention.

Referring to FIG. 58B, light transmitting openings 834B of lighted post 810B provided in panel 826B are configured and arranged to form the letters S, T, O, and P to form the word "STOP". Lighted post 810B is also of similar construction to lighted post 10 and includes a tubular member 814B and a base 812B. For further details of the assembly of lighted post 810B, reference is made to the referenced provisional application.

Lighted post 810C includes a side panel 826C with a plurality of light transmitting opening 834C that form the word "INFO". In addition, one of the openings may be configured to form a universal symbol, such as an arrow.

In another form, openings 834D of panel 826D of lighted post 810D are configured and arranged to form an alphanumeric identifier, such as a reference to the 2010 Olympics.

Although each of these lighted posts have been illustrated with a single side panel, it should be understood that any of the lighted posts may include two or more side panels. Further, the additional side panels for a given lighted post may be substantially identical to the side panel or may be different. For example, the additional side panel or panels may have different configurations of light transmitting openings to form other words, designs, and/or symbols or may have no light transmitting openings.

In addition, as noted, the light emitting surfaces of the respective light assemblies may be substantially flush, sub-flush, or projecting from the respective openings in the side panels. In some applications, it may be preferable for the light emitting surfaces of the light assemblies to be positioned within the light transmitting openings so that a diffuser, such as a diffuser plate or member may be positioned over the light transmitting openings. Suitable plastic diffuser members could be made from high impact plastics, such as Plexiglas or the like.

Figure 58F:
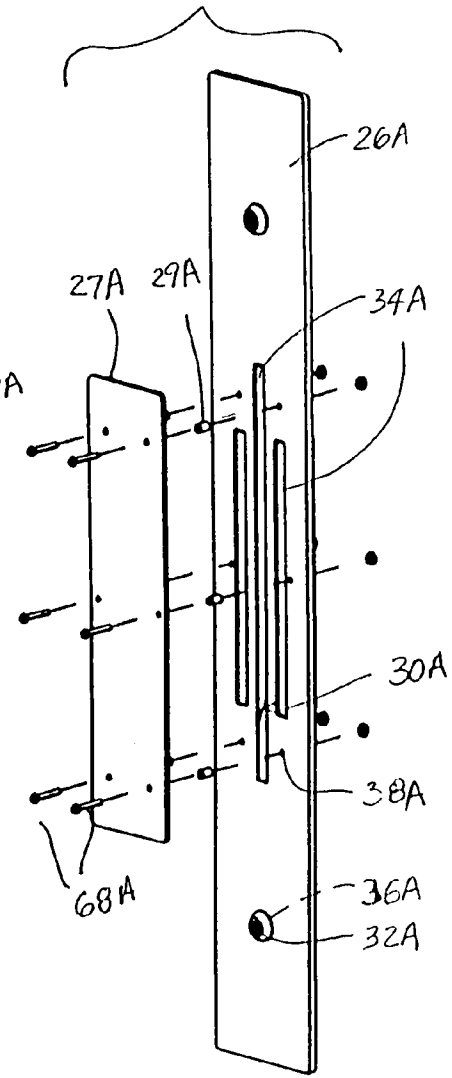
FIG. 58F is an exploded perspective view of the side panel of FIG. 58E.
Figure 58E:
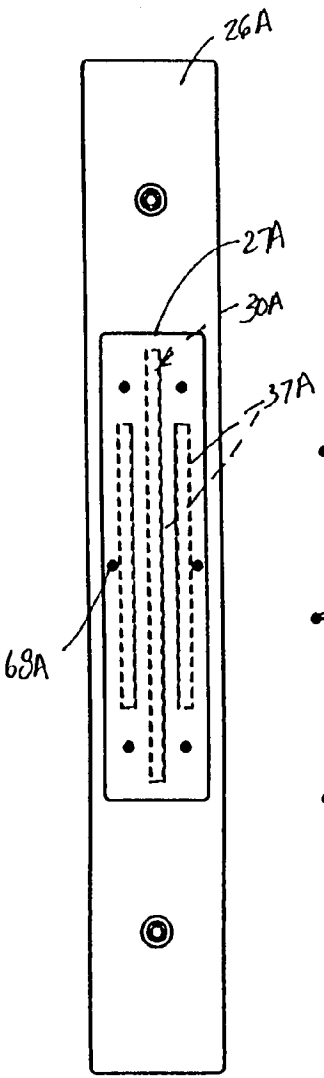
FIG. 58E is a front elevation view of another embodiment of a side panel of a lighted post of the present invention.
Figure 58G:
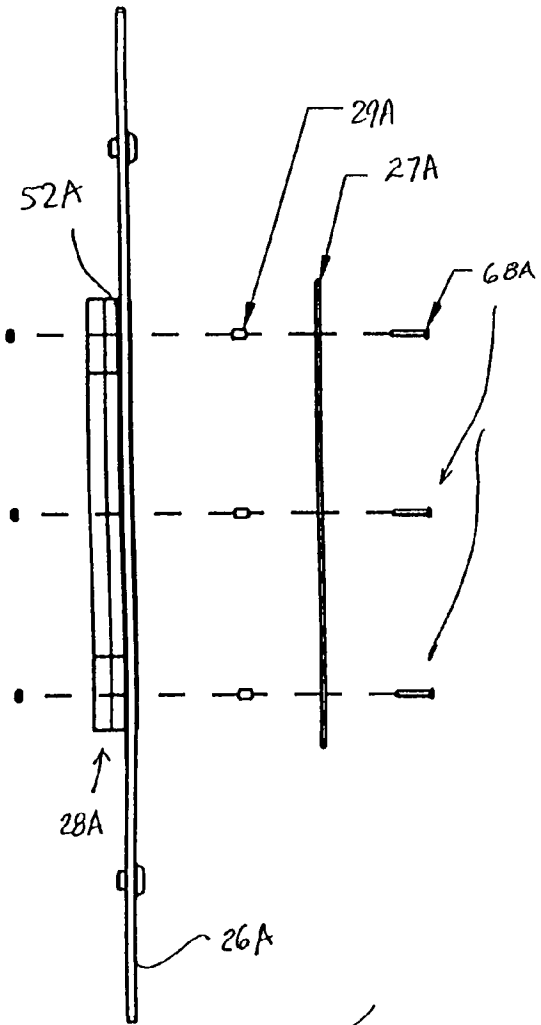
FIG. 58G is a side elevation of the side panel of FIG. 58E with a light assembly mounted to the side panel.
Figure 66:
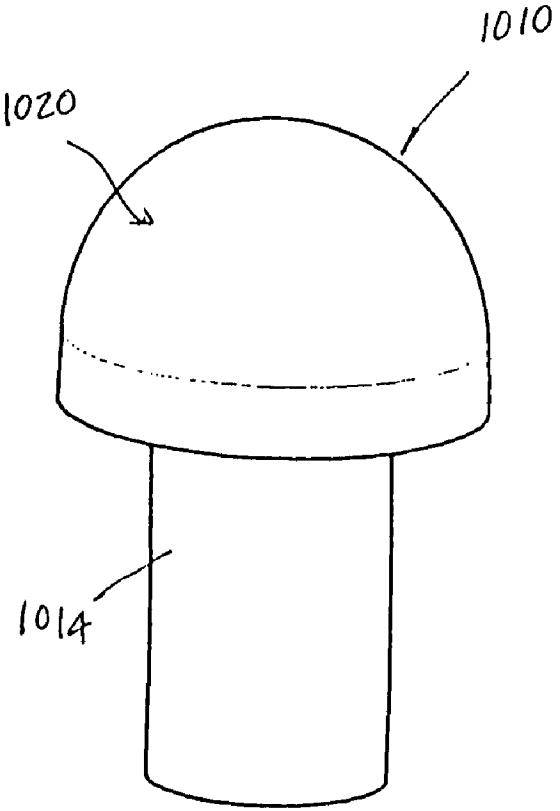
FIG. 66 is perspective view of another embodiment of the lighted post of the present invention.

Referring to FIGS. 58E-58G, side panel 26*a*, which is of similar construction to side panel 26 described in the referenced provisional applications, incorporates a diffuser 27*a* to further diffuse the light emitted from light assemblies 28*a*. For further details of the construction and arrangement of light assemblies 28*a*, reference is made to light assemblies 28 described in the referenced provisional applications.

In the illustrated embodiment, diffuser 27*a* comprises a diffuser plate that mounts over all the light transmitting openings 30*a*, which comprise elongated openings 34*a* similar to openings 34 in the referenced applications. Diffuser 27*a* is mounted to side panel 26*a* by a plurality of fasteners 68*a* that extend through mounting opening 38*a* and, further, through the light assemblies' mounting bracket 52*a* wherein fasteners 68*a* mount both the diffuser and the light assemblies to the side panel.

Referring to FIGS. 58F and 58G, optionally, stand-offs 29*a* in the form of truncated cylindrical members may be positioned between diffuser 27*a* and side panel 28*a* to offset diffuser 27*a* from the surface of the side panel.

As previously noted, diffuser 27*a* preferably comprises a plastic member. In addition, diffuser 27*a* may be tinted either by a coating applied to the diffuser or by incorporating color into the plastic material forming the diffuser.

Alternately, each light transmitting opening may incorporate a diffuser. For example, the light emitting surfaces of the respective light assemblies may be sub-flush with respect to the outer surface of the side panel so that a diffuser element, such as a plastic member, may be positioned in each of the light transmitting openings of the side panels. Optionally, the outer surfaces of the diffusers may be flush with the outer surface of the panel or may project outwardly. The diffusers may be formed with a mechanical attachment means, such as spring tabs or the like, to form, for example, a snap-fit coupling with the side panels. Alternately, the diffusers may be bonded to the panels using adhesive bonding, or in the case of plastic side panels may be welded or molded in place, for example, using insert molding or two-shot molding or the like. Another method of providing the diffusers includes coating the side panels with a suitable plastic to form the diffuser or respective diffusers. For example, the side panels may be formed from two-shot molding or insert molding, with the diffuser extending over the entire side panel or just a portion thereof.

Figure 59:
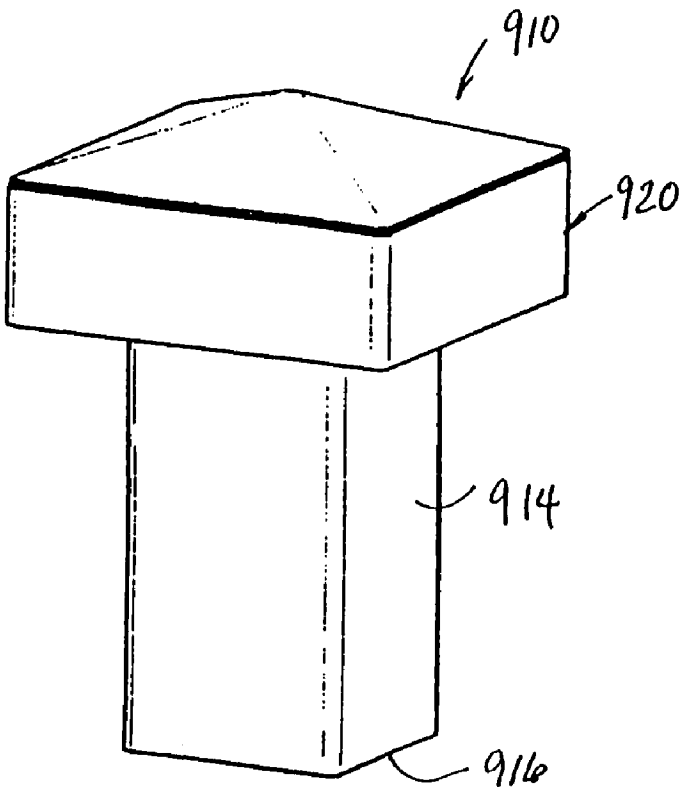
FIG. 59 is a perspective view of another lighted post of the present invention.
Figure 61:
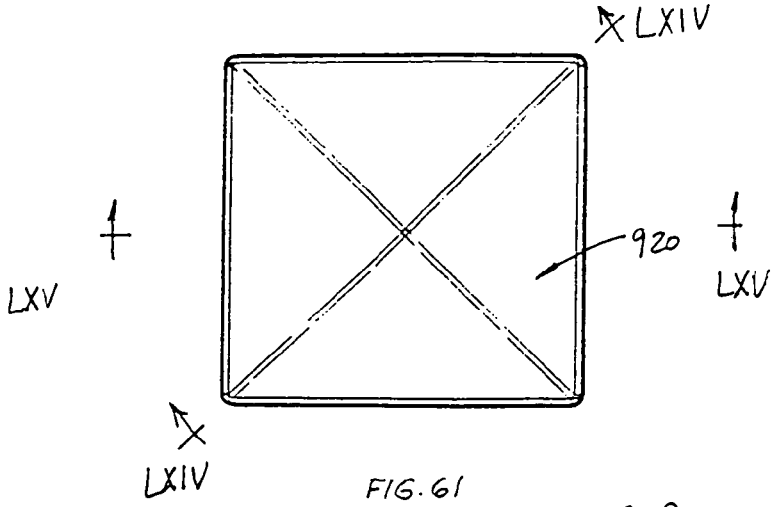
FIG. 61 is a top plan view of the lighted post of FIG. 60.
Figure 60:
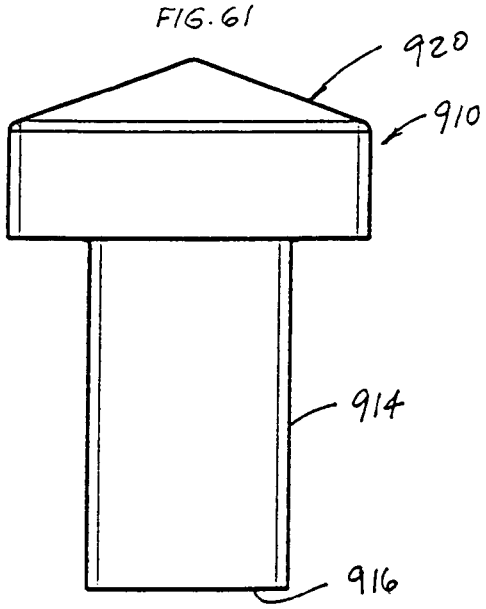
FIG. 60 is a front elevation view of a lighted post of FIG. 59.

Referring to FIG. 59, the numeral 910 generally designates another embodiment of a lighted post of the present invention. As will be more fully described below, lighted post 910 is particularly useful as a pathway light and incorporates the use of one or more light assemblies (940) that use less energy and produce less heat than the lights used in conventional pathway lights and, further, in a manner to eliminate the need for louvers used in conventional pathway light designs.

In the illustrated embodiment, lighted post 910 includes a support 914 that is mounted to or in the ground. Alternately, support 914 may be mounted to a support base, including a base plate, a mat, or a deck, such a concrete or asphalt pad or a wooden deck or the like. It should be understood that the manner of mounting the support post may vary depending on its application. For example, the support may be mounted by a base plate or flange, may be "cast in place", or may be mounted in a receptacle, such as a sleeve to provide a removable light design. For example, support 914 may include an inner post that extends below support 914, which is then inserted into a hole formed in the ground and cast in the hole, for example, by concrete to in effect form a piling for the post. Alternately, a separate tubular member may be cast in the ground to form a sleeve into which support 914 or an inner post is inserted to form a removable post.

Support 914 is preferably formed from a strong, rigid material, such as metal, including aluminum, stainless steel, or iron, so that lighted post 910 may be used as a commercial or residential light. However, it should be understood the support may be formed from plastic, such as a reinforced plastic, wood, or a composite material. In addition, in the illustrated embodiment, support 914 comprises a square tubular member; however, as will be described below, the shape of the tubular member may be varied.

Figure 62:
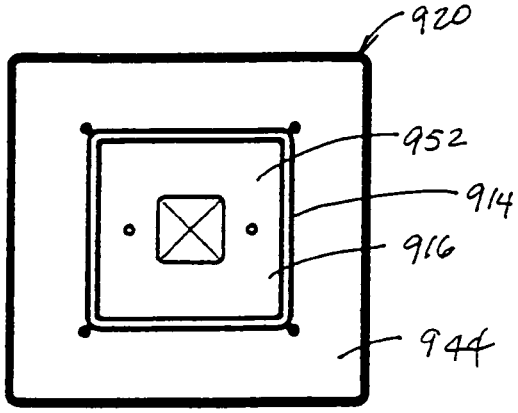
FIG. 62 is a bottom plan view of the lighted post of FIG. 60.
Figure 64:
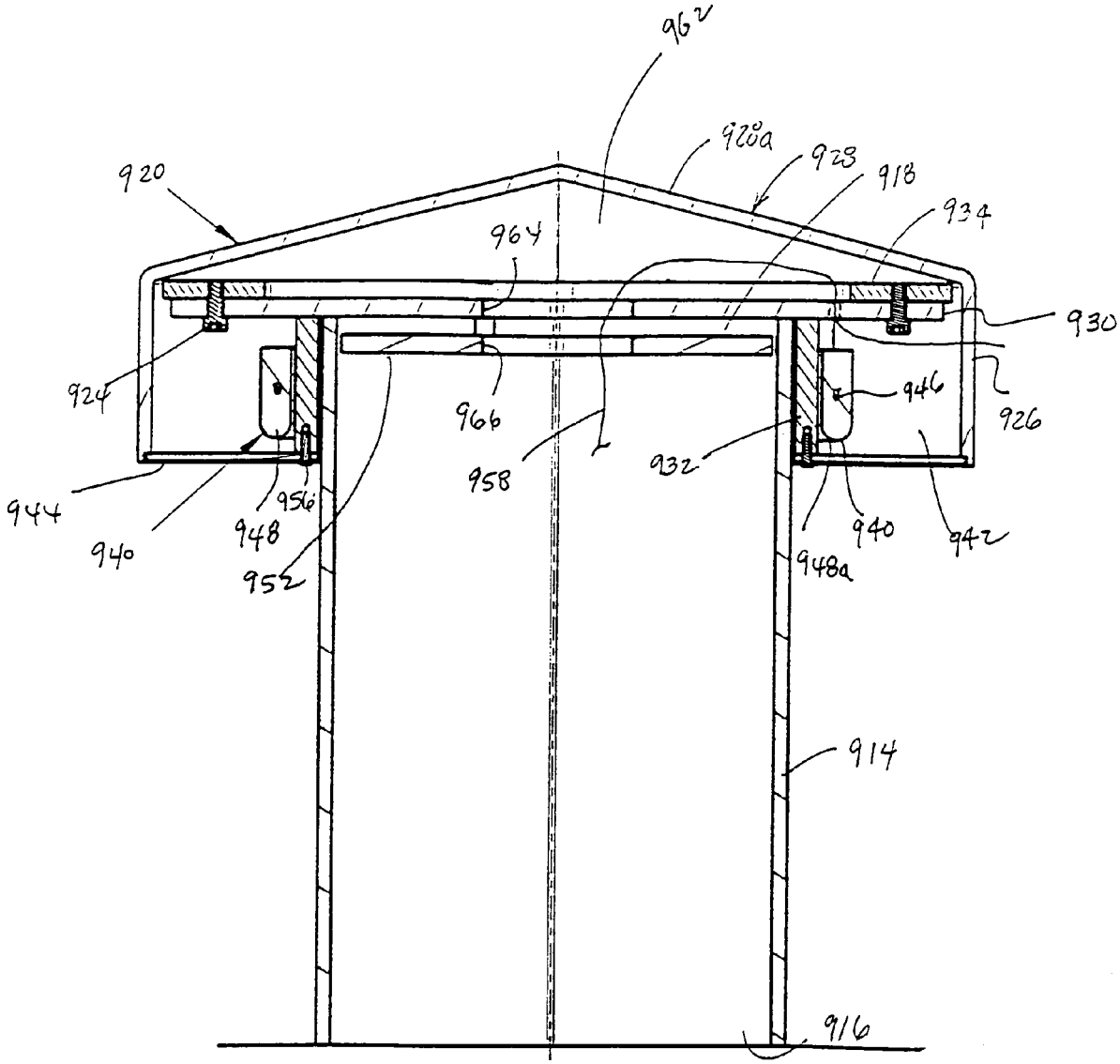
FIG. 64 is a cross-section taken along line LXIV-LXIV of FIG. 61.

As best seen in FIGS. 62 and 64, support 914 includes a lower open end 916 and an upper open end 918, which is closed by a cover assembly 920. Cover assembly 920 includes a cover 921 and a mounting bracket 922, which mounts cover 921 to support 914. As will be more fully understood from the description that follows, cover 921 is free of louvers or other openings so that cover 921 can seal the open upper end of the support and also seal the light assembly.

Cover 921 and bracket 922 may be formed from the same material as support 914 or may be formed from a different material. Cover 921 is secured to bracket 922, for example by fasteners 924, such as screws or bolts, or the like, so that cover 921 may be removed from the bracket.

In the illustrated embodiment, cover 921 includes a perimeter base flange 926 and a top 928, which is either formed with or secured to base flange 926 for example by adhesive bonding or welding. Alternately, top 928 and flange may be integrally formed, for example, by molding. In the illustrated embodiment, top 928 comprises a pyramid-shaped member 928*a*. It should be understood that the shape and size of the top and cover may be varied.

Bracket 922 includes a substantially planar mounting or support flange 930 and a perimeter flange 932 which is either formed with flange 930, or secured thereto for example by welding or adhesive bonding or other suitable fastening methods, and mounts over the upper end of support 914. Flange 930 includes a plurality of mounting openings 930*a* for receiving bolts or screws for securing bracket 922 to support 914, as will be more fully described below.

Referring to FIG. 64, cover 921 includes a mounting flange 934, which is formed or secured therein, for example by welding or gluing, or other suitable fastening methods. Alternately, flange 934 may be formed with cover, such as during molding in the case of plastic or the like. In the illustrated embodiment, mounting flange 934 is located adjacent the upper end of base flange 926 and secures to bracket 922 by a plurality of fasteners 924. It should be understood that the location of mounting flange 934 may be varied.

Figure 65:
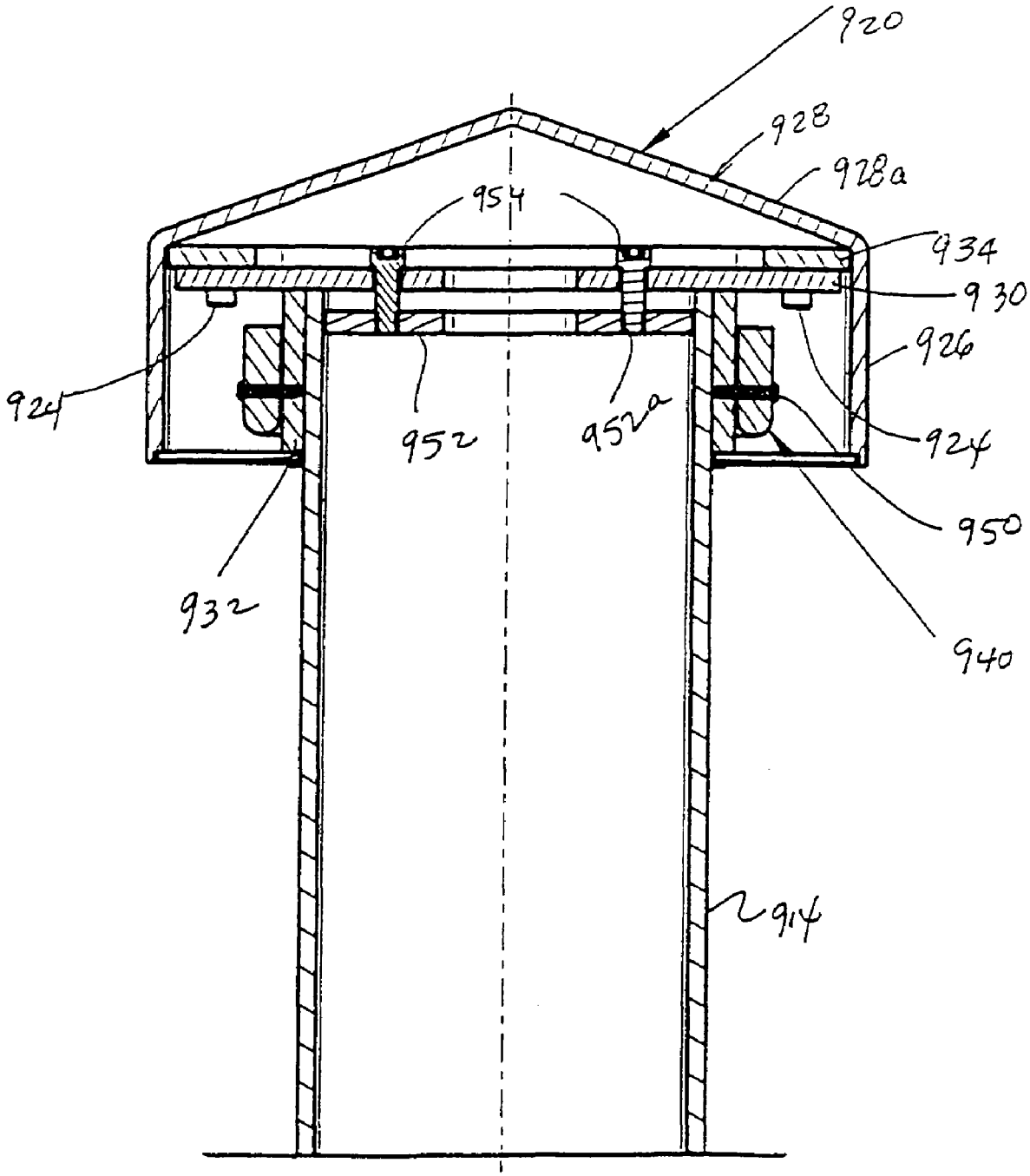
FIG. 65 is a cross-section taken along line LXV-LXV of FIG. 61.

As best seen in FIGS. 64 and 65, one or more light assemblies 940 are mounted to the outwardly facing side of perimeter flange 932 at perimeter flange 932 inwardly of base flange 926 so that cover assembly 920 shields light assembly 940, as will be more fully described below. Light assembly 940 may comprise a single LED lighting strip or may comprise two or more LED lighting strips. Suitable LED lighting strips are available under the tradename PLEXINEON by Light Technologies, Inc. of Ill. In this manner, when cover 921 and bracket 922 are mounted to support 914, the light from light assembly 940 will create a puddle of light around support 914. However, as will be more fully described below, the space 942 (FIG. 64) between cover 921 and bracket 922 is closed by a light transmitting member 944 to eliminate bug and dirt intrusion into the tubular member and into cover 921.

Each light assembly 940 is formed from a plurality of light sources 946 (FIG. 64), and preferably a string of light sources, such as a string of light emitting diodes and, more preferably, a string of high intensity light emitting diodes that are contiguously mounted, for example, to circuit board. The LEDs may produce a white light or may produce colored light, such as blue, yellow, red, or provide different levels of white light. In addition, each light assembly 940 includes a body that is configured to act as a wave guide 948 (FIG. 64), which scatters the light emitted by the light sources along its length but allows the light to exit through its light emitting surface 948*a*. In the illustrated embodiment, light emitting surface 948*a* is directed downwardly; however, as will be more fully described below, light assembly 940 may be mounted such that its light emitting surface is facing upwardly toward bracket 922 or outwardly towards flange 926 of cover 921. The light sources are enclosed in a housing that is positioned adjacent the wave guide and directs the light into the wave guide. The housing also houses the electrical wiring and circuit board for the LEDs. For further details of a suitable light assembly, reference is made herein to U.S. Pat. No. 6,592,238, which is incorporated by reference herein in its entirety.

Referring again to FIG. 65, light assembly 940 is mounted to bracket 922 by fasteners 950. Fasteners 950 extend through light assembly 940 and secure the light assembly to perimeter flange 932 of bracket 922. In addition, fasteners 950 may optionally extend through flange 932 and contact support 914 to provide additional securement of cover assembly 920 to support 914, as will be more fully described below.

Figure 63:
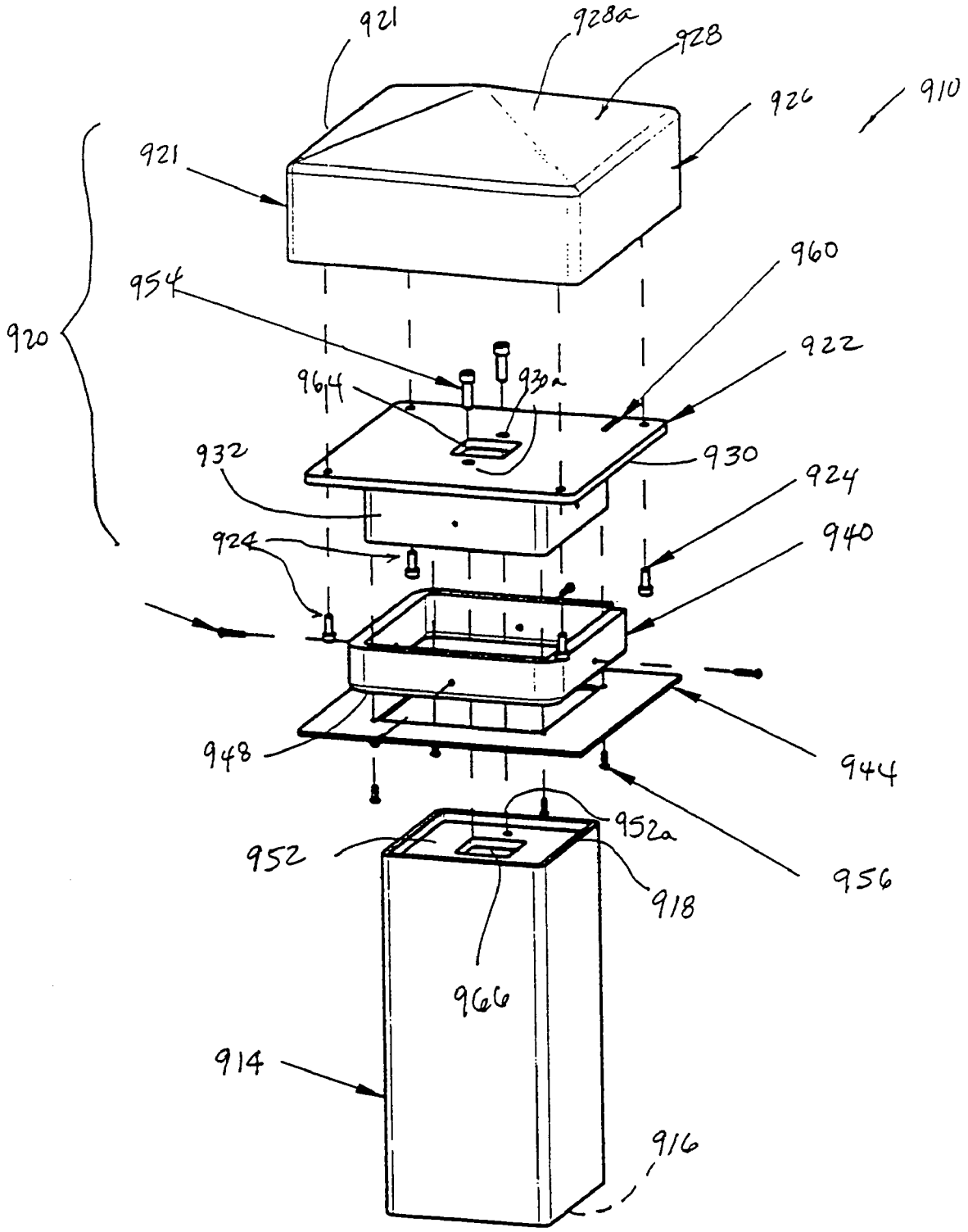
FIG. 63 is an exploded perspective view of the lighted post of FIG. 59.

As best seen in FIGS. 63-65, support 914 includes a mounting member or plate 952 positioned at or near its upper open end 918. Member 952 may be formed from the same material as support 914 or may comprise a different material. Member 952 is secured in support 914 by, for example, welding or adhesive bonding or other suitable attachment methods and provides a surface to which cover assembly 920 may be secured. As previously noted, flange 930 of bracket 922 includes a plurality of openings 930*a*, which receive fasteners 954 that extend into and engage member 952 through openings 952*a*.

To assemble the light assembly, light assembly 940 is mounted to bracket 922. Bracket 922 is then mounted on support 914 and secured to member 952 by fasteners 954. Fasteners 950 are then tightened further to contact and bear against support 914. After fasteners 950 are tightened, then cover 921 is placed over bracket 922 and secured to flange 930 by fasteners 924. Once cover 921 is secured to bracket 922, then light transmitting member 944 is inserted into a groove provided in flange 926 of cover 920 and secured to perimeter flange 932 of bracket 922 by fasteners 956 (FIG. 64) to thereby close and preferably seal the space between cover 921 and bracket 922 and, thereby, at least substantially seal light assembly 940 in cover assembly 920. In this manner, the cavities or spaces within the lighted post are now at least substantially sealed from bug or dirt intrusion into the light assembly.

Light assembly 940 is powered through wiring 958, which extends from light assembly 940 through a transverse opening 960 provided in flange 930 of bracket 922 into cavity 962 formed by cover 921 and then back down through central openings 964 and 966 provided in flange 930 and member 952, respectively. Alternately, connecting wires may extend from the tubular member through openings 964 and 966 above bracket 922 for coupling to the light assembly or assemblies in space beneath cover 921. Central openings 964 and 966 are at least generally aligned over upper open end 918 of support 914. Support 914 may house a power board, such as a power circuit board with a transformer, that powers the LED and, further, which may include logic circuitry or a controller to provide one or more functions, such as a timer for the light assembly, with the board powered by an external power supply. Alternately, wiring 958 may be extended through support 914 for coupling to an external power supply and optionally external control circuitry.

As noted above, light assembly 940 may be oriented with its light emitting surface facing outwardly or upwardly. In this configuration, a reflective surface or member is preferably provided at the inner surface of cover 921 or at the downwardly facing side of flange of bracket 922 so as to deflect and/or diffuse the light from light assembly 940 in a downward direction and/or in an outward direction from the lighted post. In this manner, the size and light intensity of the puddle of light created by the light assembly may be adjusted as desired. Further, light transmitting member 944 may include one or more optical regions or surfaces for directing light in a desired light pattern, though this is only optional.

In the illustrated embodiment, the light assembly extends around the full perimeter of support 914; however, it should be understood that light assembly 940 may extend around only a portion of the lighted post perimeter or, as noted above, may be provided by a plurality of light assemblies that are either arranged to extend around the full perimeter of the support, a part of the perimeter of the support, or over a discrete portion of the perimeter of the support. However, in the preferred embodiment, the light assembly or assemblies extend around the full perimeter of the support to provide a light emitting surface or surfaces that extend around the full perimeter of the support to generate a line of light around support 914 with a substantially uniform light intensity. It should also be understood that when more than one light assembly is used, the light assemblies may generate the same color light or different color light. For example, one half of the lighted post may be washed with one color light and another half of the light may be washed with a second color of light. It should be understood that the number of light assemblies may be increased to provide even further variations.

Because the outer light emitting surface 948 of the wave guide is curved, the light emitted from the respective light assembly is fanned outwardly, such as illustrated in FIG. 7 of U.S. Pat. No. 6,592,238, referenced above. Though the LEDs tend to produce directional light, the wave guide will distribute the light from the LEDs in a manner to simulate a neon light. However, the light assemblies of the present invention produce much less heat than a neon light or other conventional lights, which reduces the risk of a burn injury to a passerby. Further, as noted, the support may be closed and essentially sealed, which eliminates bug or dirt intrusion into the support or into the cover, which will allow the lighted post to remain clean and maintain its aesthetic appearance.

Accordingly, when assembled, lighted post 910 is substantially sealed, which reduces if not eliminates bug and dirt intrusion into the lighted post and, when powered, may produce a uniform puddle or pattern of light that is suitable for use as a pathway light. Furthermore, the voltage requirements to power the light assembly or assemblies within the support are relatively low and, therefore, consume less power than conventional pathway lights. In addition, by incorporating LED light sources, the heat produced by the light assembly or assemblies is significantly reduced over neon, halogen, metal halide, high pressure sodium, fluorescent, and incandescent lights or the like, and further, have an extended life. Consequently, the light assemblies may be left on for extended periods of time. In addition, given the expected life expectancy of the light assembly or assemblies, the lighted post may be assembled in a manner so that the light assembly or assemblies are permanently mounted.

As previously noted, the orientation of the light emitting surface or surfaces of the light assembly 940 may be varied. For example, light emitting surface 948 may be oriented to direct the light outwardly toward the inner surface 926*a* of perimeter wall 926. In which case, the inner surface 926*a* of perimeter wall 926 of cover 920 may incorporate a reflective member or reflective surface for directing and diffusing the light in a desired direction, for example downwardly or outwardly and downwardly toward support 914. Suitable reflective surfaces include reflective tape, reflective paint, and the like. Suitable reflectors include metal reflectors, such as aluminum reflectors, including polished aluminum reflectors formed from sheets or plates of aluminum that are configured in a shape to achieve the desired light pattern. For example, a parabolic-shaped reflector may be used to provide a defined light pattern. Where light emitting surface 948 is directed upwardly toward the cover, bracket 922 may similarly incorporate a reflective member or surface to achieve the desired light pattern.

As noted previously, the various components forming the structure of lighted post 910 may be formed from a wide variety of materials, including plastic. A suitable plastic may include some percentage of recycled materials, including post consumer recycled (PCR) material, depending on the application. In addition, at least the exterior surfaces of the components may be painted, coated, including powder coated, stained or the like, as desired. For plastic components, the components may be assembled using welding and/or fastening devices, such as screws, bolts, rivets or the like. Notably, all of the structural components comprising the lighted post may be plastic given the low heat output from the light assembly (or light assemblies). In addition, when formed from plastic, the components may be formed, such as by molding, from more than one type of material. For example, any one of the components may be formed from two or more plastics using two-shot molding or the like or may be formed from a composite material and formed, for example, by insert molding. For example, when a reflective surface is desired, the component may be formed by insert molding the reflector into the component.

As would be understood, most lighted posts are configured to prevent "up-lighting"; hence, the covers or at least the brackets (922) are formed to provide a shade and, hence, formed from a non-light transmitting material or at least painted or coated or the like to prevent light transmission. However, in some applications "up-lighting" may be desired, in which case the bracket and cover may be provided with one or more light transmitting portions. For example, bracket 922 and cover 921 may be formed from or include a portion formed from a transparent or translucent material, such as plastic.

Optionally, lighted post 910 may incorporate a sensor that detects, for example, motion or light, for example, a low light condition, which triggers actuation of the light assembly or assemblies. For example, support 914 may house a circuit and/or electronics that are coupled to the sensor and responds to the sensor detecting motion or a low light condition by, for example, powering the light assemblies.

Figure 65A:
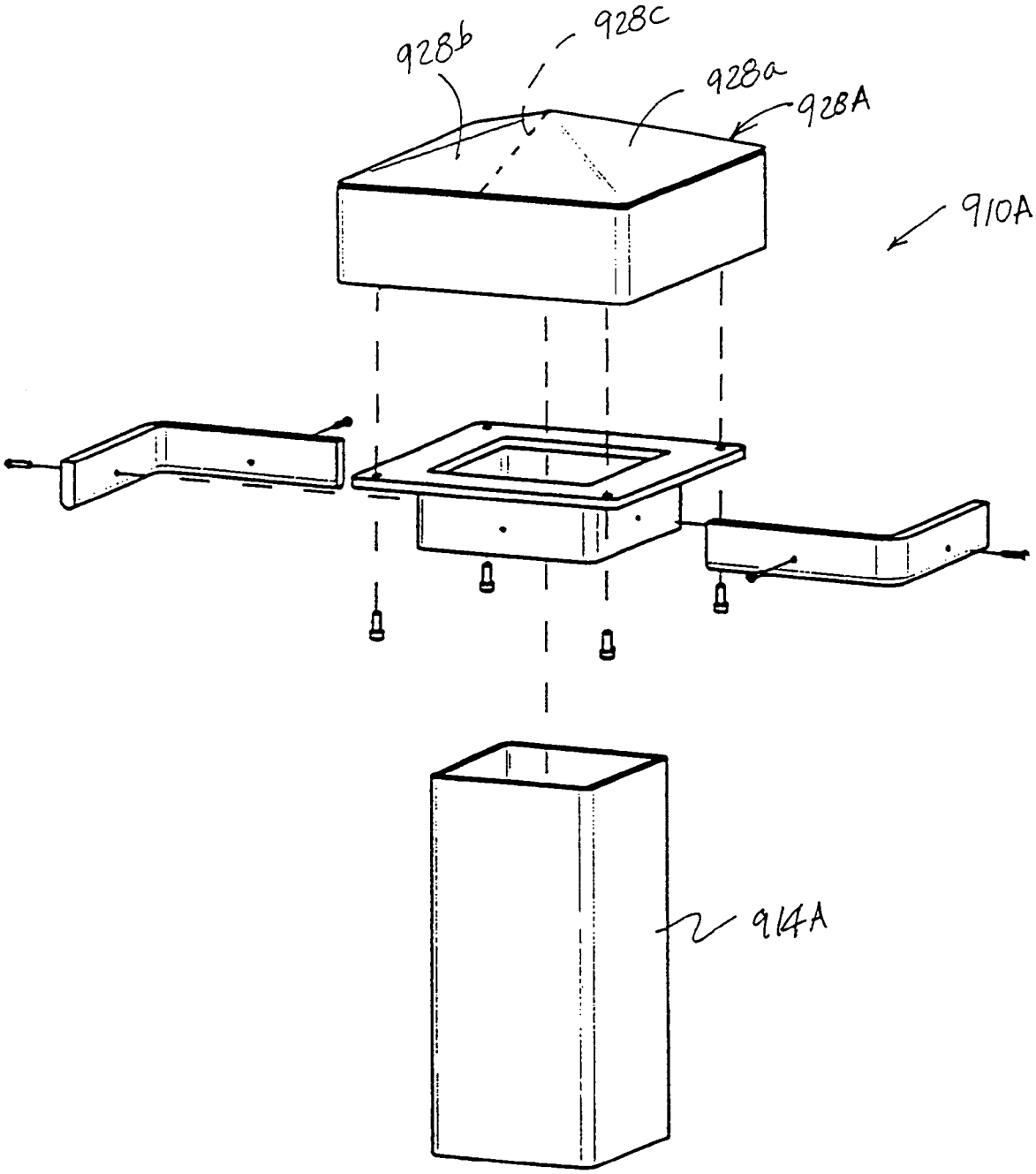
FIG. 65A is an exploded perspective view of another embodiment of the lighted post of the present invention.
Figure 65B:
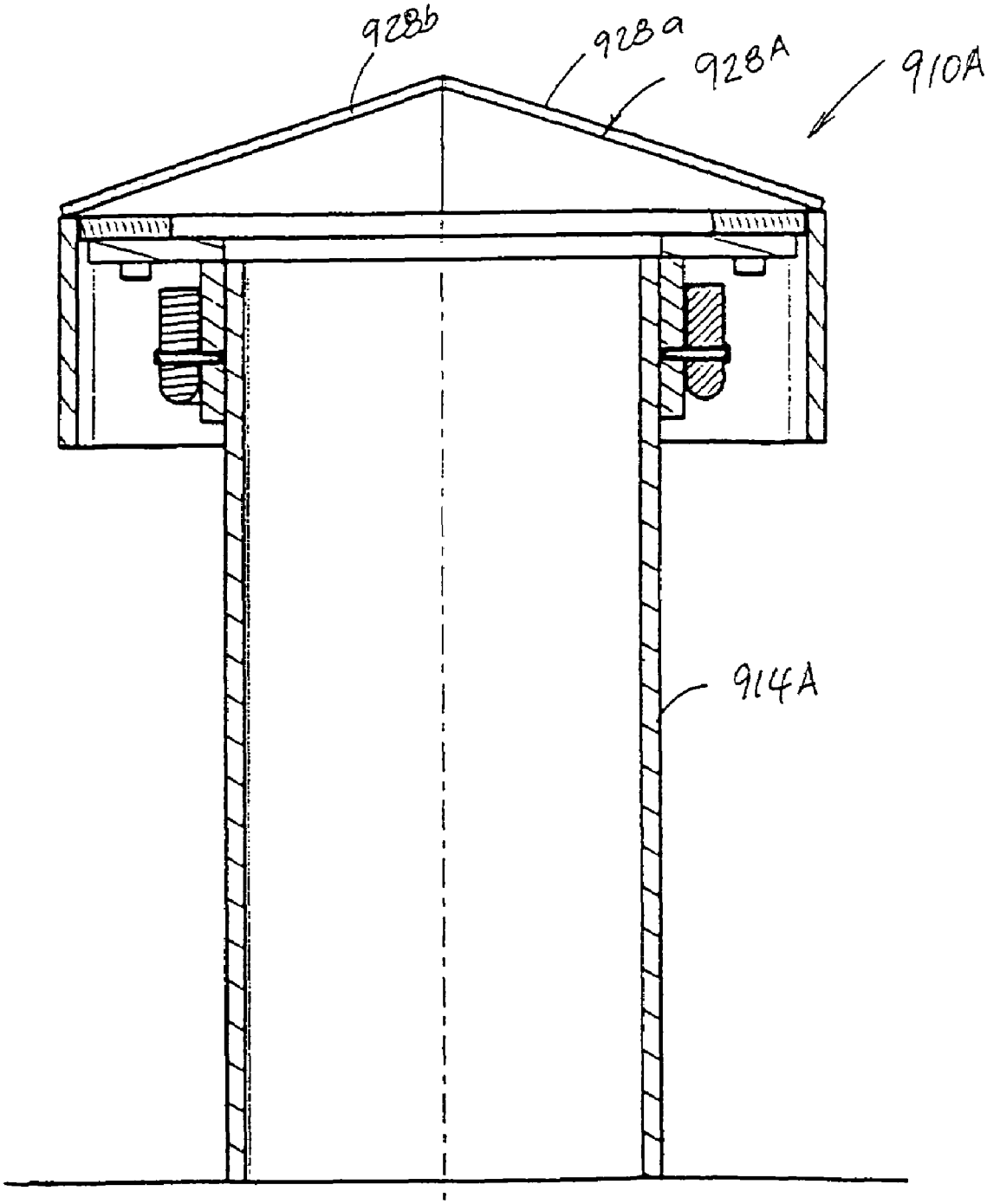
FIG. 65B is cross-section of the lighted post of FIG. 65A.
Figure 65C:
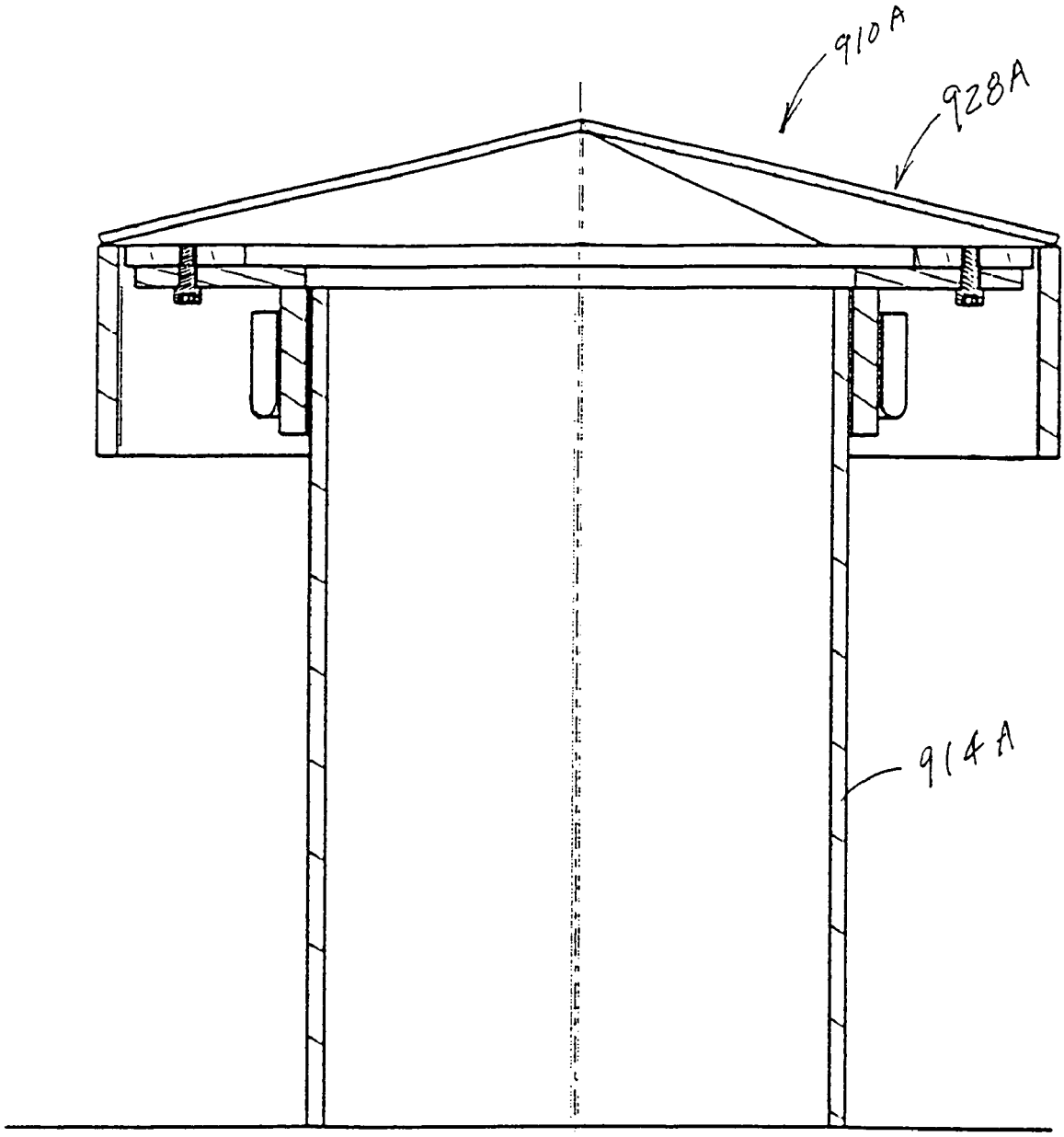
FIG. 65C is second cross-section of the lighted post of FIG. 65A.
Figure 68:
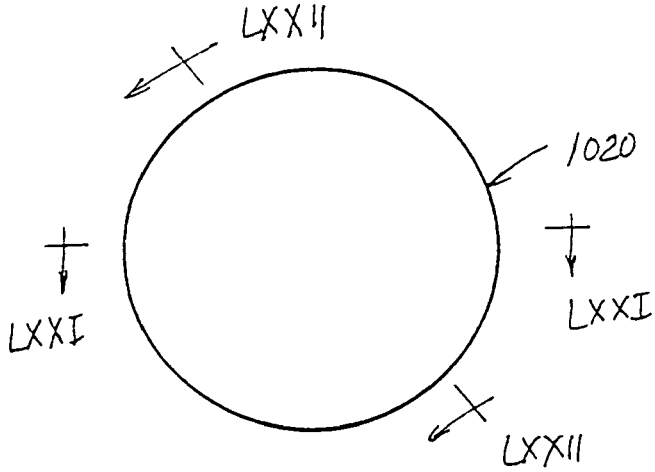
FIG. 68 is a top plan view of the lighted post of FIG. 67.
Figure 67:
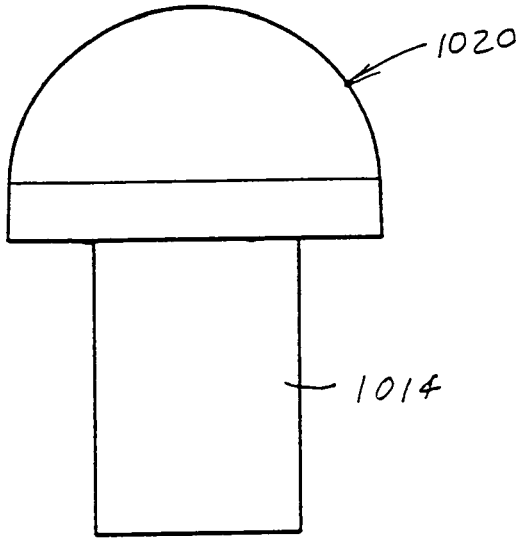
FIG. 67 is a front elevation view of the side post of FIG. 66.
Figure 69:
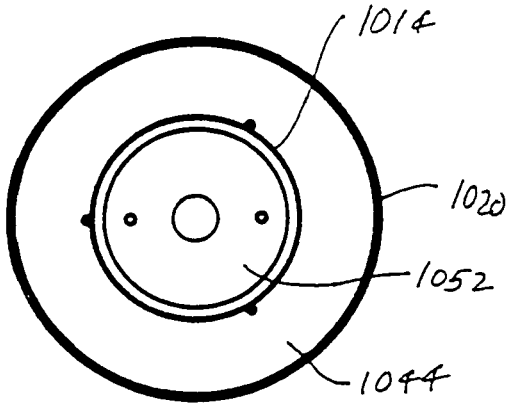
FIG. 69 is a bottom plan view of the lighted post of FIG. 67.
Figure 70:
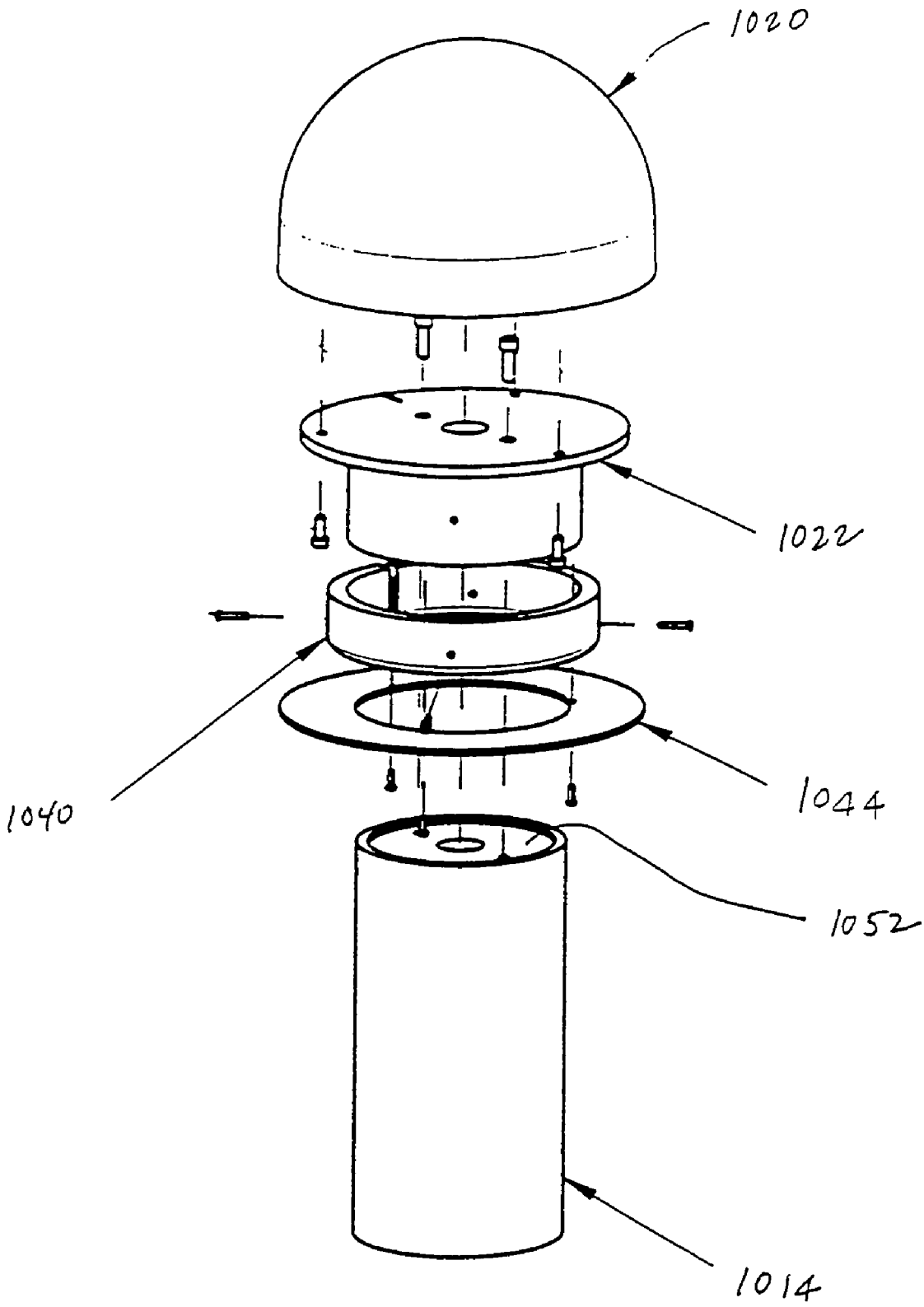
FIG. 70 is an exploded perspective view of the lighted post of FIG. 67.
Figure 71:
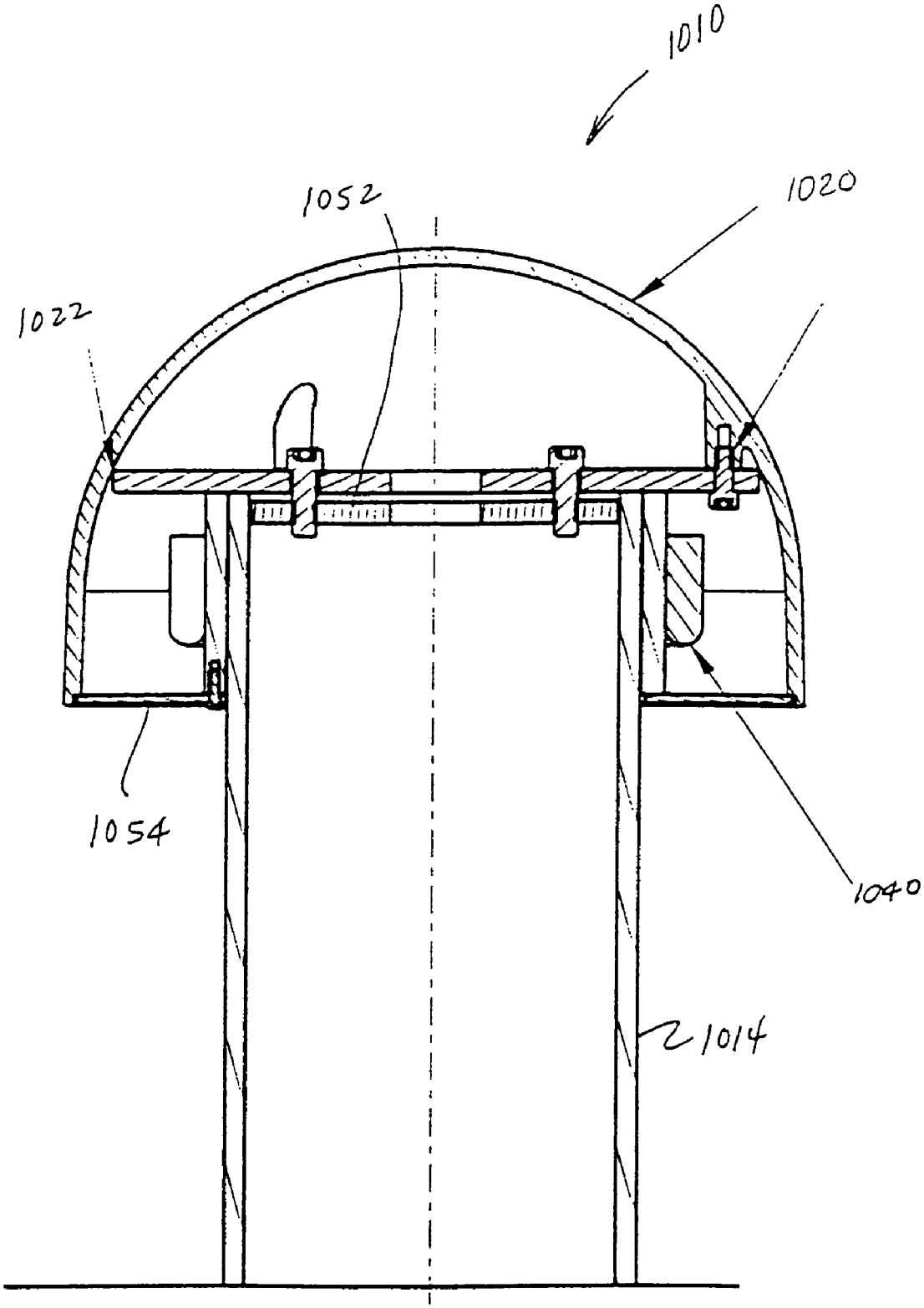
FIG. 71 is a cross-section taken along line LXXI-LXXI of FIG. 68.

Referring to FIGS. 65A-65C, lighted post 910A, which is of similar construction to lighted post 910, may be configured without a light transmitting member (i.e. without member 944) and, further, without a mounting member (i.e. member 952) in support 914A.

In the illustrated embodiment, top 928A is formed from two top sections 928*a*, 928*b* that are joined, for example, by adhesive bonding or welding at a seam 928*c*. In this application, the fasteners securing the light assembly to the bracket are used to secure the cover assembly to the support. For further details of lighted post 910A, reference is made to lighted post 910.

As noted previously, the shape of the support may be varied. For example, referring to FIGS. 66-68 and 69-71, lighted post 1010 is illustrated that incorporates a round support 1014 and a domed-shaped or semispherical-shaped cover 1020. In the illustrated embodiment, therefore, bracket 1022, mounting member 1052, and cover plate 1054 comprise annular members. In addition, light assembly 1040 has an annular configuration so that it extends around and mounts to the perimeter flange 1032 of bracket 1022 to form an annular light pattern.

Bracket 1022 is interconnected with cover 1020 by fasteners that engage a flange or stand-offs formed therein or mounted thereto, similar to the previous embodiment. Similarly, bracket 1022 is secured to member 1052 to thereby secure the cover to the support. For further details of how lighted post 1010 is assembled, reference is made herein to the previous embodiment.

Figure 72:
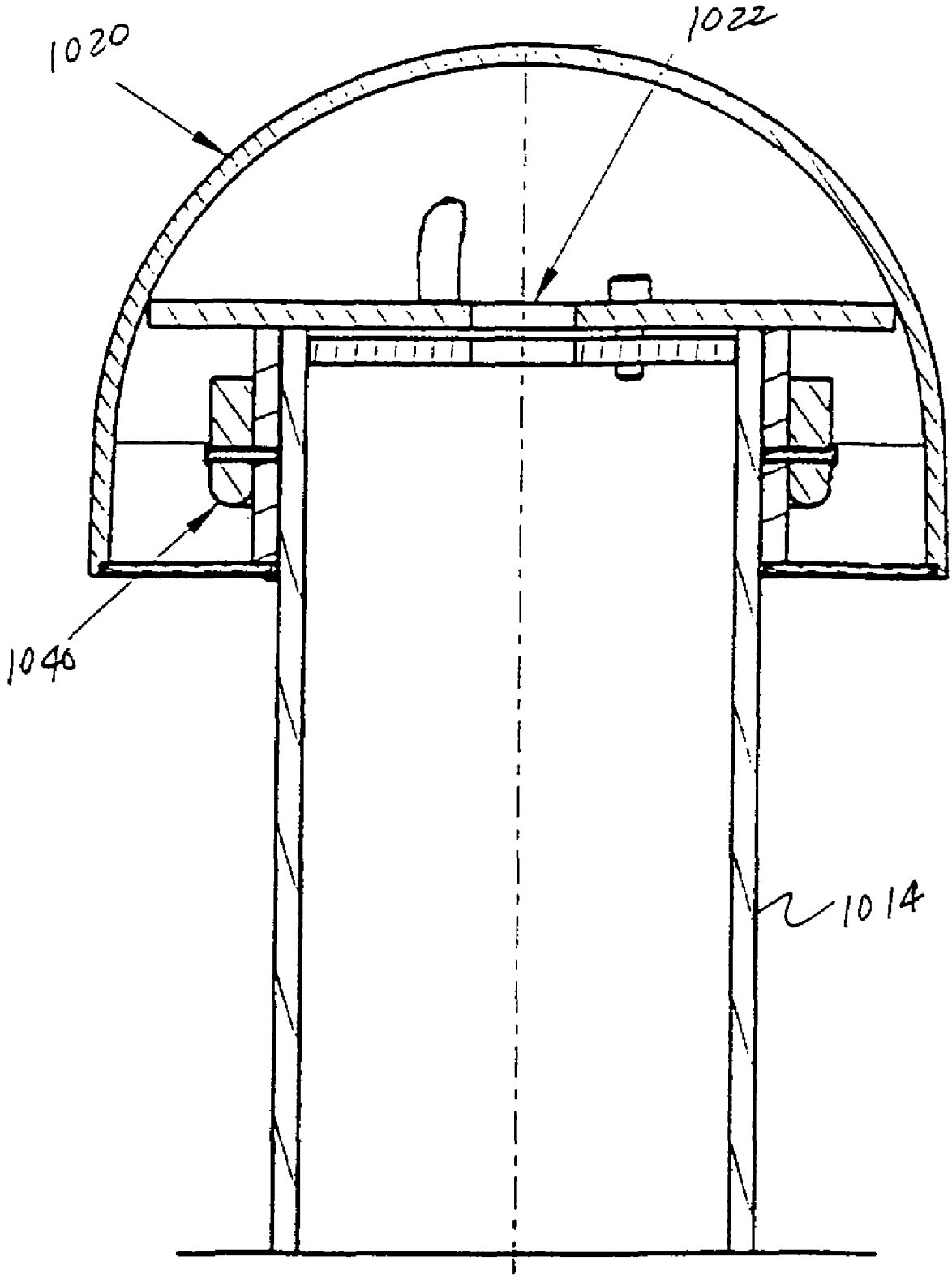
FIG. 72 is a cross-section taken along line LXXII-LXXII of FIG. 68.
Figure 72A:
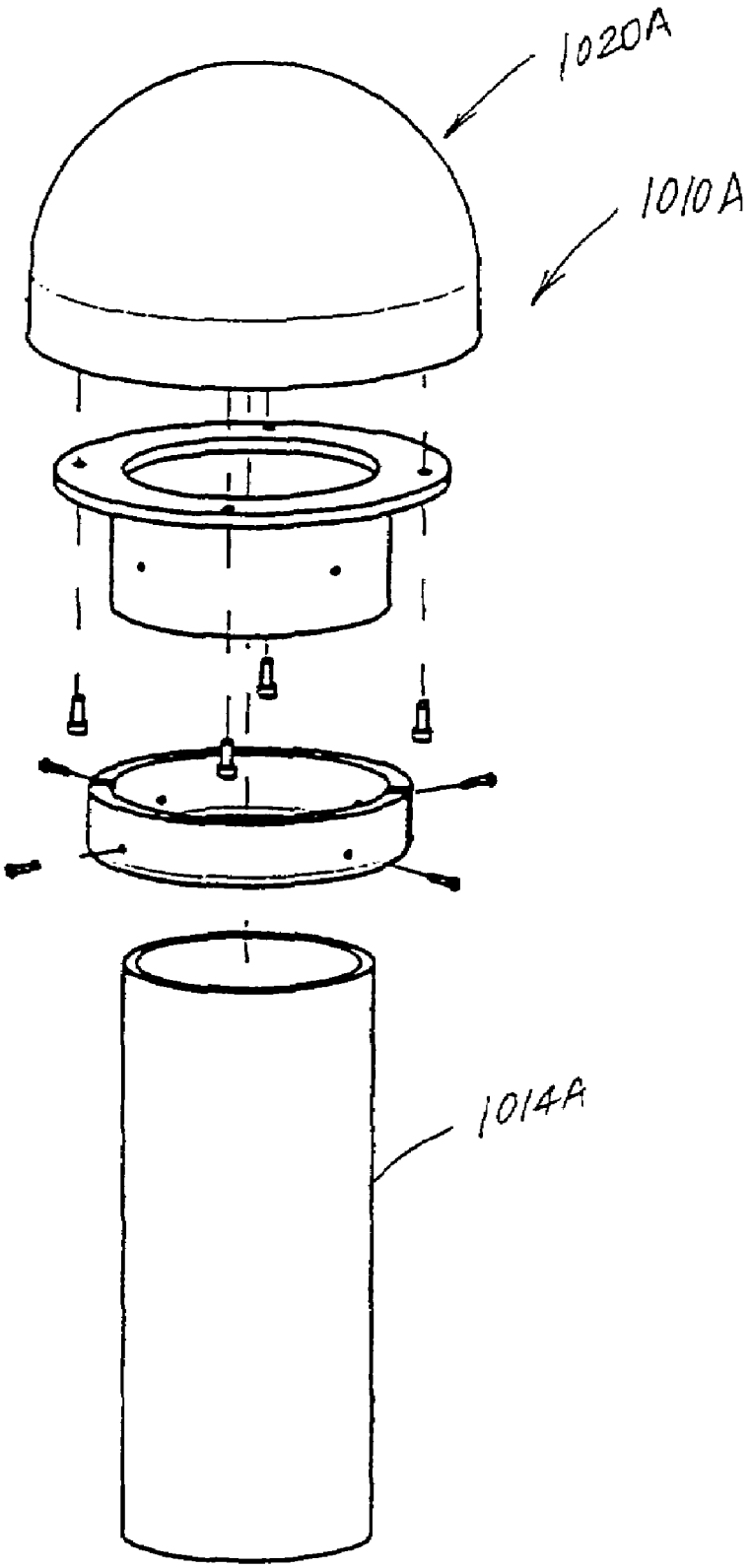
FIG. 72A is an exploded perspective view of another embodiment of the lighted post of the present invention.
Figure 72B:
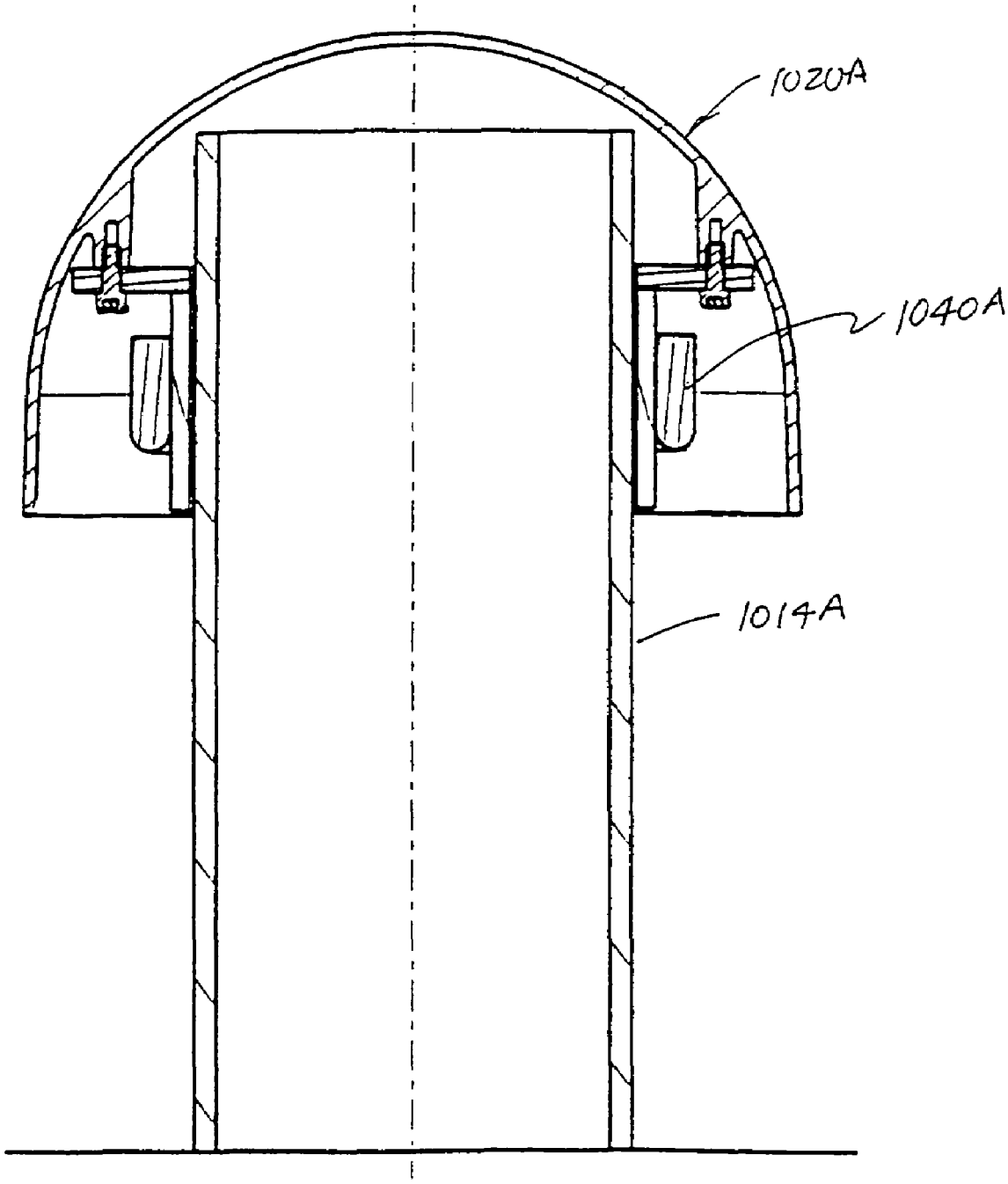
FIG. 72B is cross-section of the lighted post of FIG. 72A.
Figure 72C:
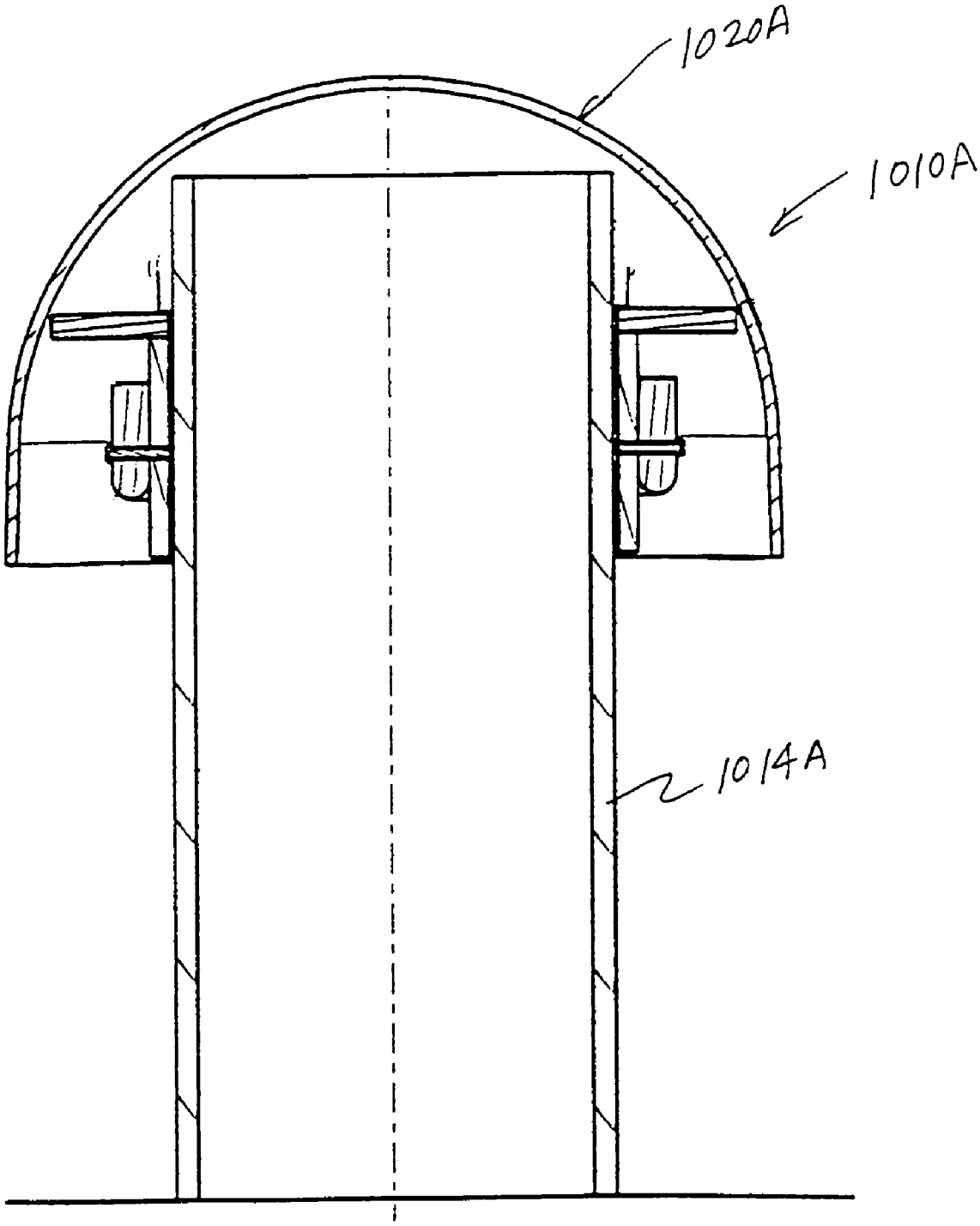
FIG. 72C is second cross-section of the lighted post of FIG. 72A.

Referring to FIGS. 72A-72C, the numeral 1010A designates another embodiment of the lighted post. Lighted post 1010A is of similar construction to lighted post 1010 and may be configured without a light transmitting member (i.e. without member 944) and, further, without a mounting member (i.e. member 952) in support 1014A. Similar to light post 910A, the cover assembly is secured to the support by the fasteners that secure the light assembly to the bracket. For further details of lighted post 1010A, reference is made to lighted post 1010.

Referring to FIGS. 73-80, the numeral 1110 generally designates another embodiment of the lighted post of the present invention. Lighted post 1110 includes a support 1114, which is mounted to or in the ground G (FIG. 80) or mounted to a support base, as described in reference to the previous embodiments. Similar to support 914, support 1114 comprises a square tubular member that is formed from a strong rigid material, such as metal, including aluminum, stainless steel, or iron. Alternately, support 1114 may be formed from a plastic material, such as reinforced plastic, wood, or a composite material.

Mounted to upper open end 1116 of support 1114 is a cover assembly 1120, which houses a plurality of light assemblies 1140 and includes a cover 1145, such as a lens cover, to enclose and preferably substantially seal light assemblies 1140 in cover assembly 1120 and, hence, in post 1110.

In the illustrated embodiment, cover assembly 1120 includes a cover 1121 that is generally rectangular in shape and includes downwardly depending flanges 1121*a*, 1121*b*, 1121*c*, and 1121*d* that depend from an upper rectangular member 1121*e*. Cover 1121 is mounted over the open upper end 1116 of support 1114 and cantilevered therefrom with flange 1121*c* secured to the side wall 1114*a* of support 1114 by a fastener 1122, which extends through flange 1121*c* and into side wall 1114*a*. Similarly, flanges 1121*a* and 1121*b* are secured to the side wall of support 1114 by fasteners 1122 to thereby secure cover 1121 to support 1114.

Positioned in the overhang formed by cover 1121 are light assemblies 1140 which extend between flange 1121*d* and the side wall 1114*d* of support 1114 and, further, as previously noted, are enclosed therein by cover 1145. Cover 1145 extends between the opposed flanges 1121*a* and 1121*b* and between flange 1121*d* and side wall 1114*a* of support 1114. Lens cover 1145 may be adhesively bonded or sealed to the respective flanges of cover 1121 and side wall 1114*a* of support 1114 or may be mechanically secured thereto, for example, by clips, fasteners, or the like. Further, cover 1145 may incorporate clips or mounting structures therein for securing the lens cover to the support and/or respective flanges of cover 1121.

Figures 73, 74, 75, 76, 77:
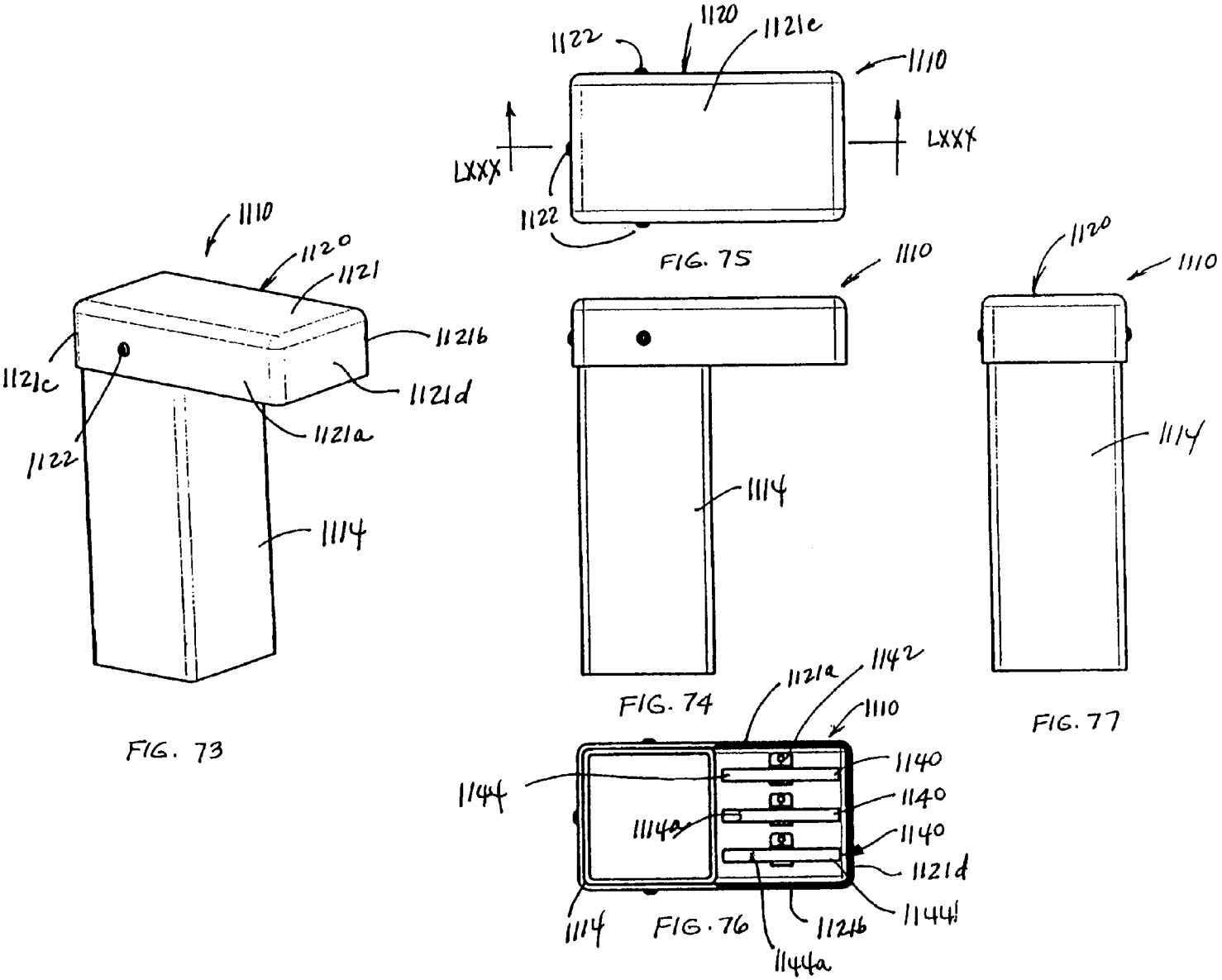
FIG. 73 is a perspective view of another embodiment of the lighted post of the present invention.
FIG. 74 is front elevation view of the lighted post of FIG. 73.
FIG. 75 is a top plan view of the lighted post of FIG. 74.
FIG. 76 is a bottom plan view of the light post of FIG. 74.
FIG. 77 is a side view of the lighted post of FIG. 74.
Figure 80:
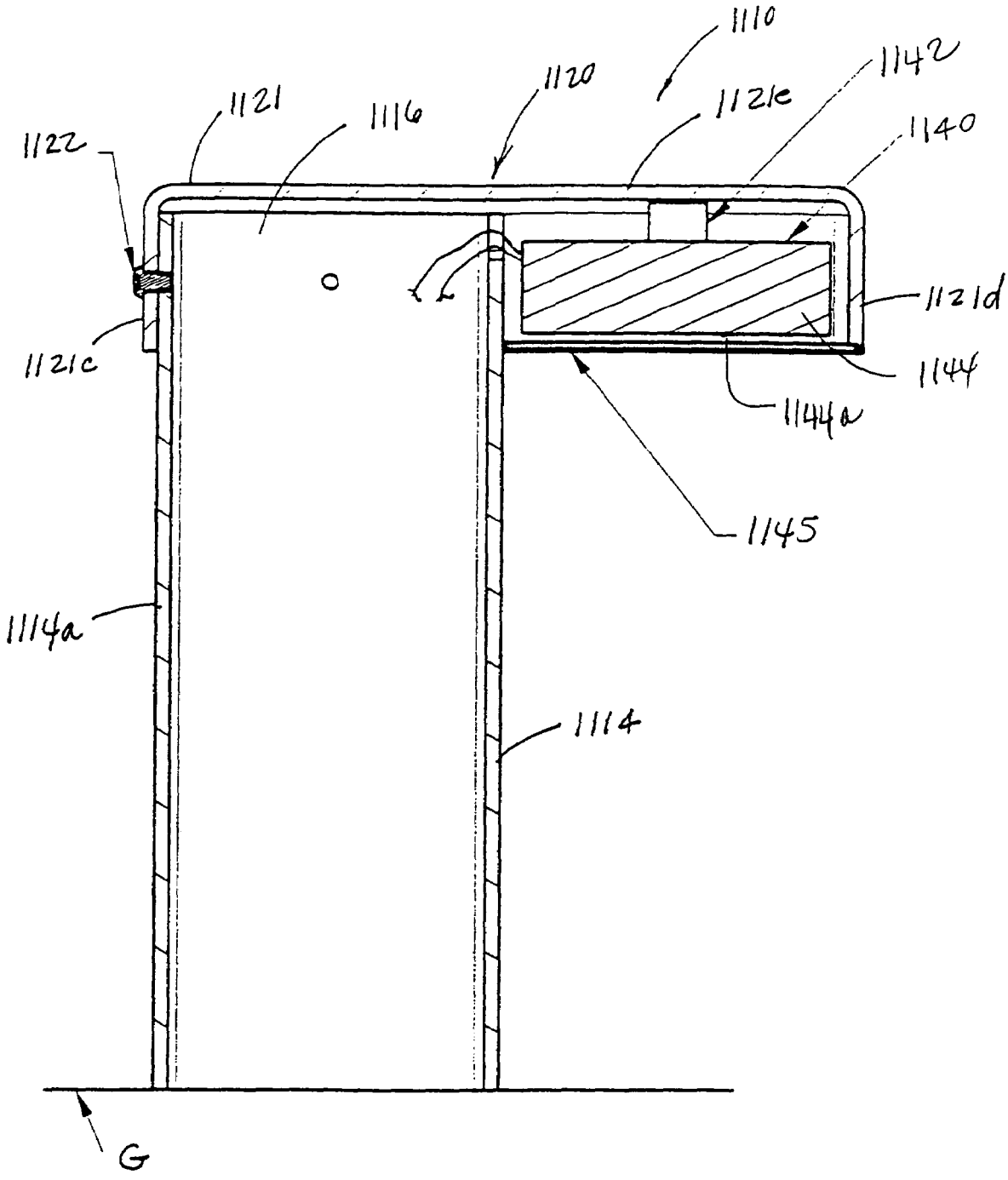
FIG. 80 is a cross-section taken along line LXXX-LXXX of FIG. 75.

As best seen in FIGS. 76 and 80, light assemblies 1140 are secured to the lower surface of rectangular member 1121*e* of cover 1121 by brackets 1142, which are secured to the cover 1121.

In the illustrated embodiment and as best seen in FIG. 76, light assemblies 1140 comprise elongate bodies 1144, which are arranged in a generally parallel arrangement with the respective flanges 1121*a* and 1121*b* of the cover 1121. Further, in the illustrated embodiment, lighted post 1110 incorporates three light assemblies. Light assemblies 1140 are of similar construction to the light assemblies described in reference to the previous embodiment and include an elongate body 1144, which acts as a wave guide, and a plurality of light sources, preferably high intensity LEDs, which are optically coupled to body 1144 so that when powered, emit light into body 1144, which in turn diffuses the light from the respective light assemblies and emits a light from their respective light emitting surfaces 1144*a* (FIG. 80), as previously noted.

As noted in reference to the previous embodiments, cover 1120 may be permanently fixed to support 1114, for example by welding or adhesive attachment or the like given the expected life expectancy of the light assemblies. Similarly, lens cover 1145 may be fixedly attached, as previously noted by welding or adhesive attachment or the like.

Figure 79:
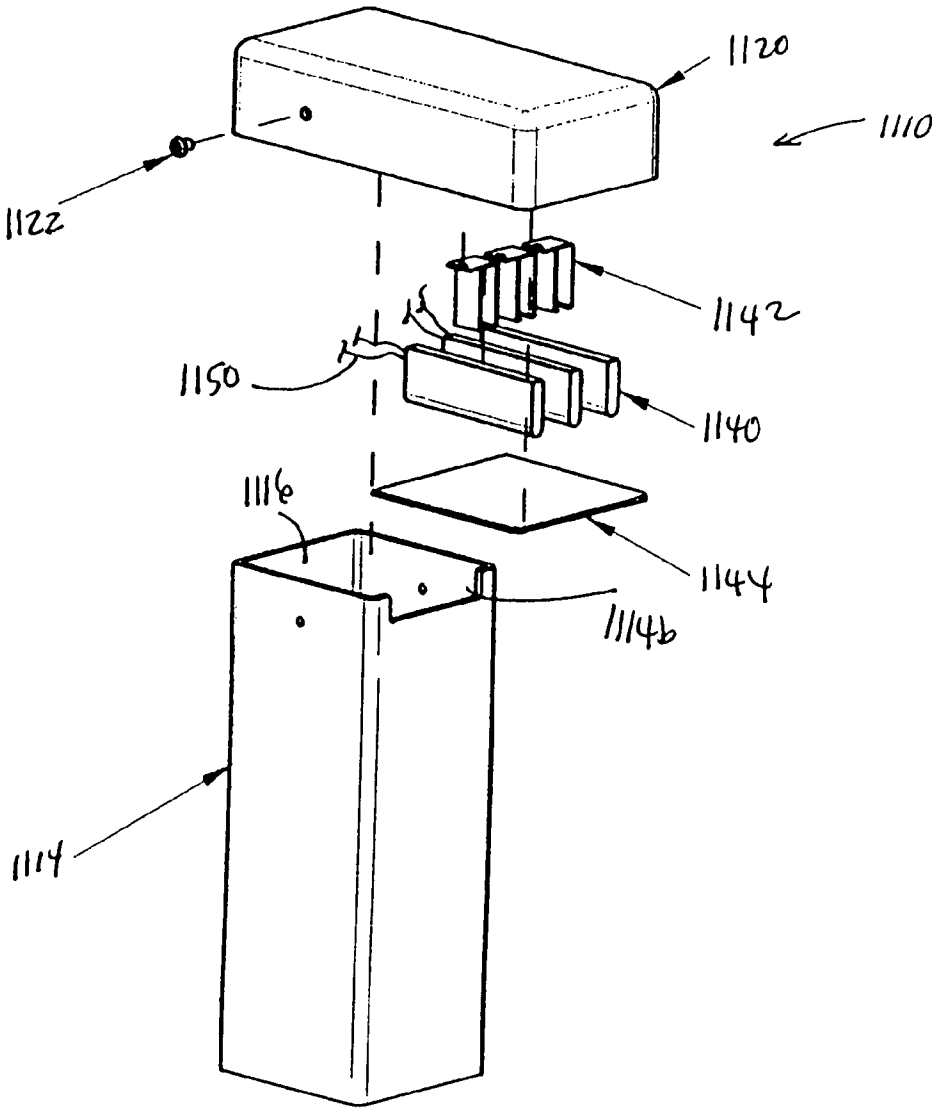
FIG. 79 is an exploded perspective view of the lighted post of FIG. 73.
Figure 78:
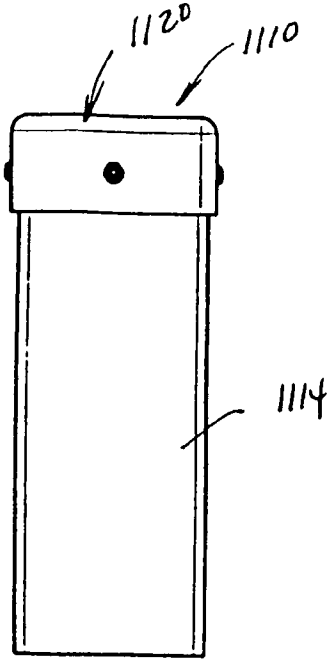
FIG. 78 is a left side elevation view of the lighted post of FIG. 74.

As best seen in FIG. 79, support 1114 includes a cut-out 1114*b* formed adjacent its upper open end 1116 to form a passageway through which the wiring 1150 of the respective light assemblies may extend into support 1114 for coupling to a driver or transformer or control circuitry, as noted in reference to the previous embodiments.

Referring to FIGS. 81-84, 87, and 88, the numeral 1210 generally designates yet another embodiment of the lighted post of the present invention. As would be understood by those skilled in the art, lighted post 1210 is particularly suitable for use as a lighted bollard and includes a base 1212 and a tubular member 1214 that is mounted to base 1212 to form a stanchion. Though illustrated with a circular tubular member, it should be understood from the previous and further embodiments described herein that the shape and size of the tubular member may be varied. For example, the tubular member may comprise a multi-sided tubular member, such as a rectangular, triangular, or hexagonal tubular member. Similar to the previous embodiments, base 1212 is adapted to anchor tubular member 1214 to a fixed and rigid support surface, such as a concrete or asphalt pad, a deck, the ground, or to a mat. Therefore, as would be understood, base 1212 may include a plurality of mounting openings 1212*a* for receiving anchor bolts or the like to secure base 1212 to the rigid support surface. However, it should be understood that tubular member 1214 may be anchored using other methods. For examples of the other methods of mounting tubular member 1214, reference is made to the first embodiment.

As in the case of the previous embodiments, base 1212 and tubular member 1214 are made from a rigid strong material, such as metal; however, it can be appreciated that the components may be formed from other strong materials, such as plastic, including reinforced plastic, or wood, or composite material. Further, as in the case of all the embodiments, the various components may be assembled using welds, fasteners, or an adhesive.

Figure 88:
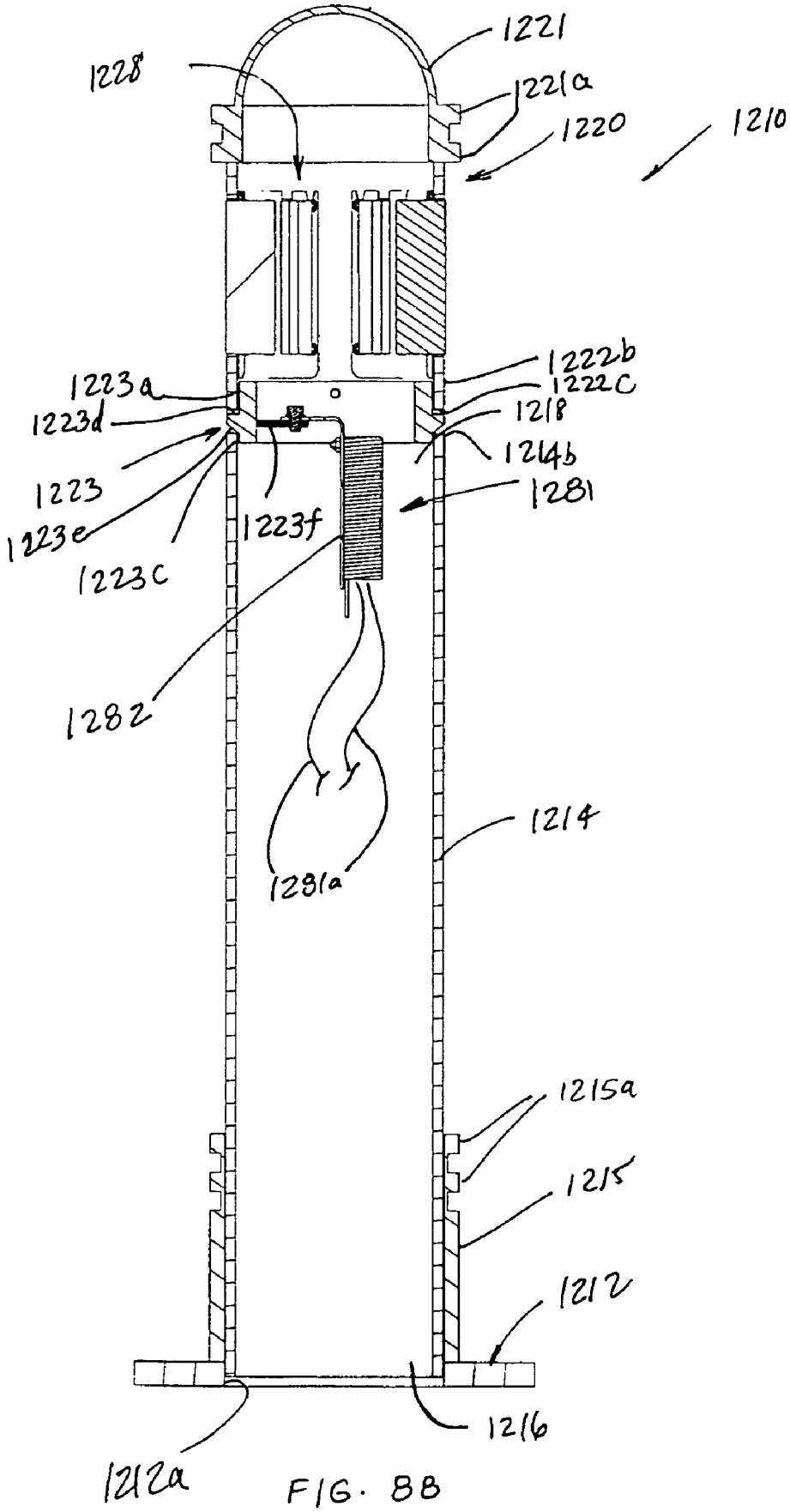
FIG. 88 is a cross-section taken along line LXXXVIII-LXXXVIII of FIG. 85.

Referring to FIG. 88, tubular member 1214 includes an open lower end 1216 and an open upper end 1218, which is closed and substantially sealed by cover 1220. Lower end 1216 is inserted into an opening in base 1212, which provides access to the inside of tubular member 1214 for routing wiring or cables or the like, but is essentially closed to the surrounding air when base 1212 is mounted to the ground or other fixed support surface.

Figure 87:
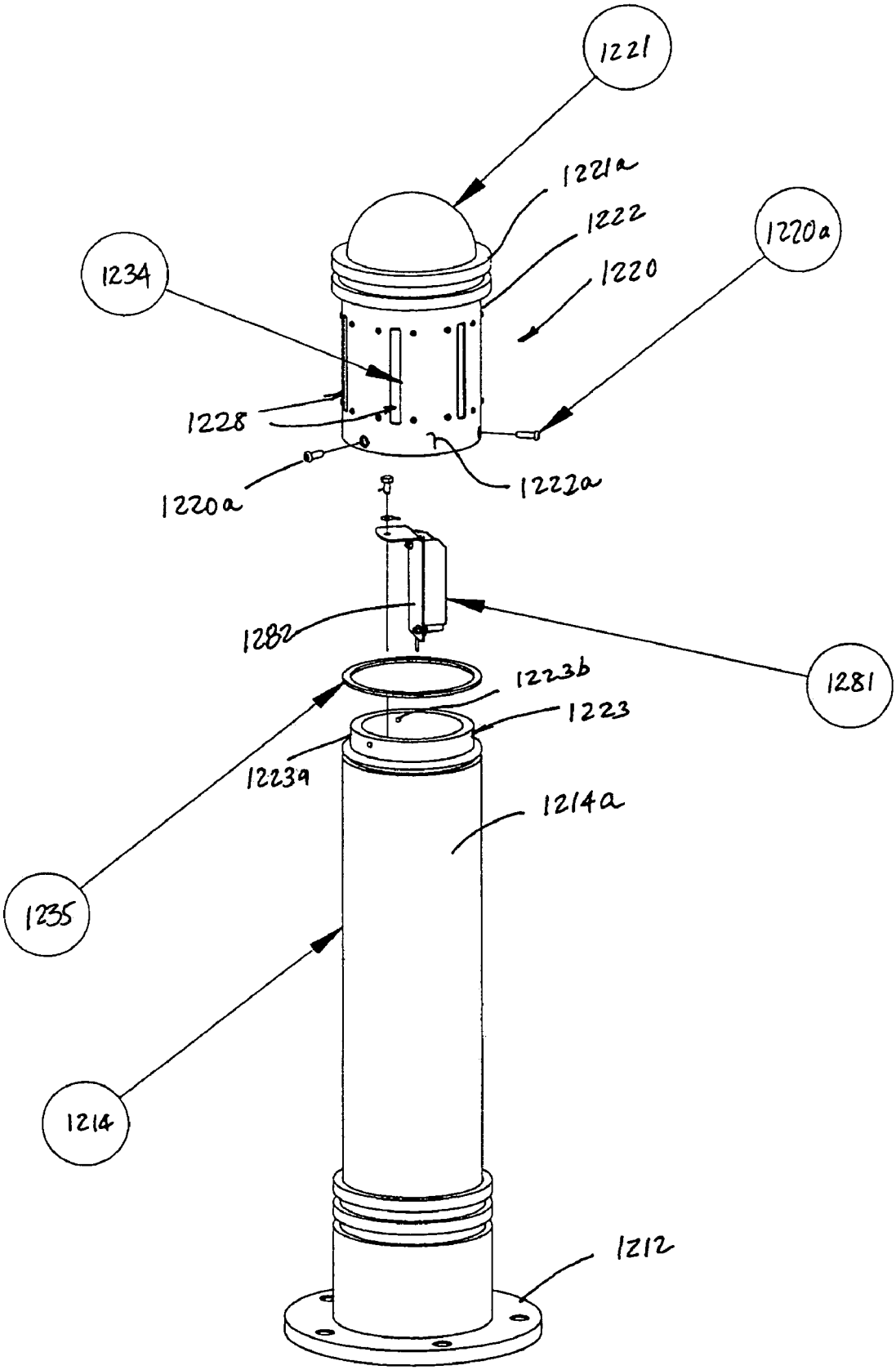
FIG. 87 is an exploded perspective view of the lighted post of FIG. 81.

Referring to FIG. 89, cover 1220 includes a top member 1221 and a cylindrical wall 1222, which extends downwardly from member 1221 for mounting cover 1220 to tubular member 1214. In the illustrated embodiment, top member 1221 comprises a dome-shaped member with a pair of annually spaced ribs 1221*a* with cylindrical wall 1222 that is joined with member 1221 below annular ribs 1221*a*. For example, cylindrical wall 1222 may be welded or adhered or otherwise secured to member 1221. In addition, cover 1220 is configured and arranged so that the outer surface 1222*a* of cylindrical member 1222 is substantially coplanar with the outer surface 1214*a* of tubular member 1214 when cover 1220 is mounted to tubular member 1214. As best seen in FIG. 87, cover 1220 is mounted to tubular member 1214 by plurality of fasteners 1220*a*.

In the illustrated embodiment, cover assembly 1220 is secured to member 1214 by a coupler 1223, which comprises an annular member with an upwardly extending flange 1223*a* with a plurality of mounting openings 1223*b* for engagement by fasteners 1220*a* of cover assembly 1220. In addition, coupler 1223 includes a downwardly extending flange 1223c that extends into open upper end 1218 of tubular member 1214. Coupler 1223 may be secured in place in tube 1214 by an adhesive, welds, fasteners, or the like.

As best seen in FIG. 88, cover assembly 1220 houses one or more light assemblies 1228. Cylindrical member 1222 includes a wall 1222*b* with one or more light transmitting openings 1234. In the illustrated embodiment, openings 1234 are vertically arranged and spaced around the circumference of cylindrical member 1222. Further, in the illustrated embodiment, the longitudinal axes of openings 1234 are generally parallel and uniformly spaced around cylindrical member 1222, and also have substantially equal lengths and widths. However, it should be understood that their arrangement, size, and shape may be varied as desired. Mounted at or adjacent each opening is a light assembly 1228. Light assemblies 1228 are secured to wall 1222*b* of cylindrical member 1222 by fasteners 1228*a*, which locate and secure each respective light assembly such that its light emitting surface 1248 is aligned in a respective opening 1234 and, further, such that its body 1244 substantially fills the respective opening as described in reference to the previous embodiments.

As best understood from FIG. 89, bodies 1244 of light assemblies 1228 are mounted in openings 1234 by brackets 1250, which include slotted mounting openings 1250*a* for receiving fasteners 1228*a* and, further, include an elongate slotted opening 1250*b* for receiving the body (1244) of a respective light assembly in a similar manner described in reference to the previous embodiment. Thus, when mounted, light emitting surfaces 1248 of the respective light assemblies are either extended from, flush, or recessed within openings 1234 but preferably positioned, as noted, such that the bodies 1244 of the respective light assemblies substantially fill and as such close the openings to thereby seal the openings and prevent or substantially limit bug or dirt intrusion into the lighted post.

Referring again to FIG. 88, when cover 1220 is mounted on coupler 1223, lower edge 1222*c* of cylindrical member 1222 rests on a shoulder 1223*d* of coupler 1223. Optionally and preferably, positioned between the lower edge 1222*c* and shoulder 1223*d* is an annular seal or a gasket 1235, which helps seal tubular member 1214 to limit or reduce bug or dirt intrusion into lighted post assembly 1210. As best seen in FIGS. 81 and 88, coupler 1223 includes a tapered surface

1223*e* between its outer most perimeter and flange 1223*c*, which forms a space between the upper edge 1214*b* of tubular member 1214. This space forms an annular groove around lighted post 1210, which is provided for decorative reasons and, therefore, may be eliminated if desired.

Similar to the previous embodiments, lighted post 1210 optionally include a transformer 1281 for reducing a supply voltage to a voltage that is suitable for driving the light sources in light assemblies 1228. As described in reference to the previous embodiments, the light sources of light assemblies 1228 may optionally comprise light emitting diodes, including high intensity light emitting diodes, which require less voltage than conventional incandescent lights. Transformer 1281 may be mounted in a housing and, further, may be mounted in tubular member 1214, for example, by a bracket 1282. Bracket 1282 may be mounted in numerous locations in 1214, but in the illustrated embodiment is mounted to coupler 1223 by a tab 1223*f* (FIG. 88). For example a suitable transformer may include a 20 watt MAGTEC transformer. As would be understood, transformer 1281 includes electrical leads 1281*a* for coupling to a power supply, typically an external power supply. As can be appreciated, the wiring for the light assembly or light assemblies and/or transformer 1281 located in lighted post 1210 may be directed through open lower end 1216 of tubular member 1214 and through opening 1212*a* of base 1212.

Referring again to FIG. 88, tubular member 1214 is mounted to base 1212 and includes a collar 1215 at base 1212. Collar 1215 optionally includes a pair of ribs 1215*a* that may be commensurate in size and spacing with ribs 1221*a* of top member 1221.

Referring to FIGS. 90-92, 95, and 96, the numeral 1310 generally designates yet another embodiment of the lighted post of the present invention. Lighted post 1310 is of similar construction to lighted post 1210 and includes a base 1312 and a tubular member 1314, which is mounted to base 1312, and a cover 1320. In the illustrated embodiment, tubular member 1314 is mounted to base 1312 by a coupler 1315*a* and a collar 1315*b*, which mimic the design of the cover to create a balanced design, described more fully below.

Referring to FIG. 96, coupler 1315*a* comprises an annular body with a pair of annular flanges 1315*c* and 1315*d*, which are spaced apart to form a recessed portion 1315*e*. The lower end 1314*a* of tubular member 1314 is mounted to flange 1315*c*, while collar 1315*b*, which has a similar diameter to tubular member 1314 is mounted to flange 1315*d*. Therefore, collar 1315*b*, which has a similar configuration to tubular member 1314 appears to be an extension of tubular member 1314 with a radial groove formed by recess 1315*e*.

Referring to FIG. 97, cover 1320 includes a top member 1321 and a cylindrical wall 1322, which extends downwardly from member 1321. In the illustrated embodiment, member 1321 comprises a generally rounded body with a flat upper surface 1321*a* and a flat annular wall 1321*b* which is mounted to a second coupler 1317*a*, which is of similar construction to coupler 1315*a* and, further, connects cover 1321 to cylindrical wall 1322. Cylindrical wall 1322 is secured to tubular member 1314 using a coupler 1323 similar to the previous embodiment. Therefore, for further details of coupler 1323, reference is made to the previous embodiment.

Referring again to FIG. 97, cover 1320 is also adapted to house one or more light assemblies 1328. Similarly, cylindrical wall 1322 includes a plurality of light transmitting openings 1334 for receiving light assemblies 1328, which are secured to cylindrical member 1322 by fasteners 1328. For further details of light assemblies 1328, reference is made to the previous embodiment.

As best seen in FIG. 96, light assemblies 1328 are powered through a transformer 1381, which is also located in tubular member 1314 and mounted to coupler 1323 by a bracket 1382. Bracket 1382 is fastened to an inwardly projecting flange or tab 1383 (FIG. 95) provided in coupler 1323. As will be understood by those skilled in the art, the transformer includes lead wires 1381*a* that extend through tubular member 1314 and, further, through coupler 1315*a* and collar 1315*b* and base 1312 for coupling to a conventional external power supply.

Referring to FIGS. 98-100, 103, and 104, the numeral 1510 generally designates yet another embodiment of the lighted post of the present invention. Lighted post 1510 is of similar construction to the previous two embodiments and includes a base 1512, a tubular member 1514, and a cover 1520.

Referring to FIG. 103, cover 1520 is of similar construction to covers 1320 and 1420 and includes a top member 1521 and a cylindrical member 1522. In addition, member 1521 is mounted to cylindrical member 1522 by a coupler 1517*a*, which is of similar construction to coupler 1515*a* (FIG. 104), which connects tubular member 1514 to a collar 1515*b* and in turn to base 1512, similar to the previous embodiment. In the illustrated embodiment, member 1521 comprises a spherical body that is mounted to a plate 1521*a*, which in turn is mounted to an annular cylindrical wall 1521*b*, which is mounted to coupler 1517*a* to secure member 1521 to cylindrical member 1522. Cylindrical member 1522 is similarly mounted to the open upper end of tubular member 1514 by a coupler 1523. For further details of light assemblies 1528, transformer 1581, and coupler 1523, reference is made to the previous embodiment.

Referring to FIGS. 105-107, 110, and 111, the numeral 1610 generally designates another embodiment of the lighted post of the present invention. Lighted post 1610 is of similar construction to the previous embodiments and includes a base 1612, a tubular member 1614, and a cover 1620. Tubular member 1614 is mounted to base 1612 in a similar manner to the two previous embodiments. Therefore, for further details of coupler 1615*a* and collar 1615*b*, reference is made to the previous embodiment. Further, cover assembly 1620 includes a top member 1621 and a cylindrical member 1622, with member 1621 being formed by a circular plate 1621*a* and an annular cylindrical wall 1621*b*, which are mounted to cylindrical member 1622 by a coupler 1617*a* similar to coupler 1517*a*. Cover 1620 is mounted to the open upper end of tubular member 1614 by a coupler 1623, also similar to the previous embodiments. Again, light assemblies 1628 are mounted in light transmitting openings 1634 formed in cylindrical wall 1622*a* of cylindrical member 1622 and, further, are secured therein by fasteners 1628*a* (FIG. 112). For further details of the construction and arrangement of light assembly 1610, reference is made to the previous embodiments.

Referring to FIGS. 113-115, 118, and 119, the numeral 1710 generally designates yet another embodiment of the lighted post of the present invention. Similarly, the numeral 1810 refers to another embodiment of the lighted post of the present invention illustrated in FIGS. 120-125, which has a generally similar appearance to lighted post 1710 but with a modified construction.

As best seen in FIG. 118, lighted post 1710 includes a base 1712 and tubular member 1714, which is mounted to base 1712 in a collar 1715. In the illustrated embodiment, tubular member 1714 comprises a square member, similar to collar 1715 and base 1712. Cover 1720 includes a top member 1721 and a downwardly depending square tubular member 1722. Tubular member 1722 includes a plurality of elongate horizontally oriented openings 1734 formed in its wall 1722*a* for receiving light assemblies 1728. As would be understood, therefore, light assemblies 1728 are oriented in a generally horizontal arrangement and mounted in openings 1734 by fasteners 1728*a* in a similar manner as described in reference to the previous embodiments. Further, as shown, the number of openings and light assemblies in each side of member 1722 may vary.

Referring to FIG. 119, member 1721 includes a generally pyramid-shaped portion 1721*a* with a downwardly square collar or tubular member 1721*b* which is arranged to mount over wall 1722*a* of tubular member 1722. Tubular member 1722 is mounted to tubular member 1714 such that its outer surfaces 1722*b* are generally coplanar with outer surfaces 1714*a* of tubular member 1714 similar to the previous embodiments. Further, tubular wall 1722 is mounted onto tubular member 1714 by a coupler 1723, which is mounted to the inner surface of tubular member 1714, for example by welding, adhesive bonding, or the like. Tubular member 1722 is mounted to coupler 1723 by fasteners 1723*a* which extend through wall 1722*a* and into the wall 1723*b* of coupler 1723 to thereby releasably mount cover 1720 to tubular member 1714.

Transformer 1781 is similarly located in tubular member 1714 and mounted to coupler 1723 by a bracket 1782 which is fastened to an inwardly extending flange or bracket tab 1723*c* provided on coupler 1723. Again, transformer 1781 is powered by electrical leads 1781*a* that extend through tubular member 1714 and, further, through base 1712 for coupling to an external power supply as previously noted.

In contrast, lighted post 1810 locates its respective light transmitting openings 1834 in tubular member 1814. Further, cover 1820 includes a top member 1821, which includes a pyramid-shaped portion 1821*a* and downwardly depending square collar 1821*b*, which includes mounting openings 1821*c* for receiving fasteners 1821*d* for securing cover 1820 to tubular member 1814. For further details of light assemblies 1828 and how they are mounted in tubular member 1814, reference is made to the previous embodiment.

Referring to FIG. 125, transformer 1881 is mounted in tubular member 1814 by a bracket 1882, which secures to an inwardly projecting tab or flange 1883 provided in tubular member 1814.

It can be appreciated that the lighted post of the present invention uses less power than heretofore known and yet provides sufficient illumination to be used as a bollard, a pathway light or the like. Further, even when operated or powered for a significant length of time, the lighted post will remain cool to the touch, typically a few degrees over room temperature. In addition, the post are substantially sealed against intrusion from outdoor elements, such as bugs, dirt and water, so that they can maintain their aesthetic appearance. Given the low power consumption, the lighted posts of the present invention can be operated at significant savings. Further, the lighted posts with detachable or removable panels provide greater flexibility and can be quickly and easily changed for venue shifts, for example, by changing or adding different light assembly colors or changing the signage.

While several forms of the invention have been shown and described, other forms will now be apparent to those skilled in the art. Further, features of one embodiment may be incorporated into or substituted for features in another embodiment. As noted, the size and shape of the tubular members, covers, and bases may be varied. In addition, though described as being powered by an external power supply, an internal power supply may also be used. For example, a battery or other voltage supply may be contained in the cover assembly or in the tubular member or collar so that the lighted post may be a powered self-contained unit. Further, many of the members or components forming the lighted posts may be integrally formed with each and, likewise, many of the members may be assembled from separate components. For example, cover 1821 is formed as a unitary member, but it should be understood that portions 1821*a* and 1821*b* may be separate components. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or priviledge is claimed are defined as follows:

1. A lighted post comprising:

a stanchion having a stanchion wall, said stanchion wall having a stanchion opening formed therein, said stanchion opening facing laterally outward from said stanchion;

a panel removably mounted at said stanchion wall to close said stanchion opening, and said panel having a panel opening:

a light source;

a light transmitting body being mechanically coupled to said light source and forming with said light source a unitary light assembly, said light transmitting body having a curved light emitting surface, said unitary light assembly being adapted for coupling to a power source for powering said light source, when said light source is powered light from said light source being directed into said light transmitting body and being directed from said light transmitting body through said light emitting surface; and said light transmitting body including a groove, a bracket extending into said groove and mounting said light transmitting body to said panel in said panel opening, thereby mounting said unitary light assembly to said panel and filling said panel opening to close said panel opening, said light source being adjacent said light transmitting body wherein said light source is aligned with said panel opening, and said light emitting surface facing outwardly from said stanchion to thereby direct light outwardly from said stanchion.

2. The lighted post according to claim 1, wherein said stanchion comprises a tubular member.

3. The lighted post according to claim 2, wherein said stanchion further comprises a cover, said tubular member having an upper open end, said cover closing said upper open end.

4. The lighted post according to claim 1, wherein said light source comprises a plurality of light emitting diodes.

5. The lighted post according to claim 1, wherein said light transmitting body comprises an elongated body.

6. The lighted post according to claim 1, wherein said light transmitting body comprises a waveguide.

7. The lighted post according to claim 1, wherein said panel substantially closes said stanchion opening wherein said stanchion is substantially free of unclosed openings.

8. The lighted post according to claim 1, wherein said light emitting surface is recessed in said panel opening.

9. The lighted post according to claim 1, wherein said light emitting surface projects outwardly from said panel opening.

10. The lighted post according to claim 1, wherein said panel includes a plurality of said light transmitting openings and a plurality of said light assemblies, said light assemblies each having a light source and a respective light transmitting body, each of said light transmitting bodies being mounted in a respective light transmitting opening to thereby mount the light assemblies in the stanchion, and each of said respective light transmitting bodies filling said respective light transmitting openings.

11. A lighted post comprising:

a tubular member having an upper open end, a lower open end, a wall, and a chamber defined by said wall, said tubular member adapted to mount to a support surface wherein said lower open end is closed by the support surface when the tubular member is mounted to the support surface;

a cover mounted over and closing said upper open end;

a plurality of light assemblies, said light assemblies each having a light source and a respective light transmitting body having a curved light emitting surface and being mechanically coupled to a respective light source wherein each of said light assemblies comprises a unitary light assembly, said light assemblies being adapted for coupling to a power source for powering said light sources, when said light sources are powered, light from said light sources being directed into said respective light transmitting bodies and being directed from said respective light transmitting bodies through said light emitting surfaces; and a plurality of light transmitting openings provided in said wall of said tubular member, each of said light transmitting bodies including a groove, a bracket for each of said light assemblies extending into said respective groove and mounting said respective lighting transmitting body in a respective light transmitting opening to thereby mount said light assemblies in said tubular member, wherein said respective light transmitting bodies fill said respective light transmitting openings to thereby substantially seal said light transmitting openings, and said light emitting surfaces facing outwardly from said lighted post to thereby direct light outwardly from said lighted post and wherein said light sources are substantially sealed in said lighted post by said respective light transmitting bodies.

12. The lighted post according to claim 11, wherein said tubular member comprises a metal tubular member.

13. The lighted post according to claim 11, wherein said tubular member comprises a rectangular or round tubular member.

14. The lighted post according to claim 11, further comprising a base, said tubular member mounted to said base, and said base adapted for mounting to the support surface.

15. The lighted post according to claim 11, wherein each of said respective light transmitting bodies comprises a longitudinal waveguide having a length, each of said waveguides scattering light emitted by a respective light source along said length and allowing light to exit said waveguides through said light emitting surfaces, wherein each of said longitudinal waveguides has a curved outer surface, said curved outer surfaces forming said light emitting surfaces for fanning the light from said light sources outwardly.

16. The lighted post according to claim 11 further comprising a coupler having a downwardly extending flange and an upwardly extending flange, said downwardly extending flange being releasably mounted at said tubular member and said upwardly extending flange being releasably mounted at said cover, wherein said coupler couples said cover and said tubular member, wherein said cover is removable from said tubular member via said coupler, whereby said cover is easily replaceable.

17. The lighted post according to claim 15, wherein each of said light sources comprises a plurality of said light emitting diode.

18. The lighted post according to claim 15 wherein each of said brackets comprises a plate with a plurality of slots extending into said plate from an edge of said plate, said slots forming a plurality of spaced lateral edges, said resepctive light transmitting bodies of said light assemblies received in said slots, and said grooves of said respective light transmitting bodies engaged by said lateral edges.

19. A lighted post comprising:

a tubular member having an upper open end and a lower open end, said tubular member adapted to mount to a support surface wherein said lower open end is closed by the support surface when the tubular member is mounted to the support surface;

a cover mounted over and closing said upper open end;

a plurality of light assemblies, said light assemblies each having a light source and a respective light transmitting body having a curved light emitting surface and being mechanically coupled to a respective light source wherein each of said light assemblies comprises a unitary light assembly, said light assemblies being adapted for coupling to a power source for powering said light sources, when said light sources are powered, light from said light sources being directed into said respective light transmitting bodies and being directed from said respective light transmitting bodies through said light emitting surfaces; and a plurality of light transmitting openings provided in said cover, each of said light transmitting bodies including a groove, a bracket extending into said groove and mounting said light transmitting body in a respective light transmitting opening to thereby mount said light assemblies in said tubular member when said cover is mounted over said upper open end, wherein said respective light transmitting bodies fill said respective light transmitting openings to thereby substantially seal said light transmitting openings, and said light emitting surfaces facing outwardly from said lighted post to thereby direct light outwardly from said lighted post and wherein said light sources are substantially sealed in said lighted post by said respective light transmitting bodies.

* * * * *

UNITED STATES PATENT AND TRADEMARK OFFICE

CERTIFICATE OF CORRECTION

PATENT NO. : 7,473,016 B2
APPLICATION NO. : 11/265034
DATED : January 6, 2009
INVENTOR(S) : Richard A. Flaherty, Matthew A. Gray and Michael P. Coffey It is certified that error appears in the above-identified patent and that said Letters Patent is hereby corrected as shown below:

Column 26:
Line 14, “priveledge” should be --privilege--.
Line 22, Claim 1,“:” should be --;-- after “opening”.

Column 28:
Line 13, Claim 17, Delete “said” before “light” in the second occurrence.
Line 18, Claim 18, “resepctive” should be --respective--.

Signed and Sealed this

Twenty-fourth Day of March, 2009

JOHN DOLL
*Acting Director of the United States Patent and Trademark Office*